US009773450B2

(12) United States Patent
Takahara

(10) Patent No.: US 9,773,450 B2
(45) Date of Patent: Sep. 26, 2017

(54) EL DISPLAY PANEL WITH GATE DRIVER CIRCUITS MOUNTED ON FLEXIBLE BOARD INCLUDING TERMINAL CONNECTION LINES CONNECTING CONNECTION PARTS AND CONTROL TERMINALS

(71) Applicant: JOLED INC., Tokyo (JP)

(72) Inventor: Hiroshi Takahara, Osaka (JP)

(73) Assignee: JOLED INC., Tokyo (JP)

( * ) Notice: Subject to any disclaimer, the term of this patent is extended or adjusted under 35 U.S.C. 154(b) by 31 days.

(21) Appl. No.: 14/434,851

(22) PCT Filed: Oct. 9, 2013

(86) PCT No.: PCT/JP2013/006030
§ 371 (c)(1),
(2) Date: Apr. 10, 2015

(87) PCT Pub. No.: WO2014/061235
PCT Pub. Date: Apr. 24, 2014

(65) Prior Publication Data

US 2015/0262528 A1 Sep. 17, 2015

(30) Foreign Application Priority Data

Oct. 17, 2012 (JP) ..... 2012-229448

(51) Int. Cl.
*G09G 3/30* (2006.01)
*G09G 3/3258* (2016.01)
(Continued)

(52) U.S. Cl.
CPC ..... *G09G 3/3258* (2013.01); *G09G 3/3225* (2013.01); *G09G 3/3266* (2013.01);
(Continued)

(58) Field of Classification Search
CPC ..... G09G 3/30; G09G 3/32; G09G 3/3208; G09G 3/3216; G09G 3/3225; G09G 3/3233; G09G 3/3266
(Continued)

(56) References Cited

U.S. PATENT DOCUMENTS 6,407,796 B2 6/2002 Tajima et al.
6,847,172 B2 1/2005 Suzuki
(Continued)

FOREIGN PATENT DOCUMENTS

JP 10-214858 8/1998
JP 2001-264731 9/2001
(Continued)

OTHER PUBLICATIONS

U.S. Appl. No. 14/435,189 to Hiroshi Takahara, filed Apr. 13, 2015.
(Continued)

*Primary Examiner* — Alexander Eisen
*Assistant Examiner* — Nelson Lam
(74) *Attorney, Agent, or Firm* — Greenblum & Bernstein, P.L.C.

(57) ABSTRACT

The number of control lines to be formed on a COF in serial connection is reduced. An EL display includes a flexible board including: a plurality of connection terminals arranged at one side for connection with panel lines formed on a panel board; terminal connection lines for connecting points inside the flexible board with the connection terminals; serial connection lines for connecting between two or more of the connection terminals. On the flexible board: driver output terminals of each of gate driver ICs are connected to terminal connection lines; driver input terminals of the gate driver IC are connected to either terminal connection lines or the serial connection lines; and control terminals for performing logic setting of the gate driver IC are each arranged
(Continued)

between connection terminals and driver input terminals to which the serial connection lines are connected.

20 Claims, 57 Drawing Sheets

(51) Int. Cl.
*G09G 3/3225* (2016.01)
*G09G 3/3266* (2016.01)
*G09G 3/3291* (2016.01)

(52) U.S. Cl.
CPC ... *G09G 3/3291* (2013.01); *G09G 2300/0408* (2013.01); *G09G 2300/0426* (2013.01); *G09G 2300/08* (2013.01); *G09G 2300/0809* (2013.01); *G09G 2310/0251* (2013.01); *G09G 2310/0262* (2013.01); *G09G 2310/0286* (2013.01); *G09G 2320/0223* (2013.01); *G09G 2320/064* (2013.01); *G09G 2330/08* (2013.01)

(58) Field of Classification Search
USPC ..... 345/76–83; 315/169.3
See application file for complete search history.

(56) References Cited

U.S. PATENT DOCUMENTS 7,283,193 B2 10/2007 Sugimoto et al.
7,599,193 B2 10/2009 Park et al.
7,705,812 B2 4/2010 Yuda et al.
7,830,489 B2 11/2010 Kim
7,868,865 B2 1/2011 Shin et al.
7,948,768 B2 5/2011 Park et al.
8,130,187 B2 3/2012 Nakao et al.
8,243,107 B2 8/2012 Matsui et al.
8,289,350 B2 10/2012 Matsui et al.
8,294,701 B2 10/2012 Matsui et al.
8,547,307 B2 10/2013 Shirouzu et al.
8,553,023 B2 10/2013 Yoshizaki et al.
8,649,477 B2 2/2014 Matsui
8,692,741 B2 4/2014 Shin
8,699,656 B2 4/2014 Matsui
8,890,778 B2 11/2014 Shirouzu et al.
8,917,227 B2 12/2014 Osako
8,933,870 B2 1/2015 Higashijima et al.
9,049,784 B2 6/2015 Osako
9,111,490 B2 8/2015 Ra et al.
9,129,920 B2 9/2015 Masumoto et al.
9,226,432 B2 12/2015 Yamakita
9,263,510 B2 * 2/2016 Takahara ..... H01L 27/3279
9,595,222 B2 * 3/2017 Takahara ..... G09G 3/3233
2001/0040664 A1 11/2001 Tajima et al.
2002/0180686 A1 12/2002 Yuda et al.
2003/0098657 A1 5/2003 Suzuki
2004/0041766 A1 3/2004 Nakao et al.
2004/0061825 A1 4/2004 Sugimoto et al.
2005/0121796 A1 6/2005 Park et al.
2006/0001621 A1 * 1/2006 Ono ..... G09G 3/3233 345/76
2006/0055649 A1 3/2006 Yuda et al.
2006/0114196 A1 6/2006 Shin et al.
2006/0233003 A1 * 10/2006 Iwanaga ..... G09G 3/20 365/1
2007/0063950 A1 3/2007 Shin
2007/0167036 A1 7/2007 Kim
2008/0048948 A1 * 2/2008 Koh ..... G09G 3/3208 345/80
2008/0150933 A1 6/2008 Toyomura et al.
2009/0073100 A1 * 3/2009 Kim ..... G02F 1/13452 345/92
2009/0184899 A1 * 7/2009 Kim ..... G09G 3/3208 345/76
2009/0251446 A1 * 10/2009 Ogawa ..... G02F 1/13452 345/204
2010/0149775 A1 6/2010 Park et al.
2010/0289788 A1 11/2010 Yoshizaki et al.
2011/0102729 A1 * 5/2011 Kawamura ..... H05K 3/0052 349/158
2011/0273408 A1 11/2011 Ra et al.
2012/0075282 A1 3/2012 Higashijima et al.
2013/0027282 A1 * 1/2013 Kimura ..... G02F 1/13452 345/80
2014/0131693 A1 5/2014 Masumoto et al.
2014/0160674 A1 6/2014 Yamakita
2015/0116194 A1 4/2015 Matsui et al.
2015/0255015 A1 * 9/2015 Takahara ..... G09G 3/3233 345/76
2015/0279272 A1 * 10/2015 Takahara ..... G09G 3/3233 345/76
2016/0163264 A1 * 6/2016 Nishimura ..... G09G 3/3258 345/212
2016/0171933 A1 * 6/2016 Takahara ..... G09G 3/3233 345/212
2016/0372035 A1 12/2016 Nakatani
2017/0076664 A1 * 3/2017 Nakagawa ..... G09G 3/3266

FOREIGN PATENT DOCUMENTS

JP 2002-098939 4/2002
JP 2003-050402 2/2003
JP 2003-167269 6/2003
JP 2003-167551 6/2003
JP 2004-133428 4/2004
JP 2005-167238 6/2005
JP 2006-049514 2/2006
JP 2006-154822 6/2006
JP 2007-086728 4/2007
JP 2007-188078 7/2007
JP 2008-158378 7/2008
JP 2010-145893 7/2010
JP 2010-266715 11/2010
JP 2010-282060 12/2010
JP 2011-237763 11/2011
JP 2012-058748 3/2012
JP 2012-060514 3/2012
JP 2012-068592 4/2012

OTHER PUBLICATIONS

U.S. Appl. No. 14/433,479 to Hiroshi Takahara, filed Apr. 3, 2015.
International Search Report (ISR) in International Patent Application No. PCT/JP2013/006030, dated Jan. 7, 2014.
International Search Report (ISR) in International Patent Application No. PCT/JP2013/005966, dated Jan. 21, 2014.
International Search Report (ISR) in International Patent Application No. PCT/JP2013/005984, dated Dec. 3, 2013.
Office Action from United States Patent and Trademark Office (USPTO) in U.S. Appl. No. 14/433,479, dated Aug. 23, 2016.
Office Action from United States Patent and Trademark Office (USPTO) in U.S. Appl. No. 14/435,189, dated Feb. 7, 2017.

* cited by examiner

| Tap | Ratio | Grayscale |
|---|---|---|
| Vi7 | 1024/1024 | 1023 |
| Vi6 | 2/3 | 683 |
| Vi5 | 1/3 | 341 |
| Vi4 | 1/6 | 171 |
| Vi3 | 1/12 | 85 |
| Vi2 | 1/36 | 27 |
| Vi1 | 1/1024 | 1 |
| Vi0 | 0/1024 | 0 |

PRIOR ART

PRIOR ART

EL DISPLAY PANEL WITH GATE DRIVER CIRCUITS MOUNTED ON FLEXIBLE BOARD INCLUDING TERMINAL CONNECTION LINES CONNECTING CONNECTION PARTS AND CONTROL TERMINALS

TECHNICAL FIELD

The present disclosure relates to pixel configurations made up of pixels each including, for example, an organic electro-luminescence element (hereinafter also referred to as an EL or an OLED), EL displays (EL display panels) on which EL elements are arranged in a matrix, EL display driving methods, driver IC boards for use in EL displays, flexible boards, etc.

BACKGROUND ART

Active-matrix (hereinafter also referred to as AM) organic EL displays on which organic EL elements are arranged in a matrix have been employed as display panels for products such as smartphones. Each EL element has an EL layer between an anode electrode and a cathode electrode. The EL element emits light triggered by a current or a voltage supplied between the anode and cathode electrodes (terminals) (for example, see Patent Literature 1).

The liquid crystal display panel (LCD) includes gate signal lines arranged on a per pixel basis. EL displays each include pixels each including at least two gate signal lines formed or arranged therein, and most of the EL displays include pixels through which three or four gate signal lines are formed or arranged (for example, see Patent Literature 2).

Patent Literature 1 discloses a configuration in which connection transmission lines which electrically connect input transmission lines and output transmission lines on a flexible board (COF (chip on film)) mounting driver ICs of an active-matrix (this may be abbreviated as AM below) organic EL display having organic EL elements in the shape of a matrix.

Patent Literature 2 discloses a configuration in which input signal lines etc. are formed in serial connection on a flexible board mounting driver ICs.]

CITATION LIST

Patent Literature

[PTL 1]
Japanese Unexamined Patent Application Publication No. 2007-188078
[PTL 2]
Japanese Unexamined Patent Application Publication No. 2006-049514

SUMMARY OF INVENTION

Technical Problem

An EL display (EL display panel) does not require a backlight for image display, and thus can be provided with a thin panel module. In order to take advantage of the feature of being able to provide the EL display with such a thin panel, a configuration (PCB-less configuration) without any printed circuit board (PCB) is employed for a gate driver IC side.

In the PCB-less configuration, all of power supply lines and control signal lines need to be formed in a COF. The COF has only a single wiring layer, and thus lines formed in the COF cannot intersect each other. For this reason, there is a need to layout the lines etc. in serial connection so as not to generate any intersection parts of the power supply lines and control lines.

However, since the EL display (EL display panel) has a large number of control signal lines, the density of the lines to be formed on the COF is large, and thus a short circuit defect is likely to occur.

The present disclosure was made considering these problems, and has an object to provide EL displays with a reduced number of control lines formed in serial connection on their COFs, with a high yield rate at low cost.

Solution to Problem

The EL display according to an aspect of the present disclosure includes a panel board on which a plurality of luminescence elements are arranged, and a flexible board on which gate driver ICs for driving the panel board are mounted.

An EL display according to the present disclosure includes: a panel board including a display screen on which pixels each including an EL element are arranged in a matrix; gate signal lines arranged on a per pixel row basis; source signal lines arranged on a per pixel column basis; gate driver circuits mounted on a flexible board; and a source driver circuit which outputs a video signal to the source signal lines. Each of the gate driver circuits includes gate signal output terminals, driver terminals, and control terminals. First connection parts, gate signal connection parts, second connection parts, and third connection parts are arranged on a side of the flexible board. The flexible board includes (i) terminals connection lines which connect terminals and the gate signal connection parts, and (ii) one or more serial connection lines which connect at least two of the connection parts. The control terminals are arranged between the gate signal output terminals and the driver terminals. The gate signal connection parts and the gate signal output terminals are connected with terminal connection lines. The first connection parts, the driver terminals, and the third connection parts are connected with the serial connection lines. Panel lines formed on the panel board are connected to the second connection parts. The second connection parts and the control terminals are connected with terminal connection lines. With this configuration, it is possible to reduce the number of control lines to be formed in serial connection on the COF, and thereby to provide the EL display at low cost, resulting in a high yield rate.

It is to be noted that the driver terminals of the EL display according to the present disclosure may be driver terminals which apply a voltage to the gate driver ICs.

Advantageous Effects of Invention

According to the present disclosure, it is possible to reduce the number of control lines to be formed in serial connection on each of the COFs, and thereby to provide EL displays at low cost, resulting in a high yield rate.

DESCRIPTION OF EMBODIMENTS

Figure 1:
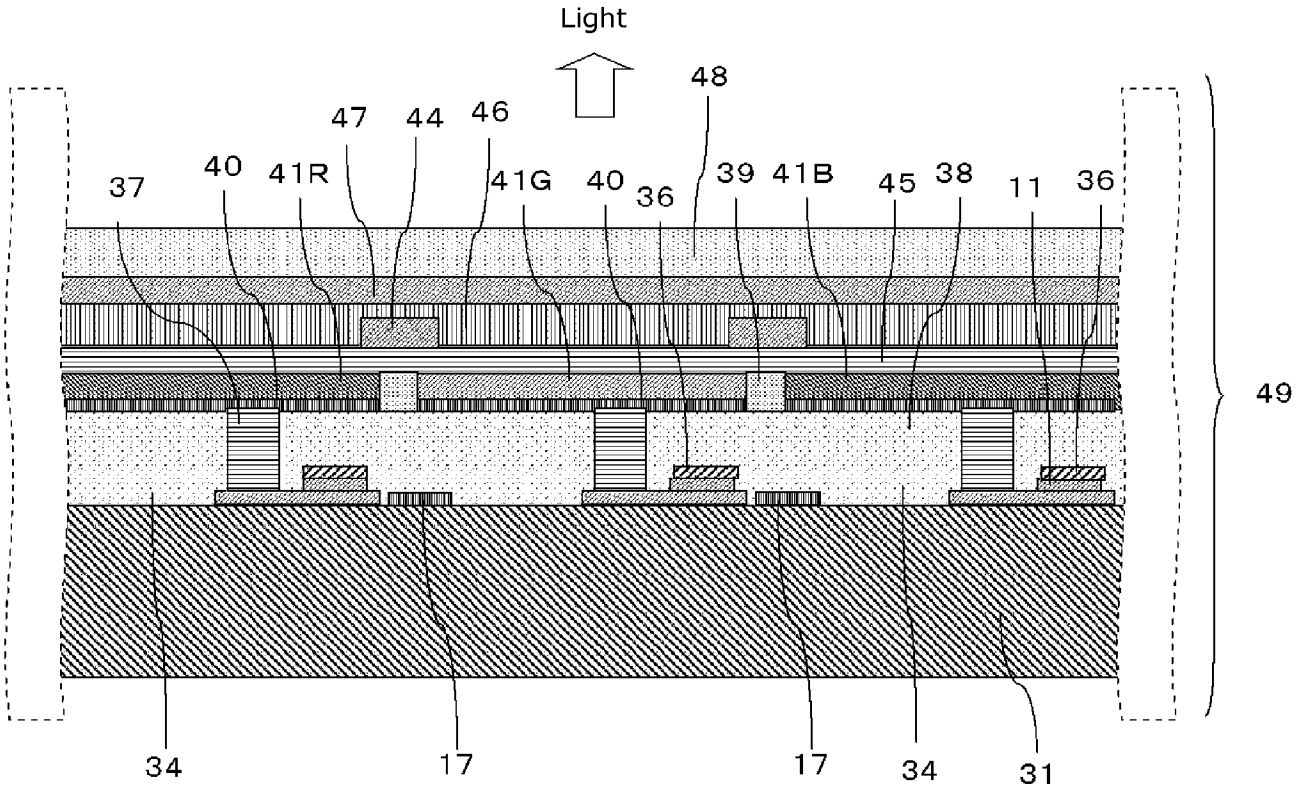
FIG. 1 is a cross sectional view of a configuration of an EL display according to an embodiment.

Hereinafter, embodiments are described in detail referring to the drawings as appropriate. Unnecessarily detailed descriptions may be omitted. For example, already well-known matters may not be described in detail, and substantially the same configurations may not be described repeatedly. This omission etc. is performed to prevent the following descriptions from being unnecessarily redundant, and to thereby allow any person skilled in the art to easily understand the descriptions.

The Inventors provide the attached drawings and the following descriptions to allow the person skilled in the art to fully understand the present disclosure, without any intention to limit the subject matter of the claims by the drawings and descriptions.

(Underlying Knowledge Forming Basis of the Present Disclosure)

The underlying knowledge forming the basis of the present disclosure is described before the present disclosure is described in detail.

A liquid crystal display panel (LCD) includes gate signal lines formed or arranged on a per pixel basis. On the other hand, an EL display (hereinafter also referred to as an "EL display panel" in the embodiments) includes gate signal lines formed or arranged such that at least two gate signal lines pass through each of pixels. For example, in most EL displays, three or four gate signal lines are formed or arranged on a per pixel basis.

In view of the above-described matters, the EL displays are configured to have a considerably larger number of gate signal lines than that of the LCDs.

An LCD requires an on voltage (Von), an off voltage (Voff), a logic voltage (Vcc), and a video signal voltage (AVdd).

An EL display requires several kinds of on voltages (Von) and also several kinds of off voltages (Voff). The EL display requires also a video signal voltage (AVdd) and a logic voltage (Vcc). The EL display may require an initial voltage (Vini), a reset voltage (Vrst) etc. depending on a pixel circuit configuration. The EL display also requires an anode voltage (Vdd) and a cathode voltage (Vss). In addition, the plurality of gate signal lines each of which controls a corresponding one of pixels operate differently, and control signals for controlling the respective gate signal lines to operate are also required. For this reason, the number of control signals is also large. Accordingly, the number of control signal lines and the number of power supply lines in the EL display are four to five times larger than those of the LCD.

Figure 48:
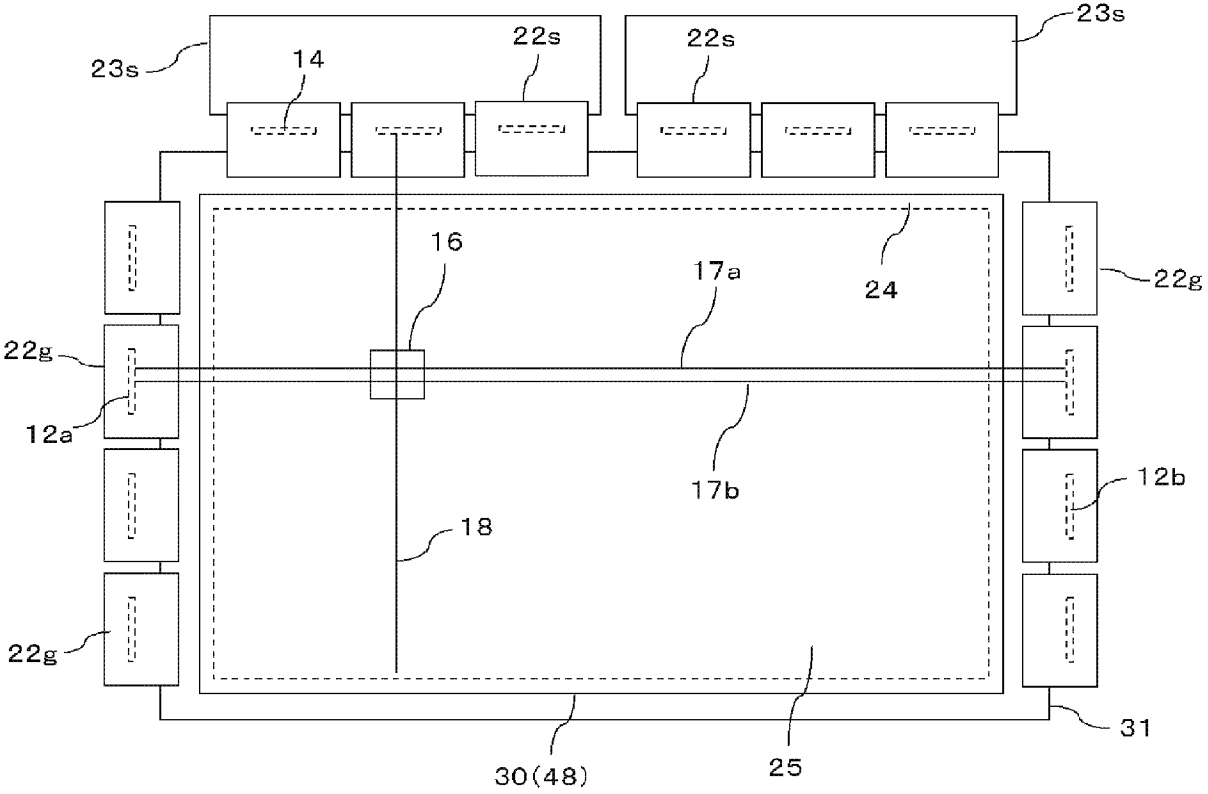
FIG. 48 is a diagram for explaining an EL display.

As illustrated in FIG. 48, gate driver ICs 12 (12*a*, 12*b*) and source driver ICs (source driver circuits) 14 are mounted on a COF. In addition, as illustrated in FIG. 48, both ends of gate signal lines 17*a* and 17*b* are connected to the gate driver ICs 12 (12*a*, 12*b*). The gate driver ICs 12 (12*a*, 12*b*) are mounted on each of COFs 22*g*.

Likewise, each pixel 16 is connected to a corresponding one of source signal lines 18. Each source signal line 18 has an end connected to a corresponding one of the source driver ICs 14 mounted on a corresponding one of the COF 22*s*. A printed circuit board (PCB) is connected to the corresponding COF 22*s*, and a video signal and a control signal are applied from the printed board (PCB) to the corresponding COF 22*s*.

COFs 22*s* with the source drivers IC 14 are mounted onto a panel. In addition, a printed circuit board (PCB) 23*s* is attached to each COF 22*s*.

In the present disclosure, circuits for driving gate signal lines are described as gate driver ICs 12, but the present disclosure is not limited thereto. For example, the gate driver ICs 12 may be directly formed on a display panel board at the same time when processes of forming a pixel circuit etc. are performed, according to a technique using TAOS, or a low or high temperature polysilicon. In other words, the gate driver ICs are not limited to semiconductor chips, and means gate driver circuits. This applies to the source driver ICs 14, that is, the source driver ICs are not limited to semiconductor chips, and means source driver circuits. Needless to say, no COF is required when driver ICs are directly formed onto a display panel board at the same time when processes of forming a pixel circuit etc. are performed, according to the technique using TAOS, or a low or high temperature polysilicon.

The COF 22*g* with the gate driver ICs 12 is also mounted onto the panel. No printed circuit board (PCB) is attached to the COF 22*g*. Stated differently, this is a configuration without any printed circuit board (PCB-less configuration). By employing such a printed circuit board without any PCB (the PCB-less configuration), a thin panel module can be configured.

Figure 49:
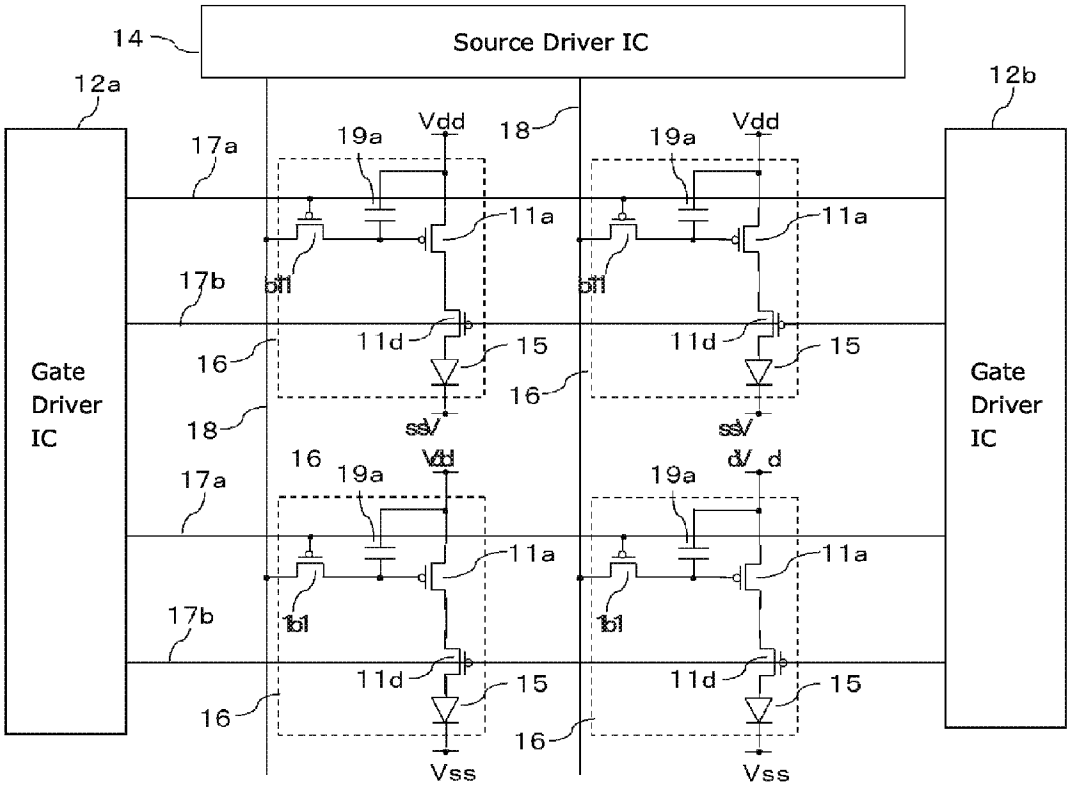
FIG. 49 is a diagram for explaining an EL display.

FIG. 49 is a diagram for explaining pixels, driver ICs, etc. of an EL display.

In each of pixels 16 in FIG. 49, the source terminal of a switch transistor 11*d* is connected to the drain terminal of a P-channel driver transistor 11*a*, and the anode terminal of an EL element 15 is connected to the drain terminal of the switch transistor 11*d*.

A cathode voltage Vss is applied to the cathode terminal of an EL element 15. An anode voltage Vdd is applied to the source terminal of the driver transistor 11*a*.

When an on voltage is applied to a gate signal line 17*b* (Gd), the switch transistor 11*d* is turned on, and a current for light emission is supplied from the driver transistor 11*a* to the EL element 15. The EL element 15 emits light based on the magnitude of the current for light emission. The magnitude of the current for light emission is determined by applying the pixel 16 with a video signal applied to a source signal line 18, using a switch transistor 11*b*.

A terminal of a capacitor 19*b* is connected to the gate terminal of the driver transistor 11*a*, and the other terminal of the capacitor 19*b* is connected to an electrode or seven lines to which an anode voltage (Vdd) is applied. The source terminal of the switch transistor 11*b* is connected to the source signal line 18, and the drain terminal of the switch transistor 11*b* is connected to the gate terminal of the driver transistor 11*a*. On the other hand, a source driver IC 14 applies the source signal line 18 with a video signal.

The gate signal lines 17 (17*a*, 17*b*) are connected to the gate driver ICs 12 (12*a*, 12*b*) arranged right and left of a display screen 25.

The gate driver ICs 12 (12*a*, 12*b*) apply selection voltages (on voltages Von) of the pixels 16 to the gate signal lines 17. The applied on voltages of the gate signal lines 17*b* turn on the switch transistors 11*b*, and video signals applied to the source signal lines 18 are applied to the pixels 16.

An EL display panel 49 has the display screen 25 on which the pixels 16 each including the EL element 15 are arranged in a matrix.

With the configuration, even when the display screen is large or for high definition display, it is possible to apply the pixels on the display screen with video signals effectively. In addition, it is possible to prevent luminance slope from occurring on the display screen, and provide excellent image display.

It is to be noted that the driver terminals of the EL display according to the present disclosure may be driver terminals which apply voltages to the gate driver ICs.

In addition, an EL display does not require a backlight for image display, and thus can be provided with a thin panel module. In order to take advantage of the feature of being able to provide the EL display with such a thin panel, a PCB-less configuration is employed for the gate driver ICs 12 (12*a*, 12*b*) side as illustrated in FIG. 48.

When PCBs are used, it is only necessary that power supply lines and control signal lines for use in the gate driver ICs 12 (12*a*, 12*b*) are supplied from the PCBs.

Figure 50:
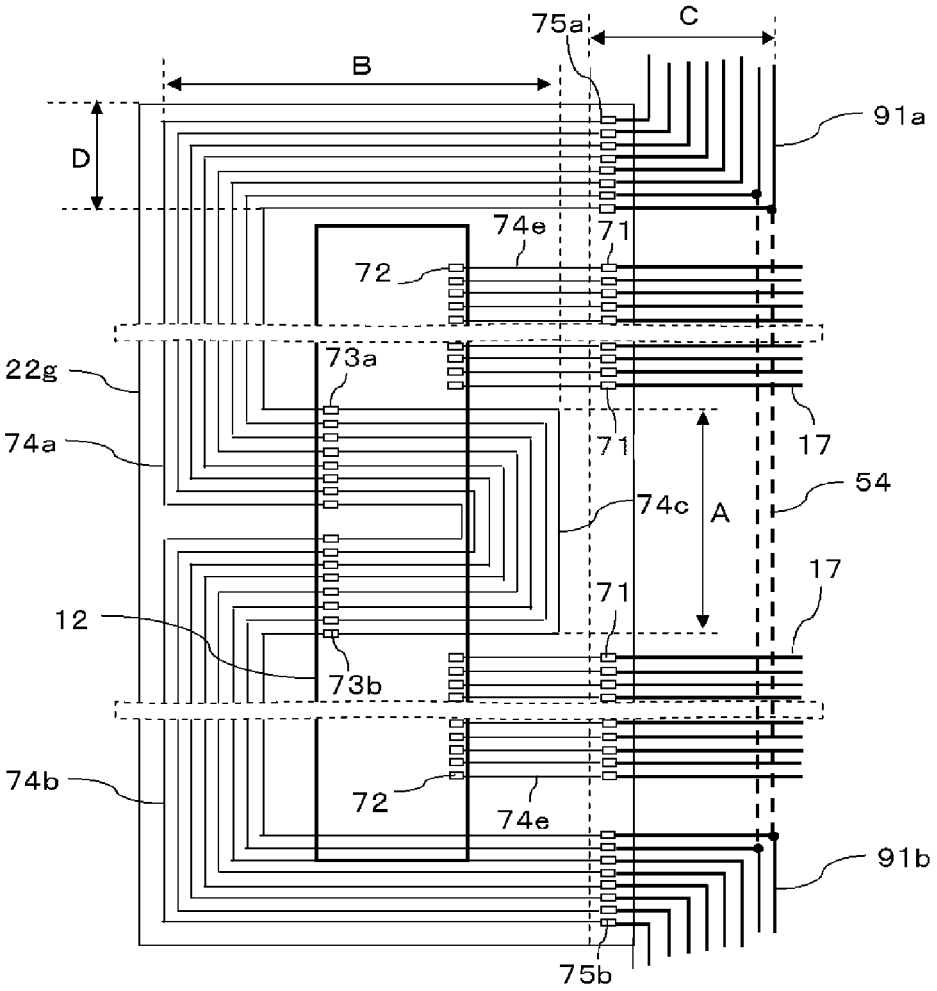
FIG. 50 PRIOR ART
FIG. 50 is a diagram for explaining a COF part of a conventional EL display.

In the configuration without any PCB (PCB-less configuration) as illustrated in FIG. 48, all of the power supply lines and control lines need to be formed on the COF 22*g* as illustrated in FIG. 50. The COFs have only a single wiring layer, and thus lines formed on the COFs 22 cannot intersect each other. For this reason, there is a need to perform wiring layout etc. in serial connection so as not to generate any intersection parts of the power supply lines and control lines as illustrated in FIG. 50.

In FIG. 50, a panel line 91*a* formed on a panel board 31 and a COF line 74*a* of the COF 22*g* are connected using an ACF resin at a connection terminal 75*a*. The COF line 74*a* is electrically connected to a driver input terminal 73*a* of a gate driver IC C12. The driver input terminal 73*a* and a driver input terminal 73*b* are connected through a COF line 74*c*. In addition, the driver input terminal 73*b* and a connection terminal 75*b* are electrically connected through a COF line 74*b*. In addition, a panel line 91*b* formed on the panel board 31 and the COF line 74*b* of the COF 22*g* are connected using the ACF resin at a connection part 75*b*.

As described above, the wiring layout is realized on the panel board 31 in the following serial connection: from the panel line 91*a* via the connection terminal 75*a* via the COF line 74*a* via the driver input terminal 73*a* via the COF line 74*c* via the driver input terminal 73*b* via the COF line 74*b* via the connection terminal 75*b* to the panel line 91*b*.

It is to be noted that outputs of the gate driver ICs 12 are output from driver output terminals 72. The driver output terminals 72 and connection terminals 71 are electrically connected through COF lines 74*e*. The driver output terminals 72 are electrically connected to gate signal lines 17 using ACF resin.

EL displays each include pixels passed through by at least two gate signal lines, and most of the EL displays include pixels passed through by three or four gate signal lines.

In view of the above-described matters, the EL displays are configured to have a considerably larger number of signal lines than that of the LCDs. Accordingly, the number of control signal lines for controlling the gate signal lines 17 etc. is also large.

The respective gate signal lines of the pixels are for controlling different transistors, and require different voltage amplitudes. Accordingly, an EL display requires several kinds of on voltages (Von) and also requires several kinds of off voltages (Voff). In addition, an initial voltage (Vini) and a reset voltage (Vrst), etc. may be required. In addition, the plurality of gate signal lines each of which controls a corresponding one of pixels operate differently, and control signals for controlling operations of the respective gate signal lines are also required. For this reason, the number of control signals is also large. Accordingly, the number of control signal lines and the number of power supply lines in the EL display are four to five times larger than those in an LCD.

Since the EL display has such a large number of power supply lines and such a large number of control lines, the number of lines to be formed on the COF 22*g* is extremely large. In general, the number is tree times larger than that of the LCD.

Since the number of power supply lines and the number of control lines to be formed on the COF are large as illustrated in FIG. 48, Distance D, Distance A, and Distance B of the COF 22*g* in FIG. 50 need to be long in order to realize such a PCB-less configuration. For this reason, the size of the COF 22*g* needs to be large, increasing the cost. The display screen size of the EL display is determined by the inches of the display screen of the panel, and thus the distance usable in COF mounting (the width within which the COFs can be attached) is also determined by the inches of the display screen of the panel. Accordingly, if the size of COFs is too large, the distance usable in COF mounting (the width within which the COFs can be attached×the number of COFs) exceeds the width of the display screen. For this reason, if the size of COFs is increased too much, it is physically impossible to mount the COFs on a panel.

If Distance A in the COF 22*g* is long, the range within which the driver output terminals 72 are formed is reduced. Alternatively, the long sides of the chips of the gate drivers IC 12 need to be lengthened. This results in increase in the size of the gate driver ICs 12, increasing the price of the gate driver ICs.

In order to reduce the number of COF lines 74 to be formed on the COF 22*g*, a means for forming array connection lines 54 as illustrated in FIG. 50 is conceivable. The array connection lines 54 are formed in a process of forming pixels on the panel, and thus intersection parts of lines can be formed. Accordingly, a complex wiring pattern and branches of lines can be formed.

However, since the array connection lines 54 each intersects with the gate signal lines 17, if a pin hole exists at any of the intersection parts, the corresponding one of the array connection lines 54 and the gate signal lines 17 is short circuited. The EL display has a large number of gate signal lines 17. For this reason, the number of gate driver output terminals per gate driver IC 12 is also large. Accordingly, the number of intersection parts between the array connection lines 54 and the gate signal lines 17 is large, and thus short-circuit defects are likely to occur. In particular, the part on which the array connection lines 54 are formed is not provided with any protection cover, and is likely to be damaged mechanically. For this reason, short-circuit defects are likely to occur at the intersection parts.

In view of the above, the COFs 22*g* with the gate driver ICs 12 are mounted on and connected to the panel board 31, and, in the EL display having such a PCB-less configuration has the constraints below.

One of the constraints is (1) the lines 74 formed on each COF 22*g* cannot intersect with any line. The other is (2) the gate signal lines 17 on the panel board cannot intersect with the input signal lines and the power lines, or if the gate signal lines 17 on the panel board intersect with the input signal lines and the power lines, there is a high risk that any of the intersection parts is short-circuited, resulting in a significant reduction in the panel manufacturing yield.

As described above, it was difficult to provide an EL display having a panel board 31 on and to which COFs 22*g* with gate driver ICs 12 are mounted and connected and has such a PCB-less configuration.

In view of this, in embodiments below, descriptions are given of EL displays each having a reduced number of control lines formed in serial connection on a COF, and thereby reducing the cost and increasing the yield.

EMBODIMENTS

Hereinafter, displays according to embodiments are described with reference to FIGS. 1 to 8B.

Figure 2:
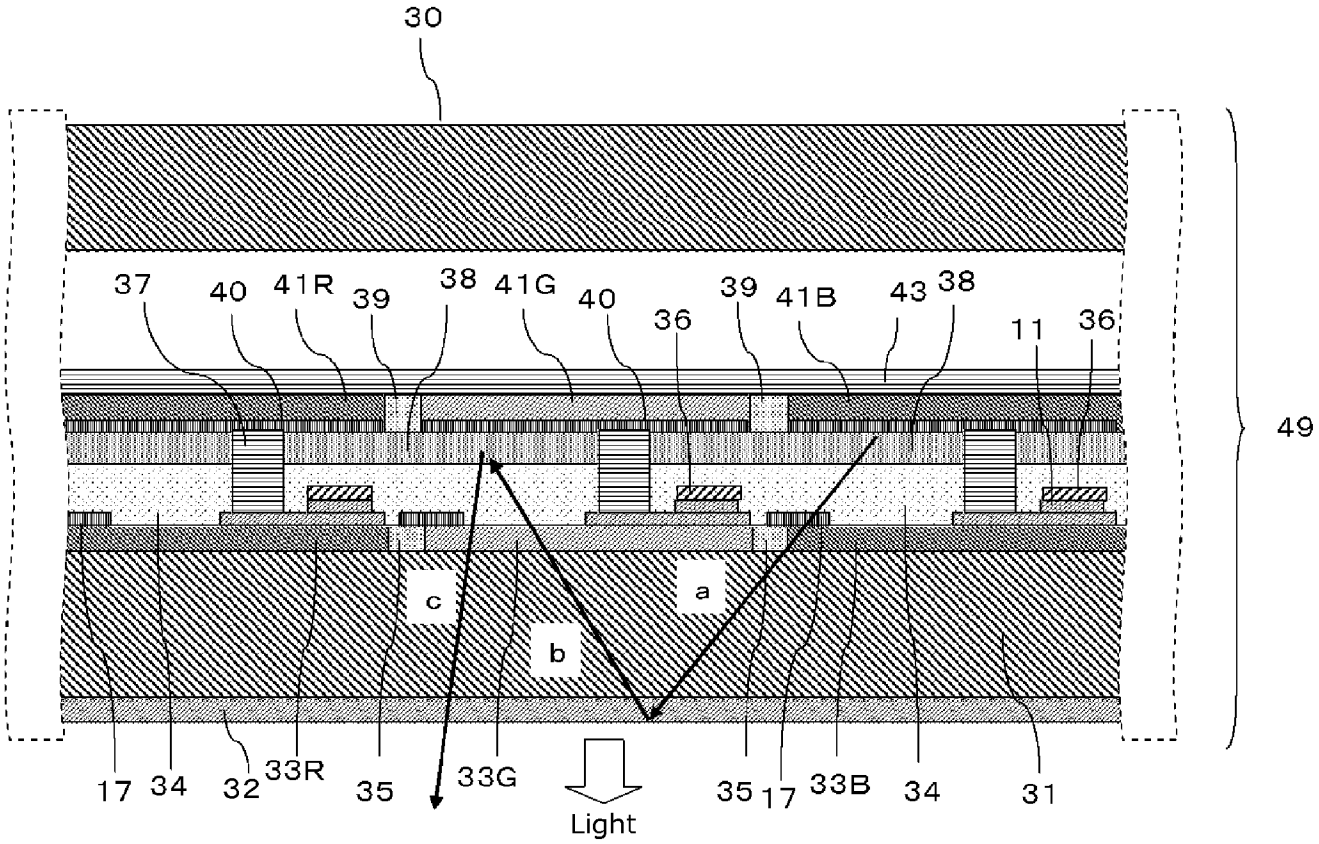
FIG. 2 is a cross sectional view of a configuration of an EL display according to an embodiment.

Each of FIGS. 1 and 2 is a cross sectional view of a configuration of the EL display according to an embodiment.

In the present disclosure, the drawings include omitted, magnified or reduced portions for help understanding or creation of the drawings. For example, a glass substrate 48 etc. are thin in the cross sectional view of a display panel illustrated in FIG. 1. In FIG. 2, a sealing substrate 30 is thin.

Examples of omitted parts are indicated below. In the EL display in FIG. 1 according to the present disclosure, it is necessary to arrange a phase film such as a circularly polarizing plate for prevention of reflected light on a light emission surface. However, in FIG. 1, such a circularly polarizing plate is not illustrated.

On the light emission surface, a glareproof sheet having an uneven surface is formed or arranged in order to prevent natural light from being reflected on the light emission surface. However, such a glareproof sheet is not illustrated in FIGS. 1 and 2. A sheet of a reflection prevention film or a reflection prevention film is not illustrated in the drawings, either.

In the following descriptions, the connection terminal 75*a* corresponds to a first connection part in the present disclosure. The connection terminal 71 corresponds to a gate signal connection part in the present disclosure. The connection terminal 75*b* corresponds to a third connection part in the present disclosure. The driver output terminals 72 correspond to gate signal output terminals in the present disclosure. The driver input terminals 73*a* and 73*b* correspond to driver terminals in the present disclosure. The connection terminal 75*c* corresponds to a second connection part in the present disclosure. The COF lines 74*a*, 74*b*, and 74*c* correspond to serial connection lines in the present disclosure. The COF lines 74*d* and 74*e* correspond to terminal connection lines in the present disclosure. Input control lines 261 correspond to panel lines in the present disclosure.

Each of FIGS. 1 and 2 is a cross sectional diagram of an EL display panel according to the present disclosure. Parts unnecessary for explanation are not illustrated. The thickness, size, etc. of some part are magnified or reduced to simplify explanation. The above-described matters apply to the other drawings.

FIG. 1 illustrates the embodiment that is a display for "top light extraction" in which light is extracted from a top surface of a panel board 31. FIG. 2 illustrates the embodiment that is a display for "bottom light extraction" in which light is extracted from a bottom surface of a panel board 31.

A sealing substrate 30 and the panel board 31 are each, for example, a glass substrate. Each of the sealing substrate 30 and the panel board 31 may be formed using a silicon wafer, a metal substrate, a ceramic substrate, a plastic sheet (plate), or the like. In order to provide excellent heat dissipation, each of the sealing substrate 30 and the panel board 31 may of course be made of sapphire glass, or the like.

As illustrated in FIG. 2, a drying agent (not illustrated) is placed in a space between a sealing substrate 30 and a panel board 31. This is because an EL film 41 is susceptible to humidity. The drying agent absorbs water content infiltrated in a sealing agent (not illustrated), and prevents the EL film 41 from deteriorating. In addition, the peripheral parts of the sealing substrate 30 and the panel board 31 are sealed with a sealing resin (not illustrated).

The sealing substrate 30 has, for example, a cap shape. The sealing substrate 30 is a means for preventing or controlling infiltration of water content from outside, and the shape thereof is not limited to the cap shape. The sealing substrate 30 may be made of fusion glass. Alternatively, the sealing substrate 30 may be a compound of a resin, an inorganic material, or/and the like. The sealing substrate 30 is formed to be a thin film using vapor deposition technique or the like.

Temperature sensors (not illustrated) are formed or arranged in a space between the sealing substrate 30 and the panel board 31, on e.g. a surface of the sealing substrate 30. Depending on the results of outputs from these temperature sensors, the amplitudes of videos output from a source driver IC 14 etc. are varied. In addition, at the time when the panel is tested, the operation speeds of gate drivers IC 12 are adjusted based on the temperatures output from these temperature sensors. With the speed adjustment, appropriate operation speeds can be set.

A COF in the present disclosure is formed to absorb light by applying or forming a light absorbing composition or material to a surface of the COF, or bonding a sheet to the surface thereof. In addition, a heat dissipation plate is arranged or formed on the surfaces of driver ICs mounted on the COF, so as to dissipate heat from the driver ICs. In addition, a heat dissipation sheet and a heat dissipation plate are arranged or formed on the rear surface of the COF, so as to dissipate heat from the driver ICs.

In FIG. 2, on the panel board 31, color filters 33 (33R, 33G, 33B) representing red (R), green (G), and blue (B) are formed. The color filters for use are not limited to RGB. Pixels of cyan (C), magenta (M), and yellow (Y) may be formed.

Here, aperture rates of R, G, and B pixels may be varied. By varying the aperture rates, it is possible to vary the densities of currents flowing in the respective R, G, and B EL elements 15. By varying the densities of currents, it is possible to equalize deterioration speeds of the respective R, G, and B EL elements 15. By equalizing the deterioration speeds, the white balance of the EL display is retained.

The display in the present disclosure has pixels 16W of W (white), in addition to pixels of three primary colors of RGB. An excellent color peak luminance can be obtained by forming or arranging the pixels 16W. Furthermore, a high luminance display can be realized.

Each of the pixels 16 of the EL panel (EL display) in the present disclosure is configured to have switch transistors 11 and an EL element 15 as illustrated in FIG. 49, etc.

An insulation layer is formed between gate signal lines 17 etc. and color filters 33, but the insulation layer is not illustrated because no explanation thereof is necessary. This applies to the other embodiments.

As illustrated in FIG. 2, anode electrodes 40 is configured to overlap with gate signal lines 17. Alternatively, in most cases, the gate signal lines 17 and the anode electrodes 40 are arranged in an overlapped manner in designing a pattern layout.

An insulation film 34 is formed on the color filters 33 (33R, 33G, and 33B). The insulation film 34 prevents EL films 41 etc. from deteriorating due to water content exuded from the color filters 33. The insulation film 34 functions also as a smoothing film.

Transistors 11 which constitute pixels 16 are formed on a layer above the color filters 33. A light blocking film 36 is formed on the transistors 11. As necessary, a light blocking film 36 is formed on a layer below the transistors 11, and a layer below or above gate driver circuits. The anode electrodes 40 and the transistors 11 are connected at connection parts 37.

The light blocking film 36 is formed with a metal thin film made of chromium or the like, to have a film thickness ranging from 50 nm to 150 nm inclusive. A thin light blocking film 36 provides a small light blocking effect, while a thick light blocking film 36 makes it difficult to pattern transistors 11 in a layer above the light blocking film 36 due to unevenness of the light blocking film 36.

By arranging or forming source signal lines 18, the anode electrodes 40 or cathode electrodes above the gate signal lines 17, electric fields from the source signal lines 18 and the gate signal lines 17 are blocked by the anode electrodes 40 or the cathode electrodes. With this blocking, it is possible to reduce noise in image display.

An insulation film or an insulation film (planarizing film) 34 made of an acrylic material is formed to insulate the source signal lines 18 and the gate signal lines 17, and the anode electrodes 40 are formed on the insulation film 34.

Such a configuration in which the anode electrodes 40 are overlapped at least partly above the gate signal lines 17 etc. is referred to as a high aperture (HA) structure. This configuration reduces unnecessary interference light etc. and realizes an excellent light emission state.

The insulation film (planarizing film) 34 functions also as an inter-layer insulation film. The insulation film (planarizing film) 34 reduces parasitic capacitances of the gate signal lines 17 etc. and the anode electrodes 40. In order to reduce the parasitic capacitances, the insulation film (planarizing film) 34 is formed to have a thickness of 0.4 μm or larger. However, a thin insulation film 34 increases connection errors at the connection parts 37. For this reason, the insulation film 34 is configured or formed to have a thickness of 2.0 μm or smaller.

An insulation film 34 having a thickness of 0.4 μm or smaller causes an inter-layer insulation error, reducing the yield. An insulation film 34 having a thickness of 2.0 μm or larger makes it difficult to form contact connection parts, which causes insufficient contact, reducing the yield.

As the anode electrodes 40 of the pixels 16, transparent electrodes made of ITO, IGZO, IZO, TAOS, or the like can be used.

The parasitic capacitances occurring between the anode electrodes 40 and the gate signal lines 17 affect rise and fall times of the gate signal lines 17. The gate signal lines 17 for which a fast response is required is driven by the gate driver ICs 12 connected from outside. An anode voltage, a cathode voltage, etc. are supplied from rings (not illustrated) reinforced using reinforcement lines (not illustrated) of the COF 22. Accordingly, falls of voltages such as the anode voltages are small irrespective of the positions in the display screen.

A light scattering film 38 contributes to increase in light emitted from the panel. Light generated from one of the EL films 41 of the EL elements enters the panel board 31 (Trajectory a) and emitted from the panel board 31. However, when the light is incident on the light emission surface of the panel board 31 with a light incident angle larger than a critical angle, the incident light is reflected and returns to the EL film 41 (a trajectory b).

The light scattering film 38 is preferably formed to have a film thickness ranging from 0.1 (μm) to 1.5 (μm) inclusive, depending on a light diffusion performance.

It is to be noted that a circularly polarizing plate (circularly polarizing film) 32 is arranged on the light emission surface of the panel board 31. An integrated one of a polarizing plate and a phase film is referred to as a circularly polarizing plate (circularly polarizing film).

In a conventional EL display panel, the light having Trajectory b is diffused on the EL display panel and is absorbed therein. Accordingly, the light having Trajectory b is absorbed therein, and is not emitted from the panel to outside.

On the EL display panel according to the present disclosure, the light having Trajectory b is diffused on the light scattering film 38, and the trajectory of the light changes. As the result of the change in the trajectory, the light whose angle is reduced at or below the critical angle on the light emission surface of the panel is emitted from the panel (Trajectory c).

In this way, the trajectory of the light reflected on the boundary face of the panel is changed to be emitted from the panel to outside. Accordingly, the EL display panel has a high light utilization rate, and realizes a high luminance display.

Although the light scattering film 38 is formed above the insulation film 34 in the above non-limiting example, the light scattering film 38 may be formed in a layer below the insulation film 34.

In the peripheral parts of the color filters 33, a black matrix (BM) may be formed. Preferably, the black matrix (BM) is configured with a light absorbing film having a light absorbing property. This is because halation light in the panel can be reduced.

Examples of materials for use as a light absorbing film includes a material obtained by including carbon in an organic material such as acrylic resin, a material obtained by dispersing a black dye or a pigment in an organic resin, and a material such as a color filter obtained by dyeing using gelatin or casein using a block acid dye.

Alternatively, a material obtained using a fluoran dye representing a black color may be used, or a black color obtained by mixing a green dye and a red dye can also be used. Other examples include a $PrMnO_3$ film formed by sputtering, a phthalocyanine film formed by plasma polymerization.

Ribs (banks) 39 are formed in the peripheral parts of the anode electrodes 40. Ribs (banks) are also used as ribs (banks) 39 for use in mask deposition for ELs. The ribs (banks) 39 are used as contact parts of deposition masks to form EL films 41 (41R, 41G, 41B).

On the EL films 41, cathode electrodes 43 made of a metal material is formed. Examples of materials for use as the cathode electrodes 43 include silver (Ag), aluminum (Al), magnesium (Mg), calcium (Ca), or an alloy containing one or more of these metals. An example is a composition of Mg and Ag. In addition, it is also possible to use transparent electrodes made of ITO, IGZO, IZO, TAOS, or the like, depending on the structure of each EL element 15.

Needless to say, the above embodiments are also applicable to other embodiments in the present disclosure. In addition, the above embodiments can of course be combined with other embodiments.

As illustrated in FIG. 1, in the EL display of the "top light extraction", EL films 41 are formed, and on the EL films 41, a magnesium and silver (Mg and Ag) films to be cathodes (or anodes) are formed to have a film thickness ranging from 20 angstrom to 300 angstrom inclusive. In addition, it is preferable that transparent electrodes made of ITO or the like is formed on the Mg and Ag films as necessary in order for resistance reduction.

In addition, in the EL display of "top light extraction", a low resistance line 44 made of a metal thin film in a layer above or below the cathode electrodes. Examples of compositions for use as the low resistance line 44 are the same as in a black matrix (BM) of a liquid crystal display panel. For example, chromium (Cr), aluminium (Al), titanium (Ti), and copper (Cu) may be used. Other examples include a three layer configuration of Ti, Cu, and Ti, and a three layer composition of Ti, Al, and Ti. Alternatively, an alloy of metal materials may be formed. Needless to say, the configurations, methods, and other details are also applicable to rings (not illustrated).

A thicker BM film is easy to have a reduced resistance and preferable. However, considering an unevenness problem, the film thickness thereof is set to be a range from 200 (nm) to 800 (nm) inclusive. The BM 44 is formed corresponding to the position of pixels 16 and the anode electrodes 40. In other words, the BM 44 is mainly formed between pixel electrodes.

It is to be noted that a BM 44 may be formed for each of groups of R, G, B, and (W) pixels, or for each of a plurality of groups of R, G, B, and (W) pixels. The BM 44 may be formed on the layer above the gate driver ICs 12. This is because the BM 44 functions as a light blocking film, to prevent operation errors of the gate driver ICs 12.

Although the BM 44 has been described above, the BM 44 is different from an BM in LCD because there is no need to form an BM in an organic EL. A low resistance line (BM) 44 does not always need to be formed on a layer above optically transparent electrodes, and may be formed on a layer below optically transparent electrodes. Alternatively, a low resistance line (BM) 44 may be stacked with cathode electrodes and anode electrodes.

In addition, preferably, a sheet resistance value or a resistance value per unit length of an BM 44 varies corresponding to the part of a display screen 25. A voltage decreases significantly at the center part or a part with many voltage supply points of the display screen 25. For this reason, with increase in the distances from the voltage supply points, the BM 44 is made wider or the resistance value is reduced by thickening the BM 44. The resistance value or the sheet resistance value of the BM 44 is reduced more significantly with decrease in the distance to the center part of the display screen 25 by widening or thickening the BM 44.

An BM 44 can be formed thick when designing a panel. An BM 44 can be formed thick at the part corresponding to the center part of a display screen 25 by depositing the material of the BM 44 in a distribution. For example, a concentric circle like distribution of film thicknesses is generated.

A glass substrate 48 is bonded with a bonding layer 47. The glass substrate 48 may be a thin sealing film. Alternatively, a glass substrate 48 may be configured as a sealing film.

When using a sealing film (thin sealing film) as a replacement for the glass substrate 48, for example, a DLC film with diamond like carbon deposited thereon may be used. This film has a high moisture proof performance. This film is used as a sealing film.

Needless to say, the DLC film or the like may be directly deposited on the surfaces of the cathode electrodes 43. Alternatively, a thin sealing film may be formed by stacking a thin resin film and a thin metal film.

Figure 3:
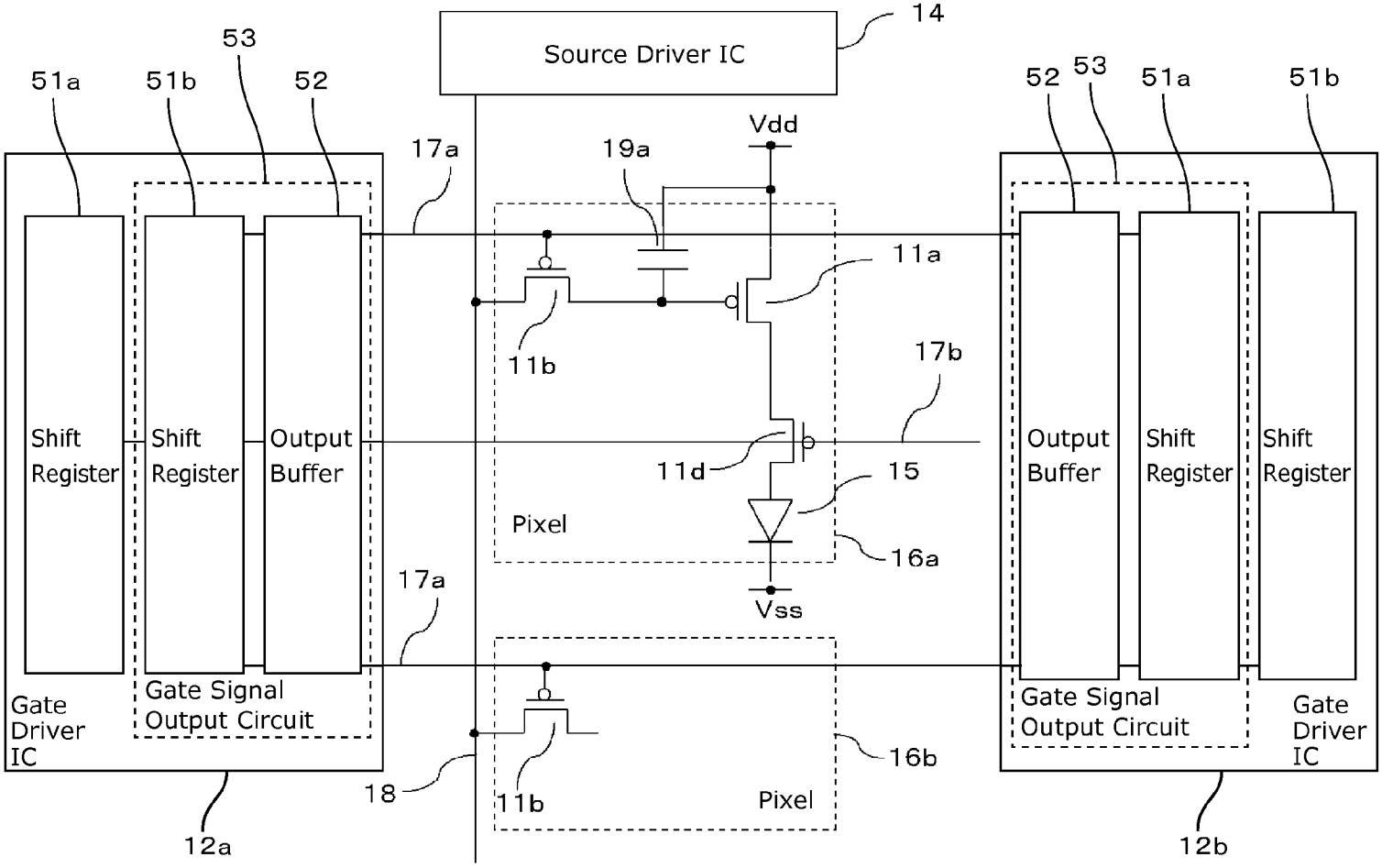
FIG. 3 is a diagram for explaining an EL display according to an embodiment.

FIG. 3 is a diagram for explaining an EL display according to the present disclosure. In a pixel 16*a* in FIG. 3, the source terminal of a switch transistor 11*d* is connected to the drain terminal of a P-channel driver transistor 11*a*, and the anode terminal of an EL element 15 is connected to the drain terminal of the switch transistor 11*d*.

A cathode voltage Vss is applied to the cathode terminal of the EL element 15. An anode voltage Vdd is applied to the source terminal of the driver transistor 11*a*. There is a relationship of the anode voltage Vdd>the cathode voltage Vss.

Here, the anode voltage is variable based on a maximum amplitude of a video signal to be output by a source driver IC 14.

In addition, by turning on or off the switch transistor 11*d*, a duty drive is performed.

When an on voltage is applied to a gate signal line 17*b*, the switch transistor 11*d* is turned on, and a current for light emission is supplied from the driver transistor 11*a* to the EL element 15. The EL element 15 emits light based on the magnitude of the current for light emission. The magnitude of the current for light emission is determined by applying a video signal applied to a source signal line 18 to the pixel 16*a* using the switch transistor 11*b*.

A first terminal of a capacitor 19*a* is connected to the gate terminal of the driver transistor 11*a*, and the first terminal of the capacitor 19*a* is connected to the drain terminal of the switch transistor 11*b*. The source terminal of the switch transistor 11*b* is connected to the source signal line 18. The applied on voltage of the gate signal line 17*a* turns on the switch transistor 11*a*, and a video signal Vs (voltage, current) applied to the source signal line 18 is applied to the pixel 16*a*.

The first terminal of the capacitor 19*a* is connected to the drain terminal of the switch transistor 11*b*, and the second terminal is connected to the anode electrode and receives an anode voltage Vdd.

Although the second terminal of the capacitor 19*a* is connected to the anode electrode 40 and receives the anode voltage Vdd, this is a non-limiting example. For example, another arbitrary direct voltage is applied thereto.

Although the source terminal of the driver transistor 11*a* is connected to the anode electrode 40 and receives the anode voltage Vdd, this is a non-limiting example. For example, another arbitrary direct voltage is applied thereto. In other words, the second terminal of the capacitor 19*a* and the source terminal of the driver transistor 11*a* may be connected to terminals having different potentials.

A gate driver IC 12*a* and a gate driver IC 12*b* are connected to the gate signal line 17*a* which drives the switch transistor 11*b* for applying the pixel 16*a* with a video signal Vs. As an example, the gate driver IC 12*a* is arranged left of the display screen 25, and the gate driver IC 12*b* is arranged right of the display screen 25 (refer to FIG. 24 described later).

As illustrated in FIG. 3, in each of the gate driver ICs 12 (12*a*, 12*b*), shift registers 51 (51*a*, 51*b*) which specify a gate signal line to which an on voltage is applied and an output buffer 52 which drives the gate signal line 17 (by supplying an on or off voltage and on or off current) are formed or arranged.

Figure 4:
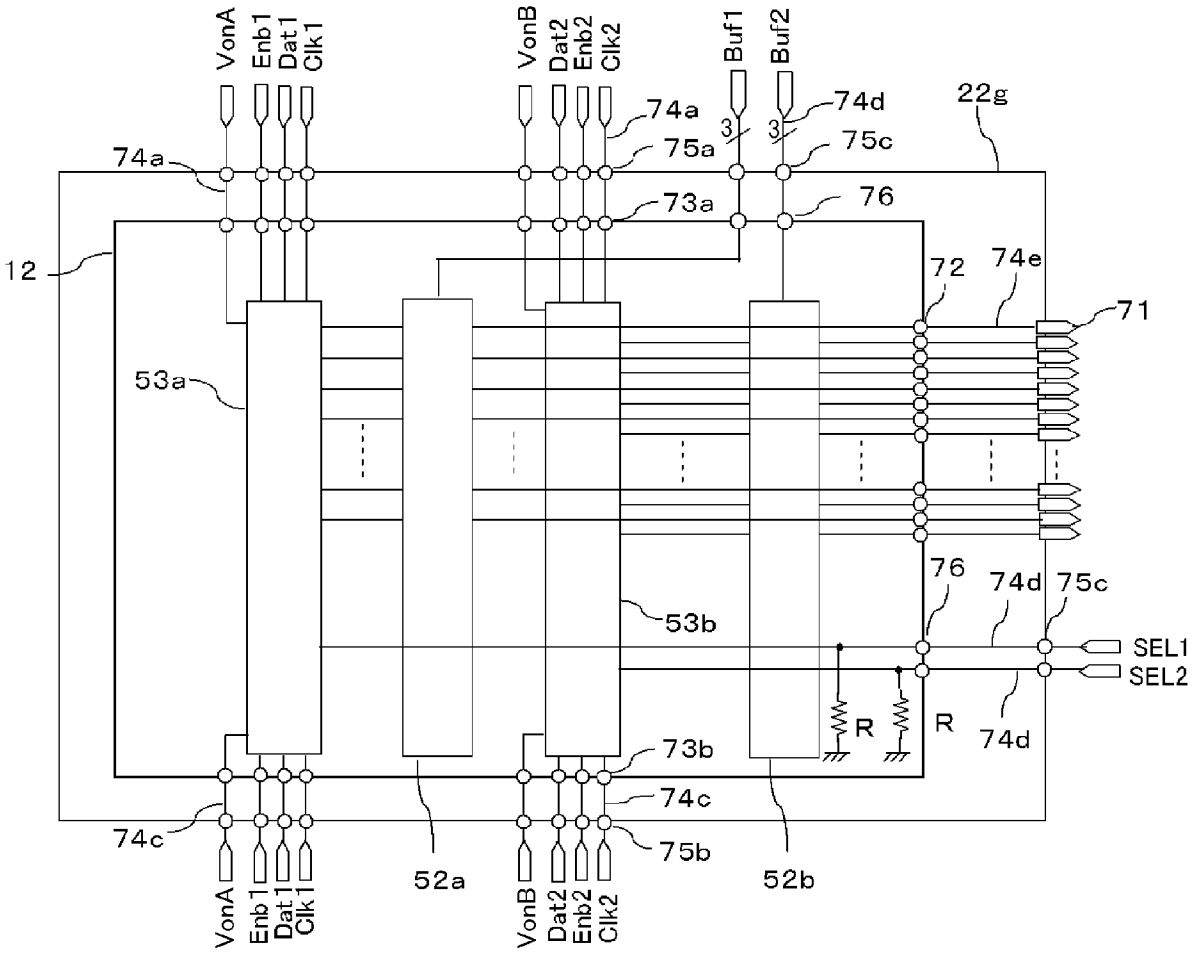
FIG. 4 is a diagram for explaining a gate driver IC of the EL display according to the embodiment.

As illustrated in FIG. 4, output buffers 52 (52*a*, 52*b*) are configured to set or switch to any one of output performances as buffer performances. A switch is made by either of logic pins (Buf1 pin, Buf2 pin) arranged in gate driver ICs 12 (12*a*, 12*b*). For example, when the logic pins comprise three pins, the buffer performances which can be set comprise eight combinations as the cube-of-2 combinations.

Each group of one of shift resisters 51 (51*a*, 51*b*) and the output buffer 52 (52*a*, 52*b*) is referred to as the gate signal output circuit 53 (53*a*, 53*b*).

The reason why two gate driver ICs 12 (12*a*, 12*b*) are arranged for a gate signal line 17*a* is described below.

The gate signal line 17*a* is connected to the switch transistor 11*b*. The switch transistor 11*b* is a transistor for writing a video signal to the pixel 16*a*, and the switch transistor 11*b* needs to perform a fast on and off operation (high slew rate operation). The gate signal line 17*a* performs the high slew rate operation by driving the two gate driver ICs 12 (12*a*, 12*b*).

Although the two gate driver ICs 12 are connected to the gate signal line 17 in the above embodiments, the present disclosure is not limited thereto. As illustrated in FIG. 3, the output buffer 52 is formed or arranged in each of the gate driver ICs (12*a*, 12*b*). Accordingly, this configuration is equivalent to a configuration in which two output buffers are connected to the gate signal line 17*a*. Each group of one of the shift resister 51 (51*a*, 51*b*) and the output buffer 52 is referred to as a gate signal output circuit 53.

The gate signal line 17*a* drives the two gate driver ICs (12*a*, 12*b*), and thereby eliminating a luminance slope at right and left sides and the center of a display screen 25. Even when the load capacity of the gate signal line 17*a* is large, it is possible to turn on or off the switch transistor 11*b* effectively.

The gate driver IC 12*a* is connected to a gate signal line 17*b*. In other words, the gate signal line 17*b* is connected to the output buffer 52.

The gate signal line 17*b* is connected to a switch transistor 11*d*. The switch transistor 11*d* has a function for switching on or off a drive current to be flown from the driver transistor 11*a* to an EL element 15. The on and off operation for causing a current to flow to the EL element 15 can be performed only at a low slew rate.

Accordingly, the gate signal line 17*b* can obtain sufficient performances by driving the gate driver IC 12*a* (the output buffer 52).

Figure 44:
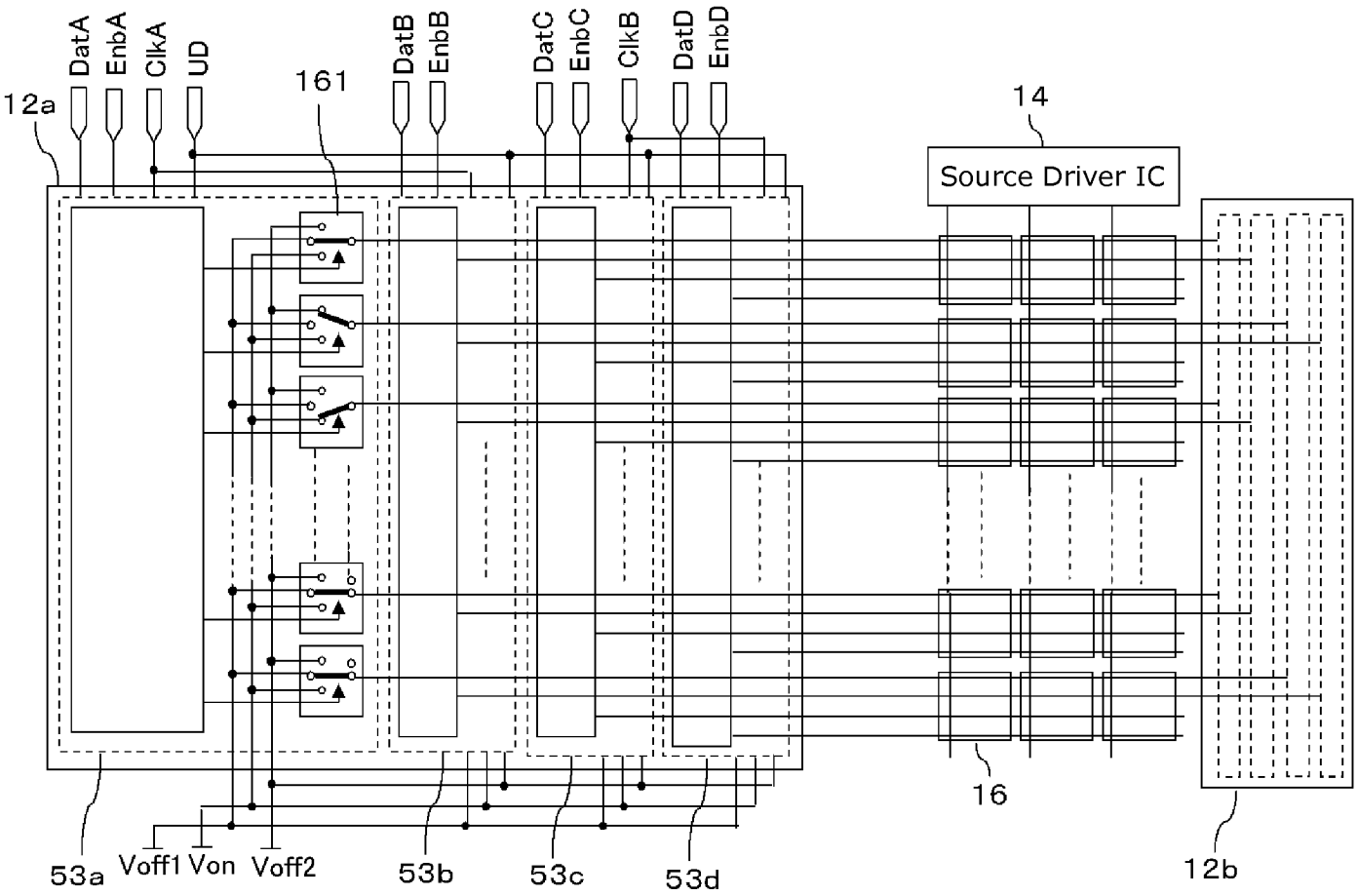
FIG. 44 is a diagram for explaining a method for driving an EL display according to an embodiment.

In FIG. 3, the gate driver IC 12*a* and the gate driver IC 12*b* are of the same kind. In each of the gate driver ICs 12 (12*a*, 12*b*), shift registers 51 (51*a*, 51*b*) each corresponding in number to the gate signal lines 17 (17*a*, 17*b*) connected to the pixels 16 (16*a*, 16*b*) are formed or arranged. For example, in the pixel circuit configuration of the EL display illustrated in FIG. 3, the number of gate signal lines 17 (17*a*, 17*b*) of pixels 16 (16*a*, 16*b*) is two, and the number of shift registers 51 (51*a*, 51*b*) is two. In the pixel circuit configuration of the EL display illustrated in FIG. 44 described later, the number of the gate signal lines is four (gate signal lines 17*a*, 17*b*, 17*c*, and 17*d*), and thus the number of shift registers is four (shift registers 51*a*, 51*b*, 51*c*, and 51*d*).

In the embodiment in FIG. 3, two gate signal lines 17 which are the gate signal line 17*a* and the gate signal line 17*b* are formed in pixels 16 (16*a*, 16*b*). The shift register 51*a* of the gate driver IC 12*a* is arranged for the gate signal line 17*a*, and the shift register 51*b* of the gate driver IC 12*b* is arranged for the gate signal line 17*b*. In other words, the two shift registers 51 (51*a*, 51*b*) are formed in each of the gate driver ICs 12 (12*a*, 12*b*).

In FIG. 3, the both ends of the gate signal line 17*a* are respectively connected to the gate driver ICs 12*a* and 12*b* (both-side drive). An end of the gate signal line 17*b* is connected to the gate driver IC 12*a*. The other end of the gate signal line 17*b* is open (one-side drive). The shift register 51*a* of the gate driver IC 12*a* is electrically connected to the gate signal line 17*a* at an odd pixel row, and the shift register 51*b* of the gate driver IC 12*b* is electrically connected to the gate signal line 17*a* at an even pixel row.

Accordingly, the speed of the shift clock of the gate driver IC 12*b* is the half of the speed of the shift clock of the gate driver IC 12*a*.

FIG. 4 is a diagram illustrating the gate driver IC according to another embodiment of the present disclosure. The Buf terminals (Buf1, Buf2) which are control terminals for setting buffer performances are arranged or formed between driver input terminals 73*a* to which serial connection lines are connected and driver output terminals 72.

SEL terminals which are control terminals for logic setting are arranged or formed between driver input terminals 73*b* which apply a voltage to the control terminals such as CLk to which serial connection lines are connected and the driver output terminals 72.

In this embodiment, each of the control terminals which set logics is arranged or formed between (i) corresponding one of the driver input terminals 73*a* to which the serial connection lines are connected or corresponding one of the driver input terminals 73*b* to which the serial connection lines are connected and (ii) the driver output terminals 72. However, this configuration is a non-limiting example. A COF 22*g* has only a single wiring layer, and thus it is impossible to form intersection parts in COF lines 74 (74*a* to 74*e*). Accordingly, the positions of terminals of the driver ICs can be represented as the connection positions in the COF 22*g*.

For example, in FIG. 4, when represented as the connection terminals of the COF 22*g*, each of Buf (Buf1, Buf2) terminals is connected to one of connection terminals 75*c* of the COF 22*g*, each of control terminals such as Clk2 is connected to one of connection terminals 75*a*, and each of COF lines 74*e* of the gate driver IC 12 is connected to one of the connection terminals 71. In addition, each of SEL (SEL1, SEL2) terminals is connected to one of connection terminals 75*c*, and each of control terminals such as Clk2 is connected to one of connection terminals 75*b*.

Accordingly, in the present disclosure, the connection terminals 75*c* of the COF 22*g* for the Buf (Buf1, Buf2) terminals which are logic setting terminals are arranged between or connected to the connection terminals 75*a* and the connection terminals 71. In addition, in the present disclosure, the SEL (SEL1, SEL2) terminals which are logic setting terminals are arranged between or connected to the connection terminals 75*b* and the connection terminals 71. In addition, the COF line 74*a*, a COF line 74*c*, and the COF line 74*b* (not illustrated) constitute a group of serial connection lines.

Figure 5:
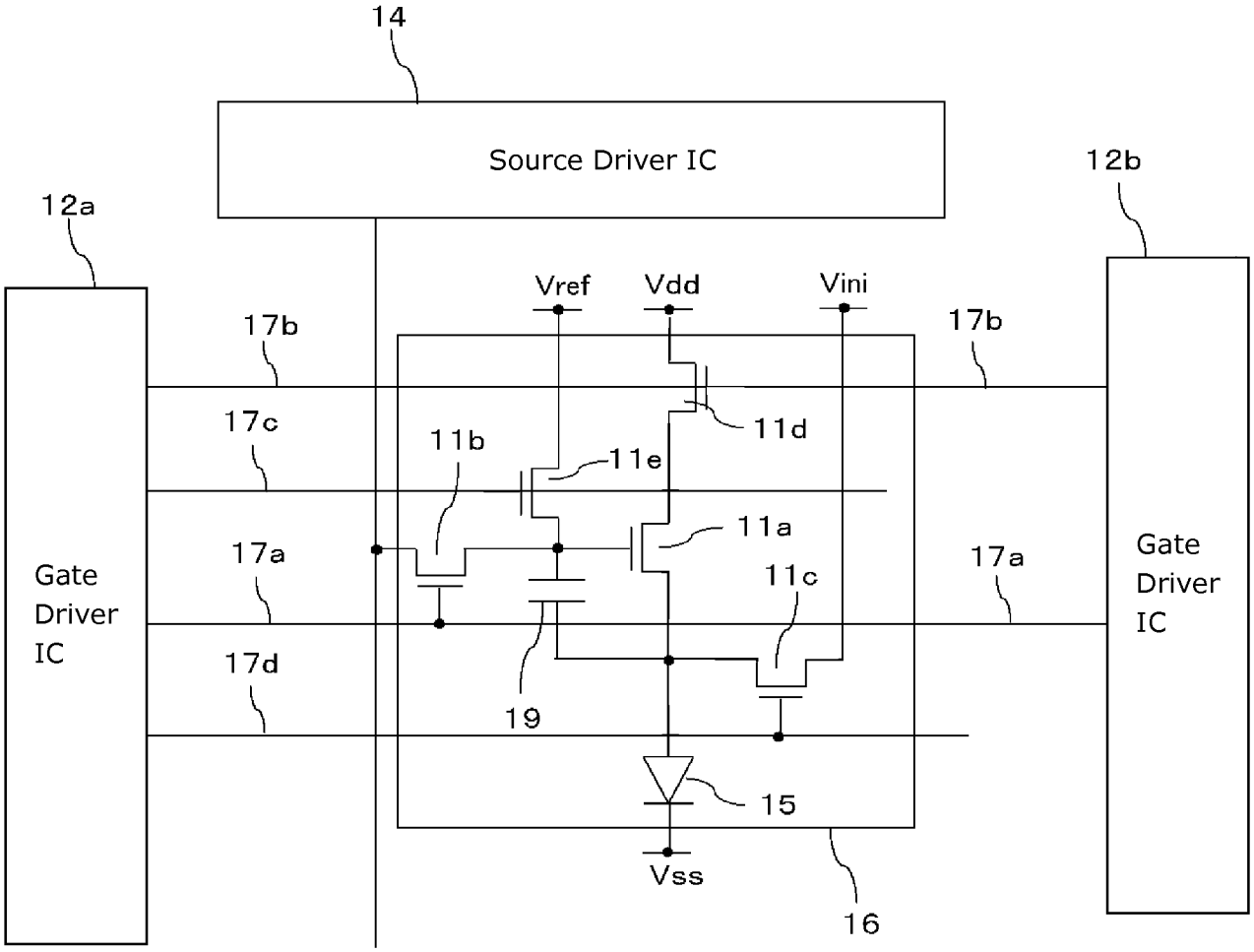
FIG. 5 is a diagram for explaining an EL display according to an embodiment.

FIG. 5 is a diagram for explaining pixels of an EL display (EL display panel) according to another embodiment of the present disclosure.

In the EL display in FIG. 5, a pixel 16 is formed such that four gate signal lines 17 which are a gate signal line 17*a*, a gate signal line 17*b*, a gate signal line 17*c*, and a gate signal line 17*d*. A shift register 51*a* (not illustrated) of a gate driver IC 12*a* is arranged for the gate signal line 17*a*, a shift register 51*b* (not illustrated) of the gate driver IC 12*a* is arranged for the gate signal line 17*b*, a shift register 51*c* (not illustrated) of the gate driver IC 12*a* is arranged for the gate signal line 17*c*, and a shift register 51*d* (not illustrated) of the gate driver IC 12*a* is arranged for the gate signal line 17*d*. In the pixel circuit configuration of the EL display in FIG. 3, the number of gate signal lines for the pixel 16 is two, the number of shift registers is two.

In the pixel 16 in FIG. 5, a first terminal of an N-channel switch transistor 11*d* is connected to either an electrode or a line of an anode voltage Vdd, and a second terminal thereof is connected to a first terminal of a driver transistor 11*a*. The gate terminal of the switch transistor 11*d* is connected to the gate signal line 17*b*.

In FIG. 5, although the transistors are N-channel transistors, this is a non-limiting example, and the transistors may be P-channel transistors. In addition, one or more P-channel transistors and one or more N-channel transistors may coexist.

A first terminal of a switch transistor 11*e* is connected to an electrode or a line to which a reset voltage Vref is applied, and a second terminal of the switch transistor 11*e* is connected to the gate terminal of the driver transistor 11*a*. The gate terminal of the switch transistor 11*e* is connected to the gate signal line 17*c*.

A first terminal of the switch transistor 11*b* which applies the pixel 16 with a video signal is connected to a source line 18, and a second terminal of the switch transistor 11*b* is connected to the gate terminal of the driver transistor 11*a*. The gate terminal of the switch transistor 11*b* is connected to the gate signal line 17*a*.

A first terminal of a switch transistor 11*c* is connected to an electrode or a line to which an initial voltage Vini is applied, and a second terminal of the switch transistor 11*a* is connected to a second terminal of the drive transistor 11*a*. The gate terminal of the switch transistor 11*c* is connected to the gate signal line 17*d*.

A first terminal of an EL element 15 is connected to a second terminal of the driver transistor 11*a*, and a second terminal of the EL element 15 is connected to an electrode or a line to which a cathode voltage Vss is applied.

A first terminal of a capacitor 19 is connected to the gate terminal of the driver transistor 11*a*, and a second terminal of the capacitor 19 is connected to a second terminal of the driver transistor 11*a*.

For at least one of the switch transistors 11*b* or a switch transistor 11*e*, a multi-gate (dual-gate or above) structure is employed, and a lightly doped drain (LDD) configuration is combined. With this configuration, an off-leak is controlled, an excellent contrast can be obtained, and offset cancelling can be performed. In addition, an excellent high luminance display and image display can be realized.

The gate signal line 17*a* and the gate signal line 17*c* are driven at both sides by the gate driver IC 12*a* and the gate driver IC 12*b*. In addition, the gate signal line 17*c* and the gate signal line 17*d* are driven at one side by the gate driver IC 12*a*.

In FIG. 5, a both-side drive is performed on the gate signal line 17*c* connected to the switch transistor 11*b* which applies a video signal to the pixel 16. In addition, a both-side drive is performed on the gate signal line 17*a* connected to the switch transistor 11*d* which performs an operation or control at the time of offset cancelling of the driver transistor 11*a*.

Figure 6:
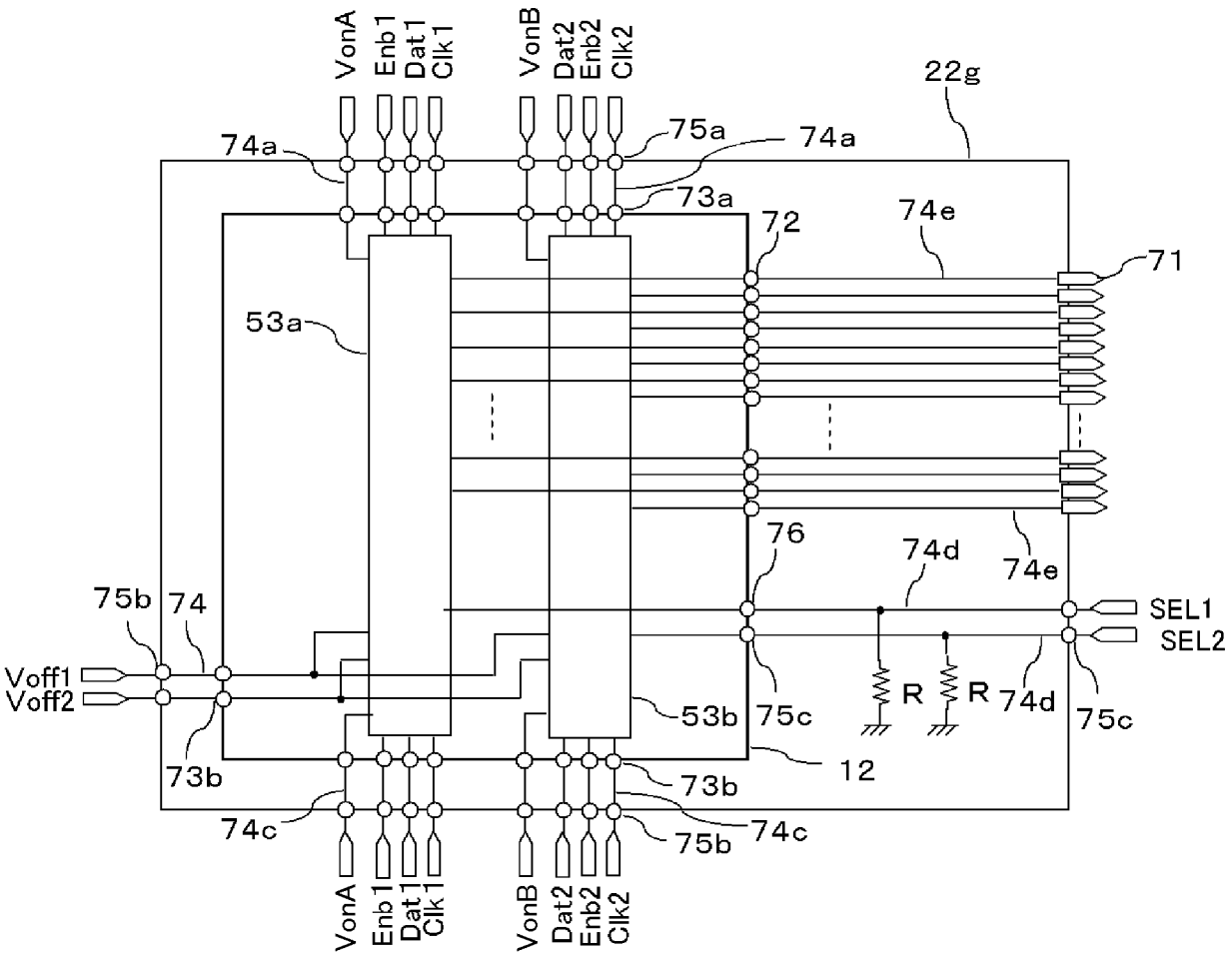
FIG. 6 is a diagram for explaining a COF for use in an EL display according to an embodiment.

FIG. 6 is a schematic diagram for explaining a state in which a gate driver IC 12 is mounted on a flexible board (COF) 22*g*.

The following are connected or arranged to a gate signal output circuit 53*a*: a data input terminal (Dat1) which inputs data to a shift register (not illustrated); an enable input terminal (Enb1) which enables or disables output from the shift register (not illustrated) (an on voltage is output to a gate signal line, and an off voltage is output to the gate signal line); and a clock input terminal (Clk1) which inputs a clock for shifting data in the shift register (not illustrated).

The following are connected or arranged to the gate signal output circuit 53*b*: a data input terminal (Dat2) which inputs data to a shift register (not illustrated); an enable input terminal (Enb2) which enables or disables output from the shift register (not illustrated) (an on voltage is output to a gate signal line when the output is enabled, and an off voltage is output to the gate signal line when the output is disabled); and a clock input terminal (Clk2) which inputs a clock for shifting data in the shift register (not illustrated).

On the flexible board 22*g*, COF lines 74 (74*a*, 74*b*, 74*c*, 74*d*, and 74*e*) are formed. A signal or a voltage is applied to the gate driver IC 12 from the driver input terminals 73 (73*a*, 73B) via the COF lines 74*a*, 74*b*, and 74*c*.

As illustrated in FIG. 6, SEL (SEL1, SEL2) terminals which are control terminals are each connected to a gate driver IC 12 via one of connection terminals 75*c*. Voltage application terminals Voff (Viff1, Voff2) are each connected to a gate driver IC 12 via one of connection terminals 75*b*.

The SEL terminals and the voltage application terminals Voff (Viff1, Voff2) are arranged or formed at an output side of the gate driver IC 12.

The connection terminals 75*c* of logic setting terminals such as SEL (SEL1, SEL 2) terminals are arranged or formed between connection terminals 71 and driver input terminals (73*b*).

The connection terminals 75*c* receive predetermined voltages such as logic voltages from the logic terminals SEL1 and SEL2. One of the logic voltages is applied to an operation terminal 76 of the gate driver IC 12 via a line 74*d* (hereinafter referred to as a "terminal connection line") which connects a point inside the COF 22*g* and a connection terminal 71.

Signal output from the gate driver IC 12 are output from the connection terminals 71 via driver output terminals 72 and COF lines 74*e*. Gate signal lines 17 are connected to the connection terminals 71.

Figure 7:
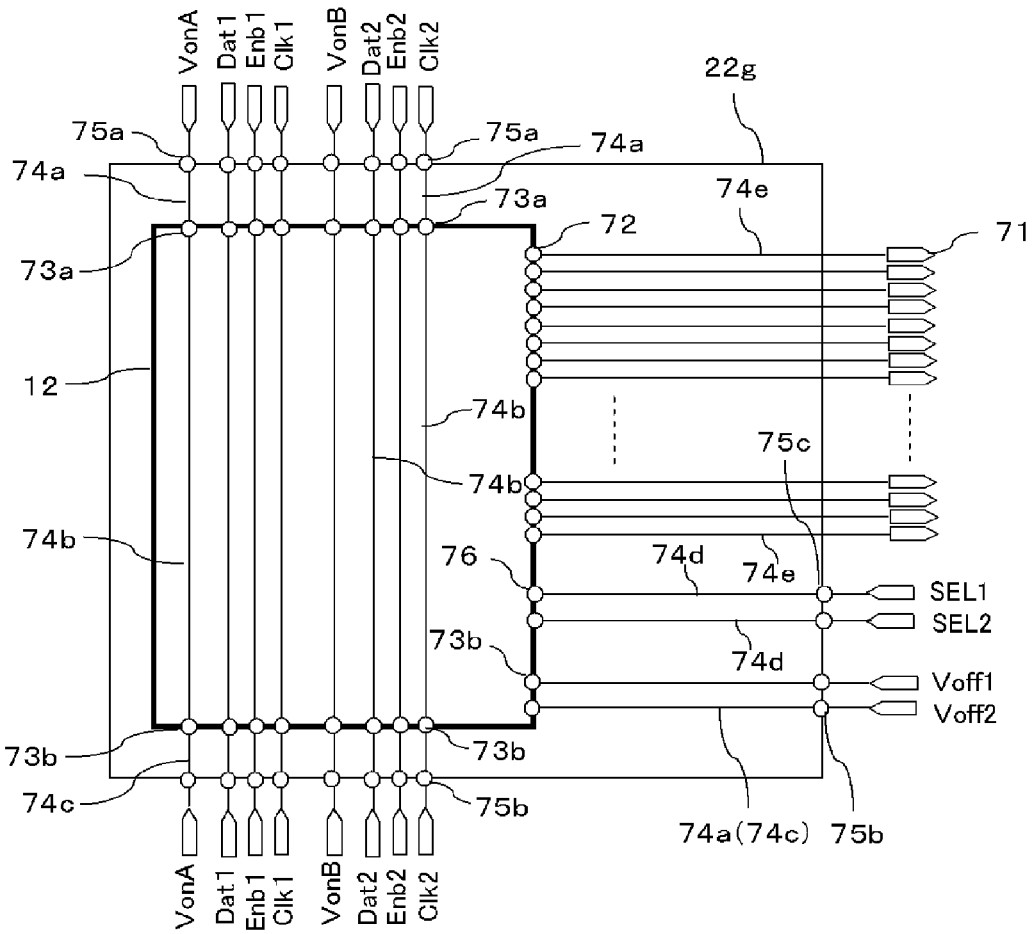
FIG. 7 is a diagram for explaining a COF for use in an EL display according to an embodiment.

As illustrated in FIG. 7, at least one of the driver input terminals (73*a*, 73*b*) is provided at a point right and left of a long side of the chip of the gate driver IC 12. With this configuration, the chip is less affected by a voltage fall. Even when a connection error occurs at one of the driver input terminals 73 (73*a*, 73*b*), the operation by the gate driver IC 12 is not affected.

As illustrated in FIG. 7, the SEL terminals and the Voff terminals are arranged between Von input terminals (VonA, VonB) and the driver output terminals 72. Input stages for the control signals Dat1, Enb1, Clk1, Dat2, Enb2, Clk2 etc. are formed or arranged at two or more points of the gate driver IC 12. Preferably, the two points are arranged at positions which are line symmetrical to each other with respect to the center line of short sides of the gate driver IC 12.

At the input stages for the control signals such as Dat1, Enb1, Clk1, Dat2, Enb2, Clk2, input circuits such as Schmidt circuit and a hysteresis circuit are formed. Each of gate signal output circuits 53 (53*a*, 53*b*) is configured to latch input signals. For example, in the Clk2, a clock input to a connection terminal 75*a* is applied to the driver input terminal 73*a* via a COF line 74*a*. The clock signal applied to the driver input terminal 73*a* is subjected to noise removal at the Schmidt circuit of the gate signal output circuit 53*b*, and latched by a latch circuit (not illustrated). The latched clock data is output to the driver input terminal 73*b* via a line (not illustrated) formed inside the gate signal output circuit 53*a*. The clock data Clk2 output from the driver input terminal 73*b* is output from the connection terminal 75*b* via a COF line 74*c*.

In FIG. 7, a COF line 74*b* is formed between the driver input terminal 73*a* and the driver input terminal 73*b*, this COF line 74*b* is for reinforcing data transmission. Accordingly, although the COF line 74*b* can be omitted, the COF line 74*b* when formed allows a user to stably transmit control data.

When a line connecting the driver input terminal 73*a* and the driver input terminal 73*b* is a power supply line such as a Von voltage line and a Voff voltage line, the COF line 74*b* functions as a bypass line. The COF line 74*b* reduces an impedance of a power supply line, and increases stable supply of power.

Figure 8A:
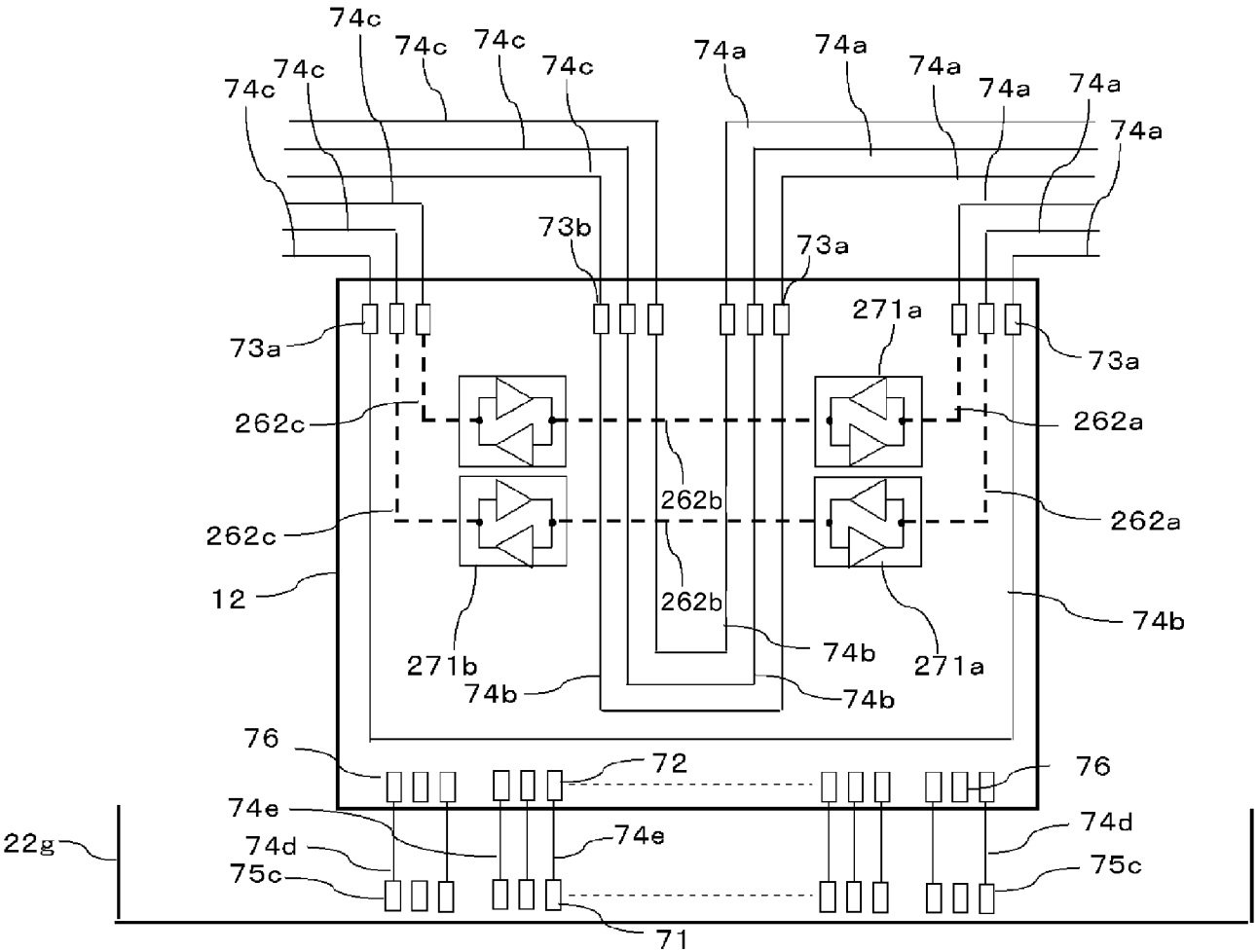
FIG. 8A is a diagram for explaining a gate driver IC of an EL display according to an embodiment.
Figure 8B:
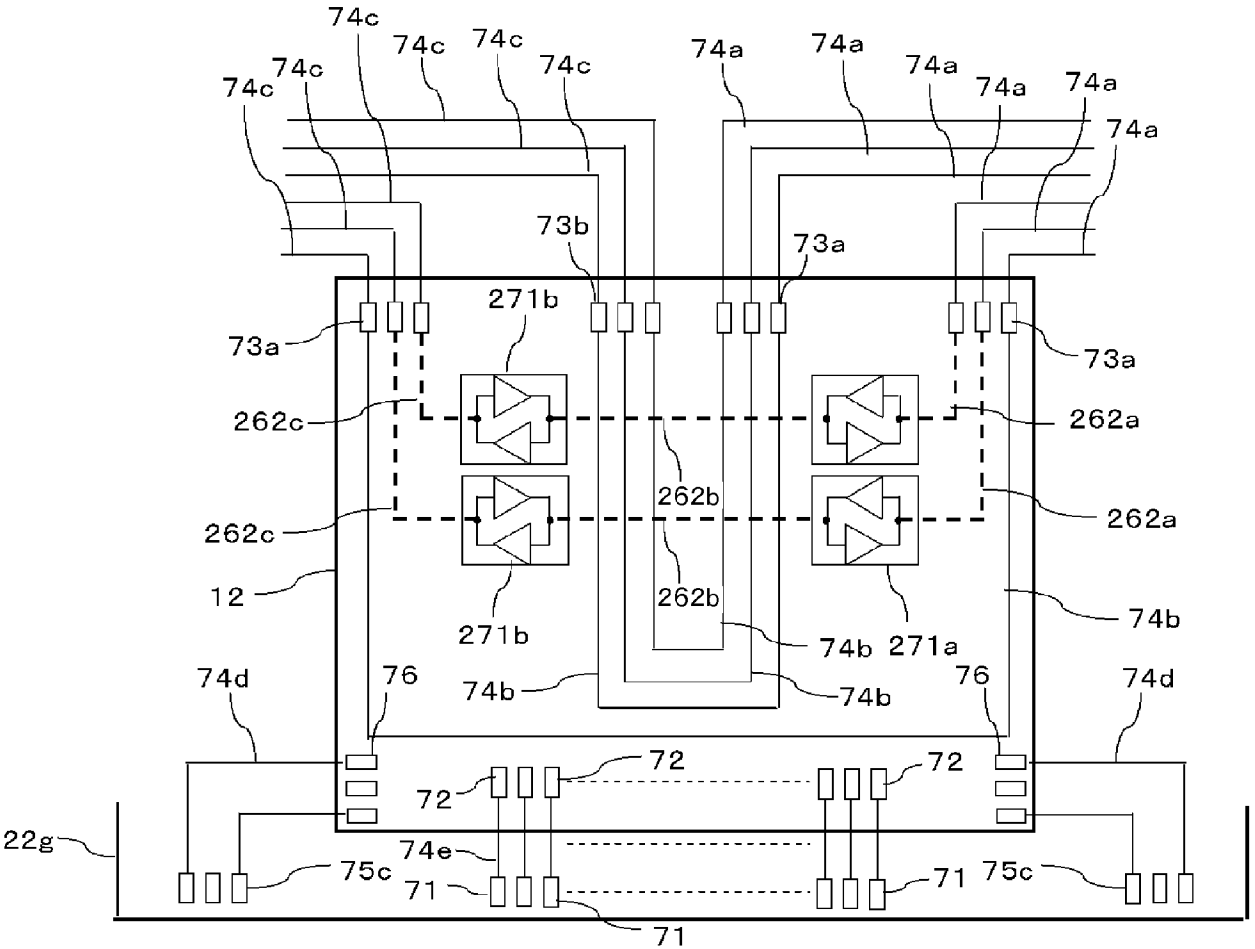
FIG. 8B is a diagram for explaining a gate driver IC of an EL display according to an embodiment.
Figure 9:
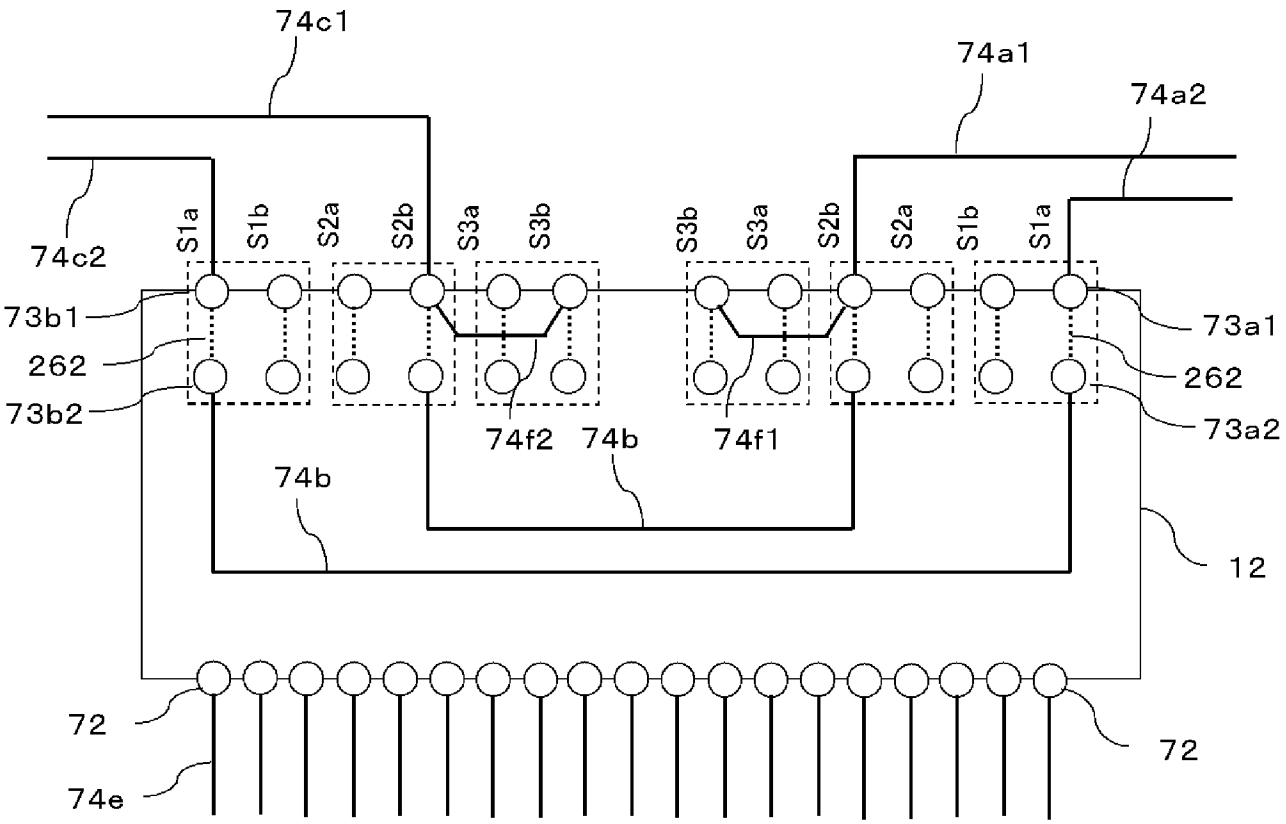
FIG. 9 is a diagram for explaining a gate driver IC of an EL display according to an embodiment.

As illustrated in each of FIGS. 8A, 8B, and 9, even when a line connected to a driver input terminal 73*a* and a driver input terminal 73*b* is a power supply line that is a Von voltage line or a Voff voltage line, internal lines 262 (262*a*, 262*b*, 262*c*) may be added. In other words, a COF line 74*b* and the internal lines 262 (262*a*, 262*b*, 262*c*) may wire-connect the driver input terminal 73*a* and the driver input terminal 73*b*. Furthermore, a plurality of input terminals for on voltages (VonA, VonB) may be arranged or formed.

As illustrated in each of FIGS. 8A and 8B, each of bi-directional buffers 271 (271*a*, 271*b*) is arranged in a point on each of the internal lines 262 (262*a*, 262*c*). The internal line 262*a* is electrically connected to the driver input terminal 73*a* and the bi-directional buffer 271*a*. The internal line 262*b* is electrically connected to the bi-directional buffer 271*a* and the bi-directional buffer 271*b*. The internal line 262*c* is electrically connected to the driver input terminal 73*b* and the bi-directional buffer 271*b*. Each of the driver input terminal 73*a* and the driver input terminal 73*b* may be connected to any one of a terminal for data Dat, a terminal for a clock Clk, a terminal for an enable signal Enb. In any of the connections, the driver input terminal 73*a* and the driver input terminal 73*b* may be an input terminal or an output terminal, or the driver input terminal 73*b* and the driver input terminal 73*a* may be an input terminal and an output terminal.

Control signals such as the clock Clk, data Dat, enable Enb are transmitted via the internal line 262 (262*a* to 262*c*). COF lines 74*c* transmit an on voltage Von, an off voltage Voff, a logic voltage Vcc, and a ground voltage Vgg.

Since the internal lines 262 (262*a* to 262*c*) transmit the control signals such as the clock Clk, data Dat, enable Enb, the COF 22*g* does not require formation or arrangement of the COF lines 74*c* for control signal lines. For this reason, Distance A and Distance B in FIG. 50 can be shortened. As a result, the size of the COF 22*g* can be reduced, which achieves cost reduction.

Figure 13:
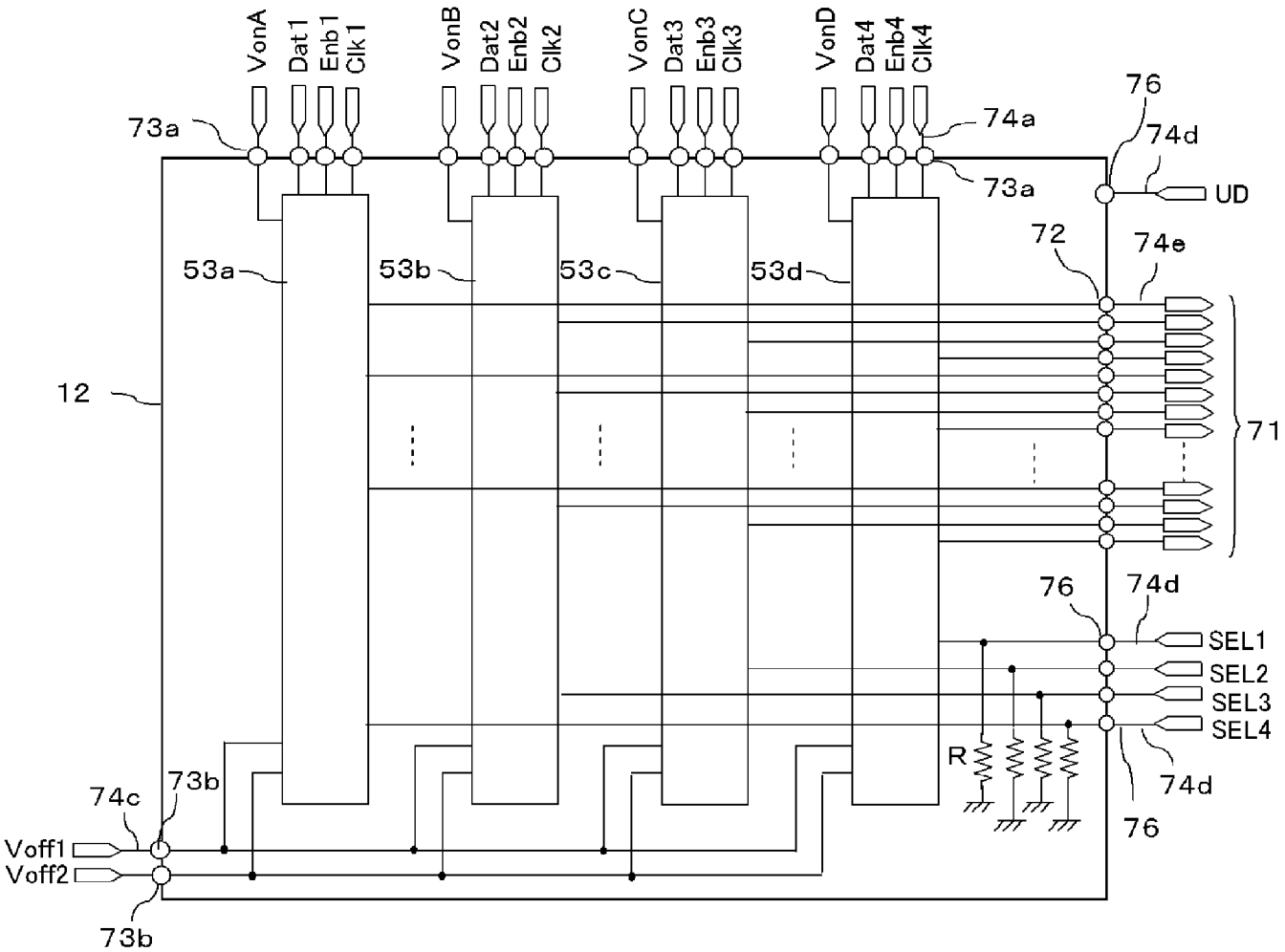
FIG. 13 is a diagram for explaining a gate driver IC for use in an EL display according to an embodiment.

The lines for transmitting the control signals such as the clock Clk, data Dat, enable Enb are configured to arrange the bi-directional buffer 271 (271*a*, 271*b*) in the internal lines 262 (262*a* to 262*c*), and the bi-directional buffer 271 supports hysteresis input. Accordingly, a waveform is adjusted to adjust a delay time. For this reason, synchronous control of gate signal lines 17 on a display screen is easy to realize. Since synchronization with a delay circuit 485 in FIG. 13 is easy to realize, the image quality can be enhanced.

FIG. 9 illustrates a configuration in which a plurality of driver input terminals 73 (73*a*2, 73*b*2) are arranged for each of driver input terminals 73 (73*a*1, 73*b*1), and these driver input terminals are wire-connected through internal lines 262. For example, two driver input terminals S1*a* (73*b*1, 73*b*2) are formed, and the driver input terminal S1*a* (73*b*1) and the driver terminal S1*a* (73*b*2) are electrically connected through a corresponding one of the internal lines 262. Similarly, for example, two driver input terminals S1*a* (73*a*1, 73*a*2) are formed, and the driver input terminal S1*a* (73*a*1) and the driver terminal S1*a* (73*a*2) are electrically connected through a corresponding one of the internal lines 262.

In addition, driver input terminals S3*b* and S2*b* are electrically connected through a COF line 74*f*1. The driver input terminals S2*b* and S3*b* are electrically connected through a COF line 74*f*2.

With the configuration, a control signal can be supplied to the plurality of driver input terminals S2*b* and S3*b* by a COF line 74*a*1 which supplies a control signal to a gate driver IC 12. In addition, a voltage can be supplied to the driver input terminals S2*b* and S3*b* by a COF line 74*c*1 which supplies a control signal to a gate driver IC 12.

In an EL display illustrated in FIG. 9, a gate signal output circuit 53*a* and a gate signal output circuit 53*b* are formed or arranged in the gate driver IC 12. The following are connected to each of the gate signal output circuits 53 (53*a*, 53*b*): control terminals (SEL1, SEL2); and two off voltage input terminals (Voff1, Voff2); and a single on voltage input terminal (VonA for the gate signal output circuit 53*a*, and VonB for the gate signal output circuit 53*b*). The SEL terminals (SEL1, SEL2) are pulled down. The SEL terminals are logic terminals for switching between a three-value drive of gate voltages and a two-value drive of gate voltages. The three-value drive of gate voltages and the two-value drive of gate voltages are described later with reference to FIGS. 21, 22A, 22B, 20A, 20B, 28, 29, etc.

An on voltage and an off voltage to be applied to gate signal lines 17 are output from driver output terminals 72 of the gate driver IC 12. The driver output terminals 72 and connection terminals 71 are electrically connected through COF lines 74*e* formed in a COF 22*g*.

Lines which connect between two or more connection terminals 75 (75*a*, 75*b*) such as a clock CLK terminal, a data Dat terminal, on a Von voltage terminal are connected to a driver input terminal 73*b* and a driver input terminal 73*a* (the lines are hereinafter referred to as "serial connection lines", and are for example, in FIG. 50 later referred to, a line from a COF line 74*a* via a COF line 74*b* to a COF line 74*c*, or a line from a panel line 91*a* via a COF line 74*a* via a COF line 74*b* via a COF line 74*c* to a panel line 91*b*).

The driver input terminal 73*a* and the connection terminal 75*a* are electrically connected through the COF line 74*a* formed in the COF 22*g*. In addition, the driver input terminal 73*b* and a connection terminal 75*b* are electrically connected through the COF line 74*c* formed in a COF 22*g*.

As illustrated in each of FIG. 7 and FIG. 50, the driver input terminals 73*a* and the driver input terminals 73*b* are electrically connected through the COF line 74*b* (in FIG. 7) or 74*c* (in FIG. 50) formed in the COF 22*g*.

Operation terminals 76 of a gate driver IC 12 are arranged or formed between (i) driver output terminals 72 and driver input terminals 73*a*, or (ii) the driver output terminals 72 and driver input terminals 73*b*. Alternatively, operation terminals 76 are arranged or formed between the both, that is, between (i) driver output terminals 72 and driver input terminals 73*a*, or (ii) the driver output terminals 72 and driver input terminals 73*b*.

The following are formed in the COF 22*g*: COF connection lines (74*a*, 74*b*, 74*c*) to be serial connection lines are formed; and a COF connection line 74*e* for transmitting an on voltage (Von) and off voltages (Voff1, Voff2) from the gate driver IC 12 to the gate signal line 17.

A COF connection line 74*d* is arranged or formed either between a COF connection line 74*e* and a COF connection line 74*c*, or between a COF connection line 74*a* and the COF connection line 74*e*. Thus, the COF connection line 74*d* does not have any intersection parts with the COF connection line 74*e*, the COF connection line 74*a*, the COF connection line 74*b*, and the COF connection line 74*c*. Accordingly, even when the COF 22*g* is wired at one side, the COF connection line 74*d* can be easily formed.

Furthermore, it is easy to layout a pattern on the COF connection line 74*d* from the panel side (on which the panel lines 91 (91*a*, 91*b*) are formed) so that a voltage can be applied to the COF lines 74*d*.

As described above, the terminals (such as the SEL terminals) connected to the COF connection line 74*d* do not need to be connected in serial connection. For this reason, it is possible to reduce the number of COF lines 74*a*, 74*b*, and 74*c* to be the serial connection lines.

With the configuration disclosed above, it is possible to shorten or reduce Distance B, Distance A, Distance C, and Distance D explained with reference to FIG. 50. Accordingly, it is possible to reduce the size of the COF 22*g* and also reduce the size of the gate driver IC 12, and to thereby reduce the cost of the EL display.

In FIG. 13, R denotes a resistor. The logic of SELs is a pull-down state. Needless to say, the resistor R may be formed inside the gate driver IC 12.

Figure 10:
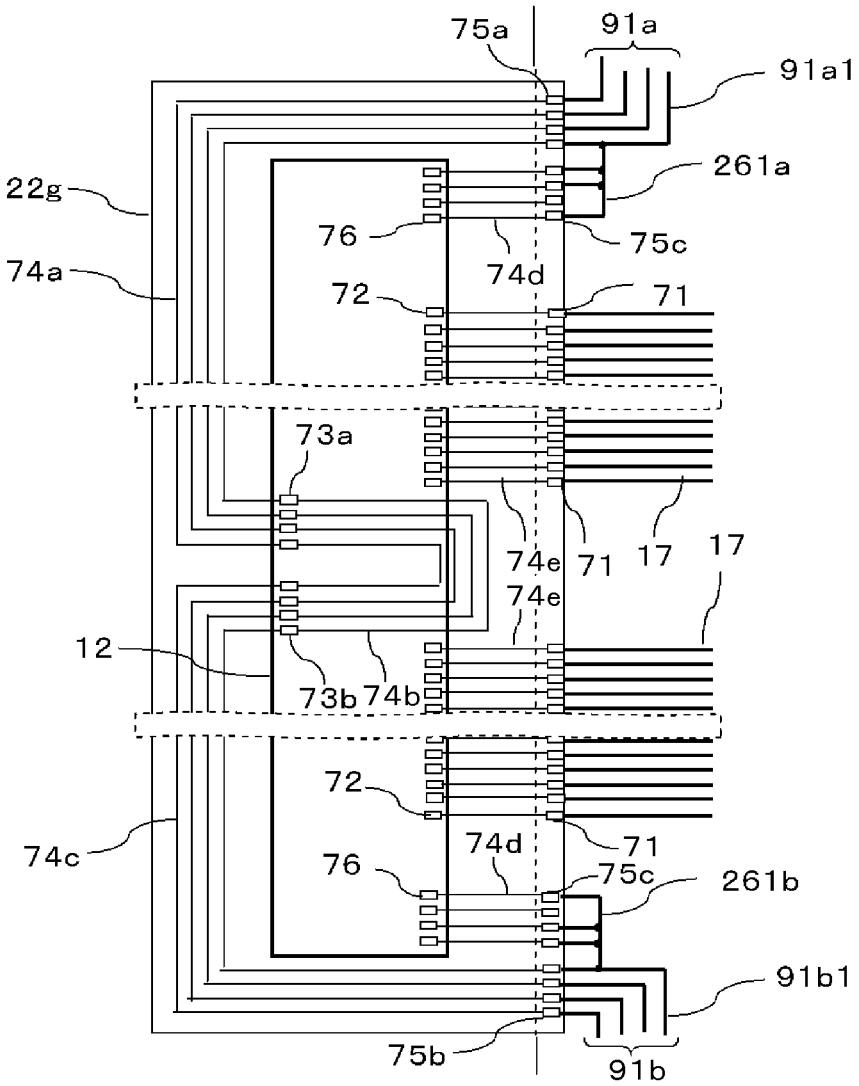
FIG. 10 is a diagram for explaining a gate driver IC for use in an EL display according to an embodiment.

As illustrated in FIG. 10, control signal lines for input to a gate driver IC 12 and COF lines 74 (74*a* to 74*e*) as voltage lines are pattern-formed in serial connection. In other words, they are formed to be serial connection lines.

On a panel board 31, panel lines 91 (91*a* (91*a*1), 91*b* (91*b*1)) are formed or patterned. The panel lines 91 are power supply lines such as an on voltage Von, off voltages Voff, an anode voltage Vdd, and a cathode voltage Vss, and control lines such as Clk, Enb, etc.

The Von denotes an on voltage to be applied to the gate signal line 17, Voff denotes an off voltage to be applied to the gate signal line 17, Vcc is a ground voltage Vgg of the power supply of a logic circuit to be used in the gate driver IC 12, and Vgg is a ground voltage of the logic terminal.

The panel line 91*a*1 located innermost of the panel line 91*a* and the panel line 91*b*1 located innermost of the panel line 91*b* are lines to which a voltage Vcc or a voltage Vgg is applied. The voltage Vcc or the voltage Vgg means a setting voltage of the logic terminal in a broad sense.

However, a voltage to be applied to the panel lines 91*a*1 and 91*a*2 may be a voltage Von or a voltage Voff. In other words, the voltage to be applied may be a constant voltage fixed in a certain period. The voltage Von or the voltage Voff is subject to a level shift process or a level down process at a level transform circuit in the driver IC 12, and the resulting voltage can be used as a voltage level signal for logic setting of the gate driver IC 12.

An input control line 261*a* branches from the panel line 91*a*1. The input control line 261*a* is connected to a connection terminal 75*c* of a COF 22*g*. The connection terminal 75*c* is a terminal to which a control voltage at a logic level is to be applied. The control voltage at the logic level is a signal voltage for logic setting. For example, a voltage at or above a first predetermined voltage is assumed to be Level H of the logic, and a voltage below the first predetermined voltage is assumed to be Level L. An operation terminal 76 and the connection terminal 75*c* of the gate driver IC 12 are electrically connected to the COF connection line 74*d*.

An input control line 261*b* branches from the panel line 91*b*1. The input control line 261*b* is connected to the connection terminal 75*c* of the COF 22*g*. The operation terminal 76 and the connection terminal 75*c* of the gate driver IC 12 are electrically connected to the COF connection line 74*d*. The operation terminal 76 is arranged between the connection terminal 71 of the gate signal line 17 and a driver input terminal 73*a* of the gate driver IC 12.

The panel line 91*a* is connected to the COF line 74*a* of the COF 22*g* through a connection terminal 75*a* at the upper part of the drawing sheet. The COF line 74*a* is connected to the driver input terminal 73*a*. The driver input terminal 73*a* and a driver input terminal 73*b* are electrically connected through the COF line 74*b*.

As described above, on the gate driver IC 12, a plurality of driver input terminals 73 (73*a*, 73*b*) are arranged or formed for a voltage of one kind and a control signal of one kind.

The driver input terminal 73*b* and the connection terminal 75*b* are electrically connected through the COF line 74*c*. The connection terminal 75*b* is connected to the panel line 91*b*.

As described above, they are formed or arranged in serial connection to the panel line 91*a*, the connection terminal 75*a*, the COF line 74*a*, the driver input terminal 73*a*, the COF line 74*b*, the driver input terminal 73*b*, the COF line 74*c*, the connection terminal 75*b*, and the panel line 91*b*. In other words, they are connected by the serial connection lines.

Figure 11:
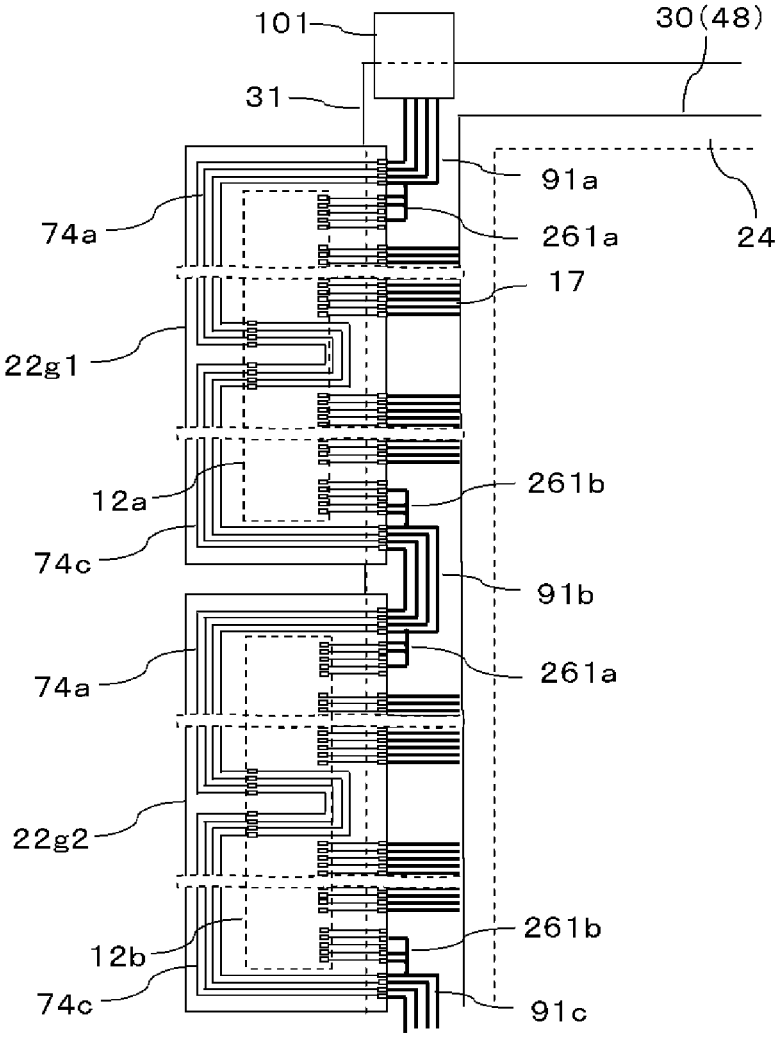
FIG. 11 is a diagram for explaining an EL display according to an embodiment.

FIG. 11 is a diagram illustrating a state in which a plurality of flexible boards 22*g* (22*g*1, 22*g*2) are mounted on a panel board 31. The flexible board 22*g*1 and the flexible board 22*g*2 are electrically connected through a panel line 91*b*. The panel line 91*b* is formed at the same time when gate signal lines 17 and source lines 18 are formed. In addition, they are made of a material identical or similar to the materials of the gate signal lines 17 and the source signal lines 18.

A voltage and a control signal from a driver circuit (not illustrated) are applied from a voltage and signal input unit 101 to a panel substrate 31, and are then applied to the flexible board 22*g*1 through a panel line 91*a*, and are then applied to a driver input terminal 73*a* of a gate driver IC 12*a*. The voltage and signal input unit 101 is connected to a source print board 23. The voltage and the signal are supplied from the source print board 23 to the COF 22*g* through the voltage and signal input unit 101.

The voltage and the control signal from the flexible board 22*g*1 are applied to the flexible board (COF) 22*g*2 through the panel line 91*b*, and are then applied to a gate driver IC 12*b*. The voltage and the control signal from the flexible board (COF) 22*g*2 are applied to a next flexible board (COF) 22*g*3 (not illustrated) through a panel line 91*c*. As described above, the voltage and the control signal are connected in serial connection to a plurality of flexible boards (COF) 22*g* through the panel line 91*b*.

Figure 12:
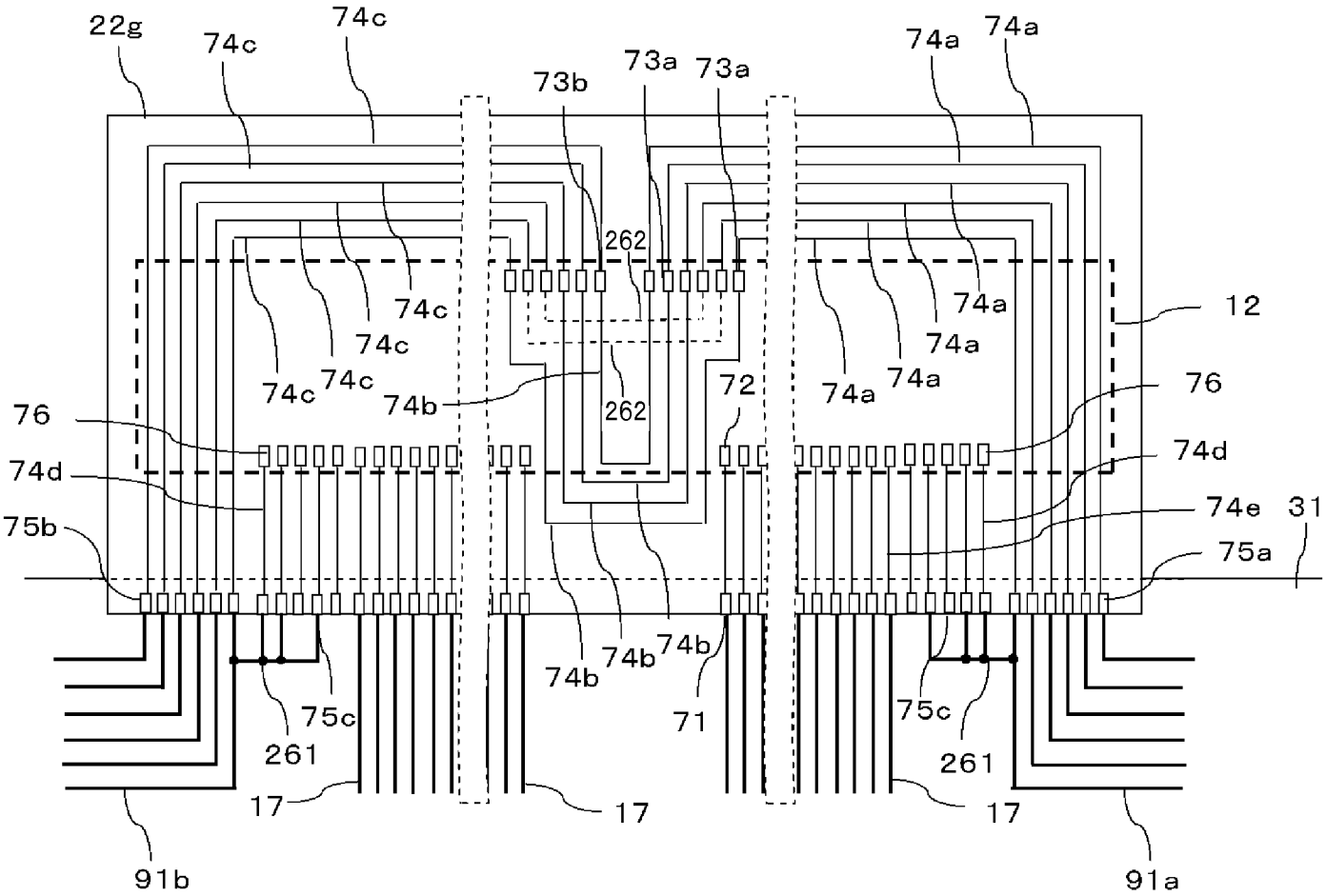
FIG. 12 is a diagram for explaining a COF part of an EL display according to an embodiment.

FIG. 12 is a diagram illustrating a COF 22*g*1 on which a gate driver C12 disclosed here is mounted. A panel line 91*a* is connected to a COF line 74*a* through a connection terminal 75*a*. The COF line 74*a* is connected to a driver input terminal 73*b*, and a driver input terminal 73*a* and the driver input terminal 73*b* are electrically connected through a COF line 74*c*. The driver input terminal 73*b* and a connection terminal 75*b* are electrically connected through a COF line 74*b*. A panel line 91*b* is connected to the connection terminal 75*b*, and the panel line 91*b* is electrically connected to a connection terminal 75*c* of a COF 22*g*2 located next.

A voltage Vcc (a logic voltage of a driver IC) is applied to input control lines 261. In other words, a logic voltage (normally, a voltage Vcc or Vgg) to be applied to the connection terminal 75*c* is applied to the panel line 91*a*. The connection terminal 75*c* and an operation terminal 76 are electrically connected through a connection line 74*d*. A logic voltage is applied to lines (91*a*1, 91*b*1) located innermost of the panel line 91. The logic voltage is applied to an operation terminal 76 connected to the COF connection line 74*d*.

As illustrated in FIG. 12, SEL terminals (SEL1, SEL2, SEL3, SEL4) are connected to the COF line 74. The SEL terminals are terminals for setting a selection between a two-value drive of gate voltages and a three-value drive of gate voltages of the gate driver IC 12. The SEL terminals are pulled down to Vgg by a resistor R formed in the gate driver IC 12.

In a state where one or more of the SEL terminals is open (no voltage is applied thereto), the logic is L. In the case of L, a two-value drive of gate voltages (FIG. 20A) is set. The logic is H in a state where a voltage Vcc is applied to one or more of the SEL terminals. In the case of H, a three-value drive of gate voltages (FIG. 20B) is set.

More specifically, an array pattern is laid out so that a voltage is applied to operation terminals 76 through the input control lines 261, or a pattern (not wire-connected) is laid out so that the operation terminals 76 is open without applying a voltage to the operation terminals 76. With this configuration, it is possible to determine logic levels of the SEL terminals (SEL1 to SEL4). Based on these logic levels, it is possible to set or determine which one of a two-value drive of gate voltages or a three-value drive of gate voltages is performed by each of gate signal output circuits 53 (53*a*, 53*b*, 53*c*, 53*d*).

As illustrated in each of FIGS. 8A, 8B, and 12, inbetween the driver input terminal 73*a* and the driver input terminal 73*b*, the following exist: parts connected through the COF line 74*c* formed on the COF 22*g*; and parts connected through the internal lines 262 of the driver IC 12.

The internal lines 262 constitute an internal line pattern of the gate driver IC 12. It electrically connects the driver input terminal 73*a* and the driver input terminal 73*b*.

FIG. 13 is a diagram illustrating a gate driver IC 12 in an EL display (EL display panel) according to the present disclosure. Four gate signal output circuits 53 (53*a*, 53*b*, 53*c*, 53*d*) are formed or arranged in the gate driver IC 12.

In each of the gate signal output circuits 53 (53*a*, 53*b*, 53*c*, 53*d*), the following are arranged or formed: an input (application) terminal of an on voltage (Von); a data input (Dat) terminal; an enable (Enb) terminal; and a clock (Clk) terminal. A terminal (UD terminal) which inverses a vertical scanning direction is shared by these four gate signal output circuits 53.

These SEL terminals are arranged corresponding to the respective gate signal output circuits 53 (53*a*, 53*b*, 53*c*, 53*d*). Each of the SEL terminals is a terminal for setting or operating a two-value drive of gate voltages and a three-value drive of gate voltages. In a broad sense, the SEL terminals are terminals for switching or controlling drive modes of the gate signal output circuits 53 (53*a*, 53*b*, 53*c*, 53*d*). Accordingly, the drive methods are not limited to the two-value drive of gate voltages and the three-value drive of gate voltages. For example, each of the SEL terminals may be a terminal for setting a selection of one of the four value voltages which are a voltage Von1, a voltage Von2, a voltage Voff1, and a voltage Voff2.

The gate signal output circuit 53*a* is set to the three-value drive of gate voltages by setting the SEL1 terminal to Logic "H", and the gate signal output circuit 53*b* is set to the three-value drive of gate voltages by setting the SEL2 terminal to Logic "H". The gate signal output circuit 53*c* is set to the three-value drive of gate voltages by setting a SEL3 terminal to Logic "H", and the gate signal output circuit 53*d* is set to the three-value drive of gate voltages by setting a SEL4 terminal to Logic "H". It is to be noted that the settings of Logic "H" and "L" may be inversed.

FIG. 13 illustrates an alternative configuration in which two SEL terminals are arranged instead, logic signals applied to the two SEL terminals are decoded, and one of the four gate signal output circuits 53 (53*a*, 53*b*, 53*c*, 53*d*) is selected. For example, assuming that these two SEL terminals are a SEL0 terminal and a SEL1 terminal, in the case of (SEL0, SEL1)=(L, L), the gate signal output circuit 53*a* is set to the three-value drive of gate voltages, and the gate signal output circuits 53*b*, 53*c*, and 53*d* are set to the two-value drive of gate voltages. Alternatively, assuming that these two SEL terminals are a SEL0 terminal and a SEL1 terminal, in the case of (SEL0, SEL1)=(L, H), the gate signal output circuit 53*b* is set to the three-value drive of gate voltages, and the gate signal output circuits 53*a*, 53*c*, and 53*d* are set to the two-value drive of gate voltages. Alternatively, assuming that these two SEL terminals are a SEL0 terminal and a SEL1 terminal, in the case of (SEL0, SEL1)=(H, L), the gate signal output circuit 53*c* is set to the three-value drive of gate voltages, and the gate signal output circuits 53*a*, 53*b*, and 53*d* are set to the two-value drive of gate voltages. Alternatively, assuming that these two SEL terminals are a SEL0 terminal and a SEL1 terminal, in the case of (SEL0, SEL1)=(H, H), the gate signal output circuit 53*d* is set to the three-value drive of gate voltages, and the gate signal output circuits 53*a*, 53*b*, and 53*c* are set to the two-value drive of gate voltages. With this configuration, it is possible to reduce the number of SEL terminals.

The one for which the three-value drive of gate voltages is performed is 17*a* gate signal line a connected to a transistor for writing a video signal to a pixel 16. Even when a plurality of gate signal lines are formed or arranged in the pixel 16, the gate signal line connected to the transistor for applying the video signal is identified solely as a gate signal line 17*a*. In other words, even when a plurality of gate signal driver circuits are formed in the gate driver IC 12, one of them can be set to be subject to the three-value drive of gate voltages, and the other gate signal driver circuit may be subject to the the two-value drive of gate voltages.

For example, when eight gate signal driver circuits are arranged or formed on the gate driver IC 12, the number of SEL terminals may be three, and a decoder (3-8 decoder) for selecting one of eight 3-bit gate signal line driver circuits may be configured.

As described above, in the present disclosure, the SEL terminals make it possible to switch between the two-value drive of gate voltages and the three-value drive of gate voltages independently or indivisualy for the gate signal output circuits 53 (53*a*, 53*b*, 53*c*, 53*d*) corresponding respectively to the gate signal lines.

In the present disclosure, the gate signal line 17 connected to the transistor for writing a video signal is driven by a both-side drive (performed by two gate driver ICs 12 arranged right and left of a display screen 25). The other gate signal lines for which fast slew rate is not required is driven by a one-side drive (performed by one of the gate driver ICs 12 arranged right and left of the display screen 25).

In each of the EL display illustrated in FIGS. 8A, 8B, and 12, the operation terminals 76 are arranged or formed on or near a side (a long side of the driver IC) on which driver output terminals 72 are formed. However, the present disclosure is not limited thereto. For example, as illustrated in FIGS. 8A and 8*b*, the operation terminals 76 may be formed on or near a short side of the gate driver IC 12. Alternatively, the operation terminals 76 may be formed on a side (a long side of the driver IC) on which the driver input terminals 73*a* and 73*b* are formed. The operation terminals 76 may be arranged between the driver output terminals 72 and the driver input terminals 73 (73*a*, 73*b*). By arranging the operation terminals 76 between the driver output terminals 72 and the driver input terminals 73 (73*a*, 73*b*), logic setting can be performed easily through the panel lines 91*a*1 and 91*b*1 or the input control lines 261 branching from the panel lines 91*a*1 and 91*b*1.

The EL display according to this embodiment connects control signal lines for logic control, etc. from the panel side (on which the panel line 91 is formed) to the operation terminals 76. With this configuration, the number of COF lines 74 (74*a*, 74*b*, 74*c*) is reduced. In a conventional EL display, all of control signal lines and power supply lines need to be formed in serial connection. Thus, as illustrated in FIG. 50, there is a problem that Distance A, Distance B, and Distance D are long. On the other hand, in the EL display according to this embodiment, the control signal lines connected to the operation terminals 76 do not form COF lines 74 (74*a*, 74*b*, 74*c*). For this reason, the number of COF lines 74 can be reduced, Distance A, Distance B, and Distance D are shortened, and the size of the COF and the size of the driver IC can be reduced.

In addition, input control lines 261 are formed to branch from lines to which predetermined voltages (e.g. a logic voltage Vcc, a ground voltage Vgg) are applied from the panel lines 91 (91*a*, 91*b*). In a configuration according to a wiring layout design for forming an array pattern, voltages corresponding to logics to be set are applied to the operation terminals 76. With this configuration, Distance C for forming the panel lines 91 (91*a*, 91*b*) in FIG. 50 is shortened. For this reason, the frame of the panel can be made smaller.

Although the above descriptions have been given of the gate driver IC 12 and the COF 22*g*, needless to say, the same descriptions can also apply to the source driver IC 14 and the COF 22*s*.

Of course, the above embodiments are also applicable to other embodiments in the present disclosure. In addition, the above embodiments can, not to mention, be combined with other embodiments.

FIG. 13 is a diagram illustrating a gate driver IC according to another embodiment of the present disclosure. A UD terminal (for setting a scanning direction of a shift register 51) that is a control terminal for logic setting is arranged or formed between driver input terminals 73*a* and driver output terminals 72, to which serial connection lines are connected.

SEL terminals (for setting a two-value drive of gate voltages and a three-value drive of gate voltages of a gate signal output circuit 53) that are control terminals for logic setting are arranged or formed between driver input terminals 73*b* and the driver output terminals 72, to which serial connection lines are connected.

Figure 15:
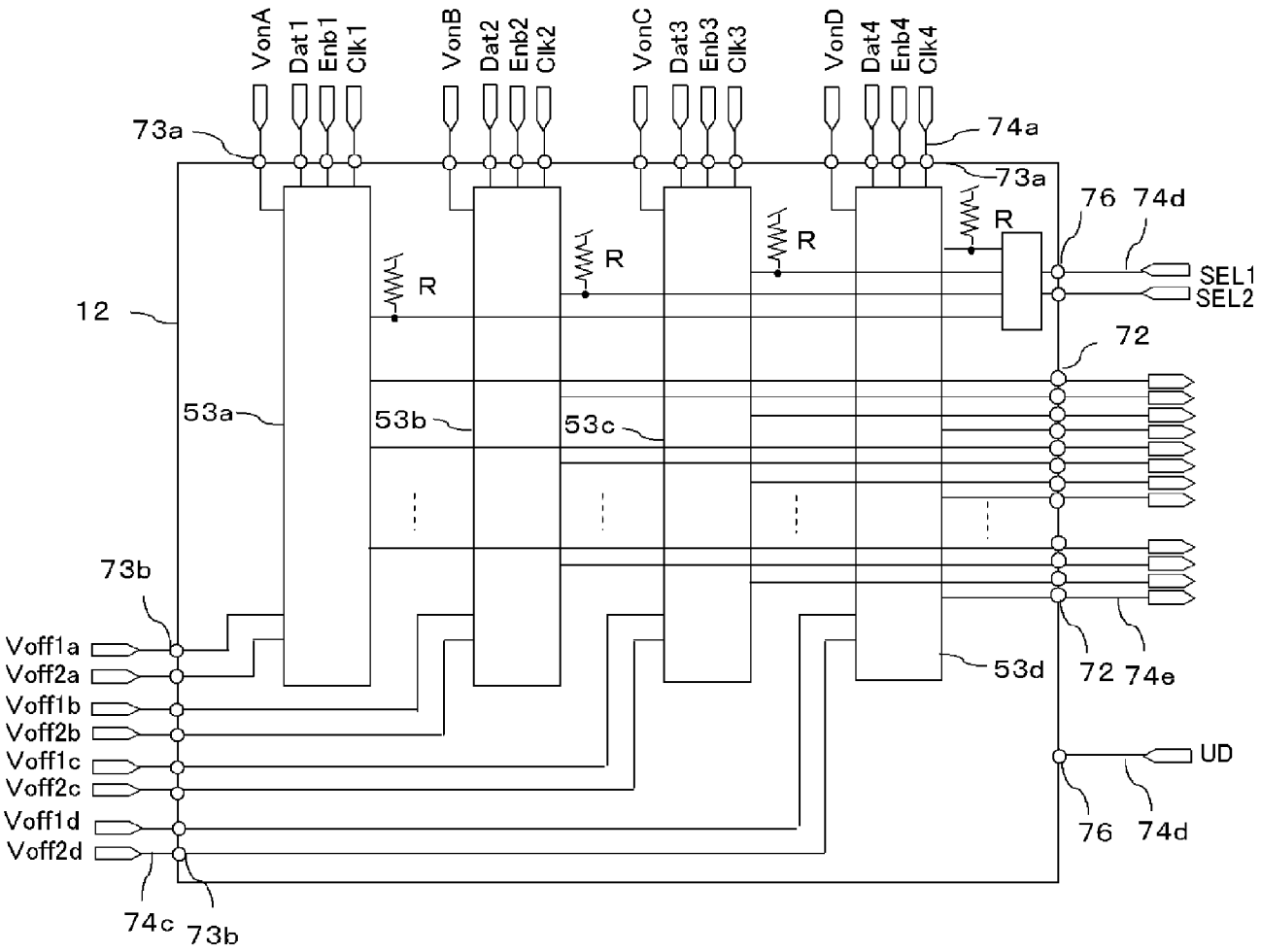
FIG. 15 is a diagram for explaining a gate driver IC of an EL display according to an embodiment.

FIG. 15 is a diagram illustrating a gate driver IC according to another embodiment of the present disclosure. SEL terminals which are control terminals for logic setting are arranged or formed between driver input terminals 73*a* and driver output terminals 72 to which serial connection lines are connected.

A UD terminal that is a control terminal for logic setting is arranged or formed between driver input terminals 73*b* apply voltages (a voltage Von, a voltage Voff) and the driver output terminals 72 to which serial connection lines are connected.

FIG. 15 illustrates a configuration in which the respective gate signal output circuits 53 (53*a*, 53*b*, 53*c*, 53*d*) are provided with respectively different voltages of Voff1 (Voff1*a* to voff1*d*) and Voff2 (Voff2*a* to voff2*d*). The voltage Voff1*a* and a voltage Voff2*a* are supplied to the gate signal output circuit 53*a*. Accordingly, when the gate signal output circuit 53*a* performs a three-value drive of gate voltages, a voltage VonA, a voltage Voff1*a*, and the voltage Voff2*a* are output.

Likewise, when the gate signal output circuit 53*b* performs a three-value drive of gate voltages, a voltage VonB, a voltage Voff1*b*, and a voltage Voff2*b* are output. When the gate signal output circuit 53*c* performs a three-value drive of gate voltages, a voltage VonC, a voltage Voff1*c*, and a voltage Voff2*c* are output. When the gate signal output circuit 53*d* performs a three-value drive of gate voltages, a voltage VonD, a voltage Voff1*d*, and a voltage Voff2*d* are output.

The other details are the same as in FIG. 13 and the above embodiments, and thus the same descriptions are not repeated.

Figure 16:
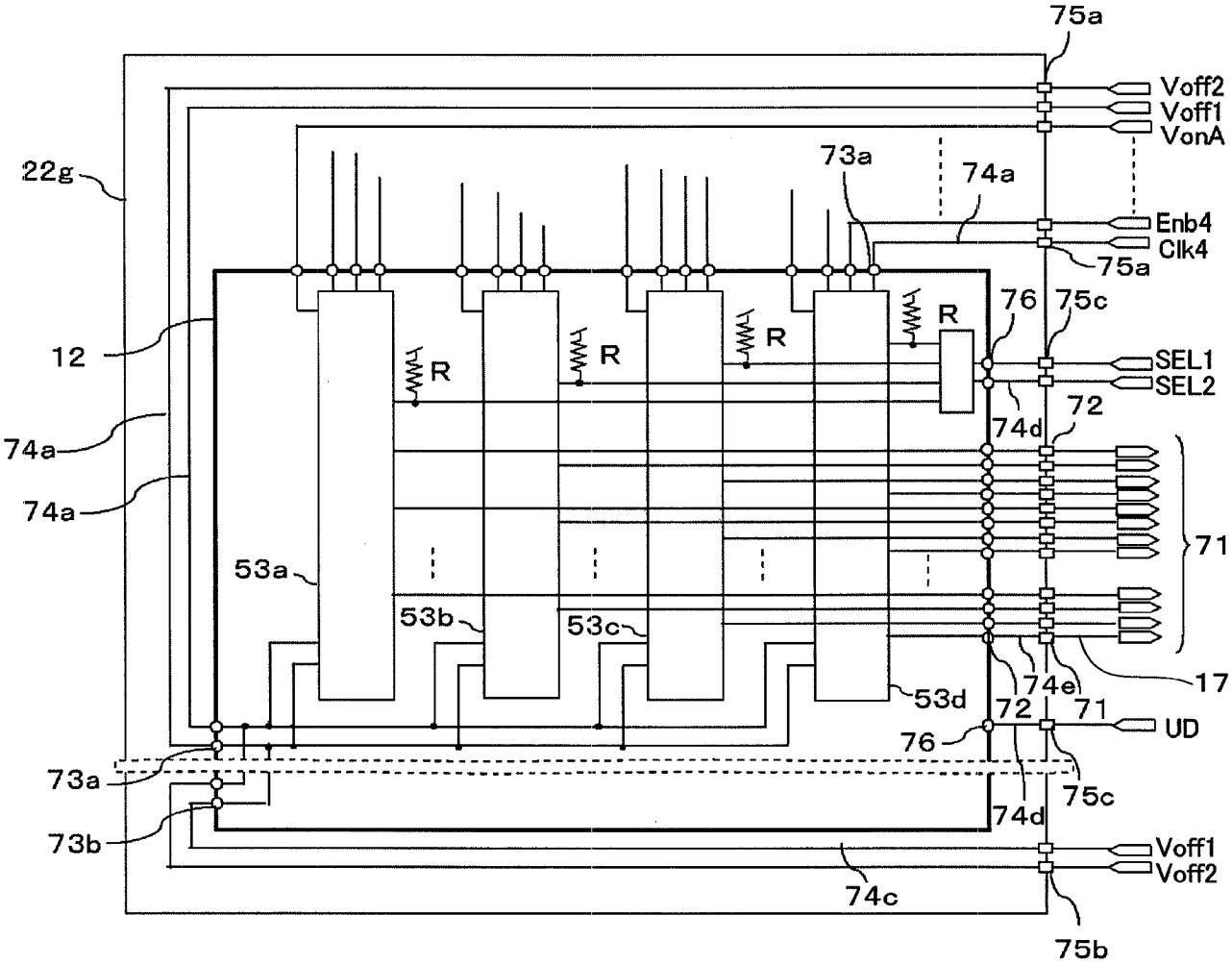
FIG. 16 is a diagram for explaining a gate driver IC of an EL display according to an embodiment.

FIG. 16 is a diagram illustrating a gate driver IC according to another embodiment of the present disclosure. SEL terminals for logic setting or operation setting are connected to connection terminals 75*c*, and gate signal lines 17 are connected to connection terminals 71. A UD terminal for logic setting or operation setting is connected to connection terminal 75*c*. Voltages Voff (Voff1, voff2) are each applied to a connection terminal 75*a* or 75*b*.

In addition, a COF line 74*a*, a COF line 74*c* (not illustrated), and a COF line 74*b* constitute a group of serial connection lines. The connection terminal 75*a* of one of the SEL terminals for logic setting or operation setting is connected or arranged between the connection terminals 71 of the gate signal lines 17 and the connection terminals 75*a*. The connection terminal 75*c* of the UD terminal for logic setting or operation setting is connected or arranged between the connection terminals 71 of the gate signal lines 17 and the connection terminals 75*b*. When a logic voltage is applied to the operation terminals 76, or a pull-up or a pull-down is performed in the gate driver IC C12, no voltage is applied to the operation terminals 76 so as to keep the operation terminals 76 open.

Figure 17:
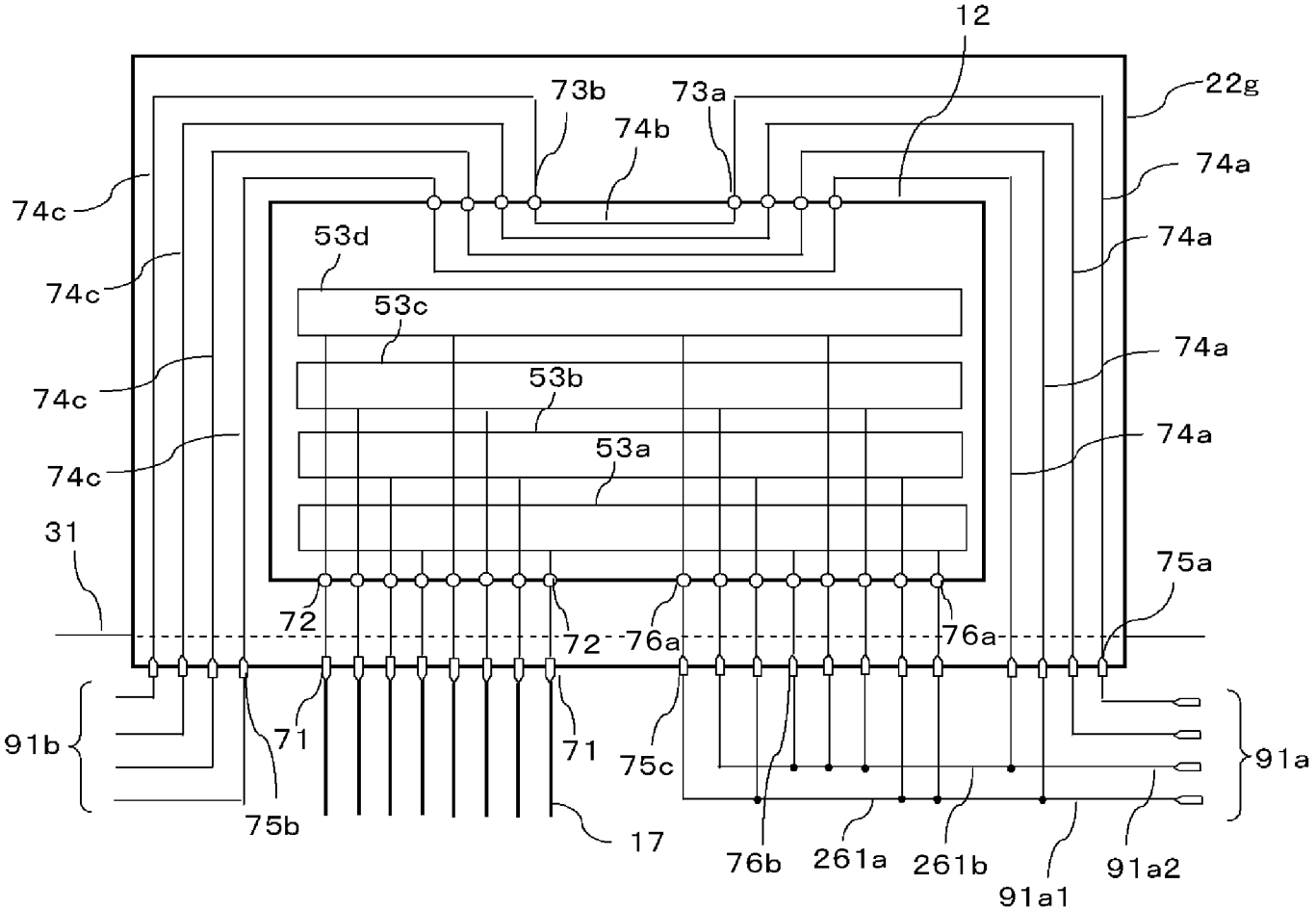
FIG. 17 is a diagram for explaining a gate driver IC of an EL display according to an embodiment.

FIG. 17 illustrates a configuration in which an input control line 261*a* branches from a panel line 91*a*1 of a panel line 91*a*. It is assumed that, for example, a logic voltage Vcc is applied to the input control line 261*a* as a branch. The input control line 261*a* is connected to operation terminals 76*a*.

An input control line 261*b* branches from a panel line 91*a*2 of the panel line 91*a*. It is assumed that, for example, a logic voltage Vgg is applied to the input control line 261*b* as a branch. The input control line 261*b* is connected to operation terminals 76*b*.

With this configuration, the operation terminals 76*b* to which the ground voltage Vgg is applied have a logic level of L. The operation terminals 76*a* to which the logic voltage Vcc is applied have a logic level of H.

The operation terminals 76 (76*a*, 76*b*) are terminals for defining or setting modes, operations, and actions of gate signal output circuits 53 (53*a* to 53*d*) in a gate driver IC 12. The logic levels (H, L) applied to the operation terminals 76 set actions of the gate driver IC 12.

In the configuration of FIG. 17, the input control line 261*a* and the input control line 261*b* are lines formed on a panel. In addition, there are intersection parts between the input control line 261*a* and the input control line 261*b*. However, the intersection parts between the input control line 261*a* and the input control line 261*b* are few, and thus do not reduce a yield of panels. The other details are the same as in the above embodiments of the present disclosure, and thus the same descriptions are not repeated.

Figure 18:
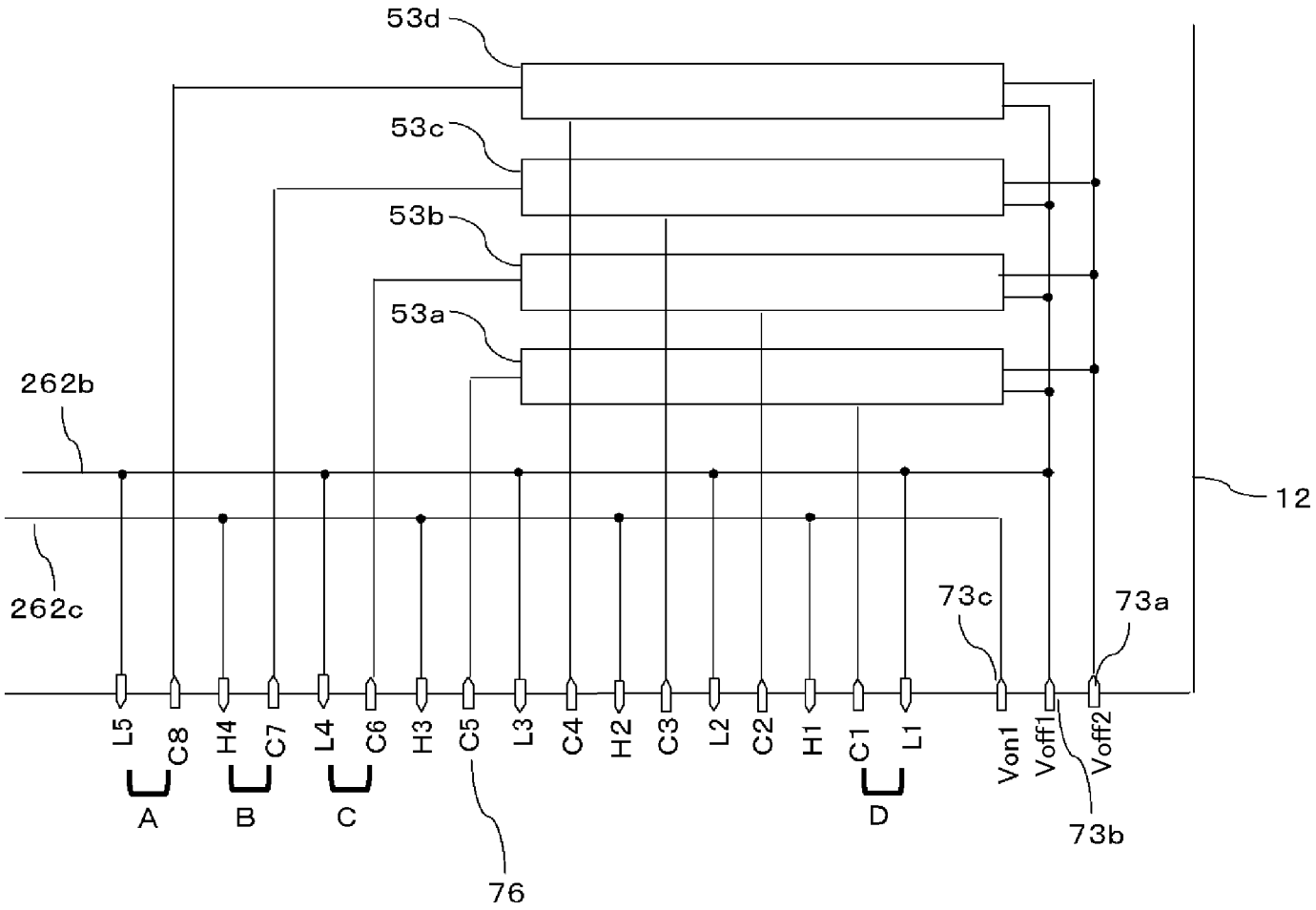
FIG. 18 is a diagram for explaining a gate driver IC of an EL display according to an embodiment.

In FIG. 18, a voltage Voff2 is applied to a driver input terminal 73*a*. A voltage Voff1 is applied to a driver input terminal 73*b*, and a voltage Von1 is applied to a driver input terminal 73*c*.

The voltage Von applied to the driver input terminal 73*c* is used as a voltage of Logic H. The voltage Voff applied to the driver input terminal 73*b* is used as a voltage of Logic L.

The driver input terminal 73*c* is connected to an internal line 262*c*. The driver input terminal 73*b* is connected to an internal line 262*b*. The internal line 262*c* becomes a voltage of Logic (logic level) H, and is output to terminals H4 to H1 of a gate driver IC 12. An internal line 262*b* becomes a voltage of Logic (logic level) L, and is output to terminals L5 to L1 of the gate driver IC 12. Operation terminals C8 to C1 are the operation terminals 76.

As a connection denoted as "A" in FIG. 18, by short-circuiting the terminal L5 and the operation terminal C8, a logic level of L is applied to the operation terminal C8. Accordingly, a gate signal output circuit 53*d* is set to an action corresponding to the logic level of the operation terminal C8.

Likewise, as a connection denoted as "B" in FIG. 18, by short-circuiting the terminal H5 and the operation terminal C7, a logic level of H is applied to the operation terminal C7. Accordingly, the gate signal output circuit 53*c* is set to an action corresponding to the logic level of the operation terminal C7.

As a connection denoted as "C" in FIG. 18, by short-circuiting the terminal L5 and the operation terminal C6, a logic level of L is applied to the operation terminal C6. Accordingly, a gate signal output circuit 53*b* is set to an action corresponding to the logic level of the operation terminal C6.

As a connection denoted as "D" in FIG. 18, by short-circuiting the terminal L1 and the operation terminal C1, a logic level of L is applied to the operation terminal C1. Accordingly, a gate signal output circuit 53*a* is set to an action corresponding to the logic level of the operation terminal C1.

As described above, an EL display according to this embodiment is configured to perform a method for setting the logic levels of the operation terminals 76 through the internal lines 262 (262*b*, 262*c*).

In other words, in each of the embodiments illustrated in FIGS. 12 and 17, it is possible to reduce the number of serial connection lines on the COF 22*g* by forming the input control lines 261 on the panel. As a result, it is possible to reduce the size of the gate driver IC 12, reduce the size of the COF 22*g*, and reduce cost of the EL display (EL display panel).

As illustrated in each of FIGS. 8A, 8B, and 12, it is possible to reduce the number of serial connection lines by forming the internal lines 262 in the gate driver IC 12. As a result, it is possible to reduce the size of the COF, and reduce the cost of the EL display (EL display panel).

Figure 19:
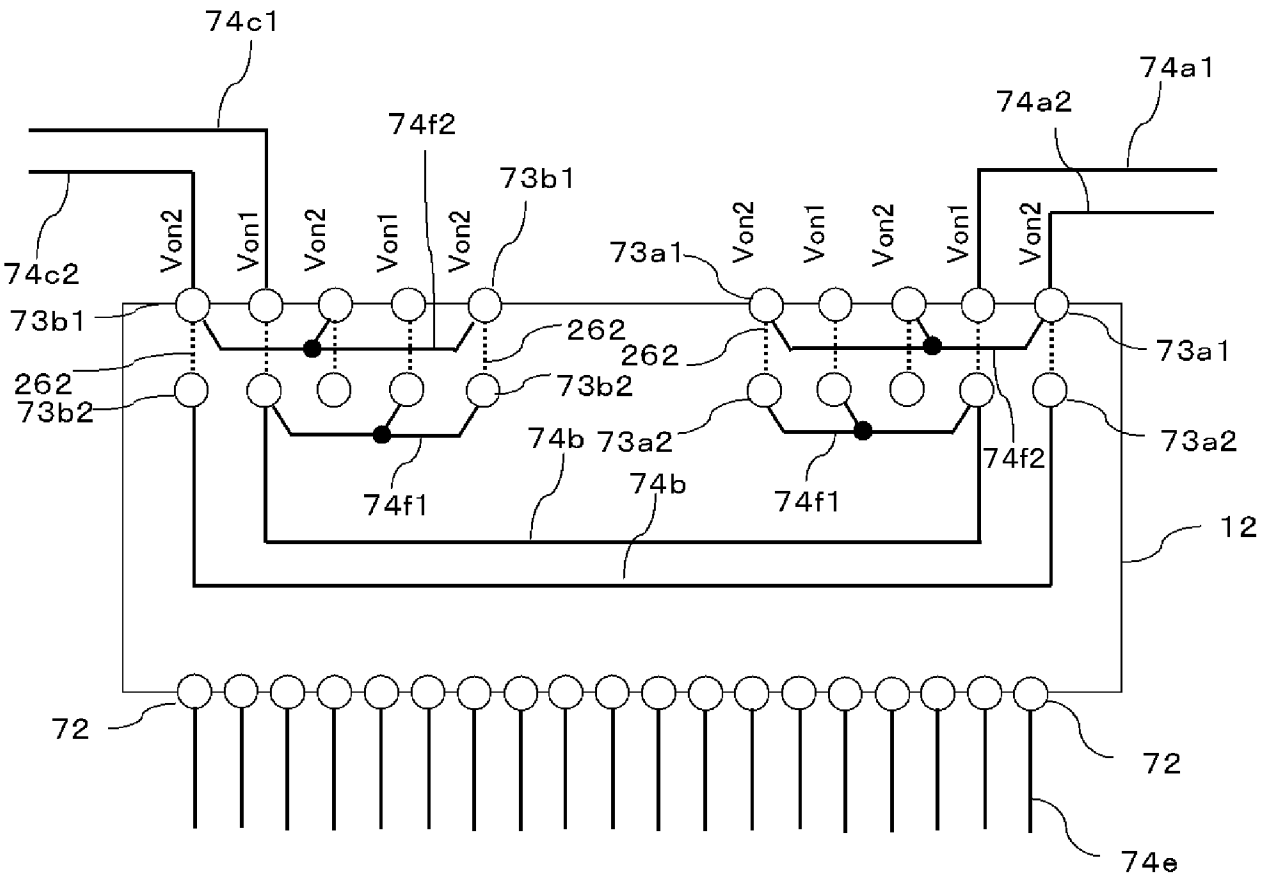
FIG. 19 is a diagram for explaining a gate driver IC of an EL display according to an embodiment.

FIG. 19 illustrates a configuration in which a plurality of driver input terminals 73 (73*a*2, 73*b*2) are arranged for per driver input terminal 73 (73*a*1, 73*b*1), and these driver input terminals are wire-connected through an internal line 262. For example, the driver input terminals 73 (73*b*1, 73*b*2) are formed as input terminals of two driver input terminals Von2, and the driver input terminals 73*b*1 and the driver input terminals 73*b*2 are electrically connected through a corresponding one of the internal lines 262.

Similarly, for example, the driver input terminals 73 (73*b*1, 73*b*2) are formed as input terminals of two driver input terminals, 73 and the driver input terminals 73*b*1 and the driver input terminals 73*b*2 are electrically connected through a corresponding one of the internal lines 262.

In addition, some of the driver input terminals 73*a*2 are electrically connected through a COF line 74*f*1. In addition, some of the driver input terminals 73*a*1 are electrically connected through a COF line 74*f*2. Similarly, some of the driver input terminals 73*b*2 are electrically connected through a COF line 74*f*1. Some of the driver input terminals 73*b*1 are electrically connected through a COF line 74*f*2.

With this configuration, a plurality of Von1 voltages can be supplied to the driver input terminals 73*a*1 and 73*a*2 through a COF line 74*a*1 which supplies the voltages Von1 to the gate driver IC 12. With this configuration, a plurality of voltages Von2 can be supplied to the driver input terminals 73*a*2 and 73*a*1 through a COF line 74*a*2 which supplies the voltages Von2 to the gate driver IC 12.

In addition, a plurality of voltages Von1 can be supplied to the driver input terminals 73*b*1 and 73*b*2 through a COF line 74*c*1 which supplies the voltages Von1 to the gate driver IC 12. In addition, a plurality of voltages Von2 can be supplied to the driver input terminals 73*b*1 and 73*b*2 through a COF line 74*b*2 which supplies the voltages Von2 to the gate driver IC 12.

Although this embodiment has been described regarding the driver input terminals, the present disclosure is not limited thereto. For example, the embodiment in FIG. 19 or the technical idea can of course be applied also to control signal lines.

Although the above embodiments have been described regarding the control signals of the driver input terminals, the present disclosure is not limited thereto. For example, voltage supply lines explained in FIG. 19 may of course be combined therewith.

Needless to say, the above embodiments are also applicable to other embodiments in the present disclosure. Of course, the above embodiments can be combined with other embodiments.

Figure 20A:
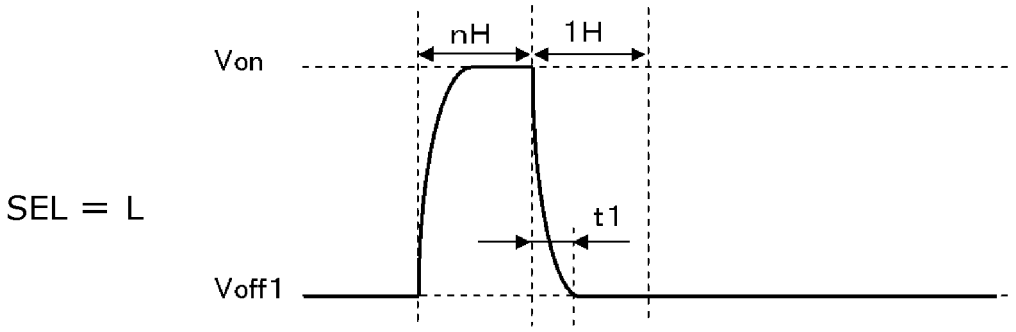
FIG. 20A is a diagram for explaining a method for driving an EL display according to an embodiment.
Figure 20B:
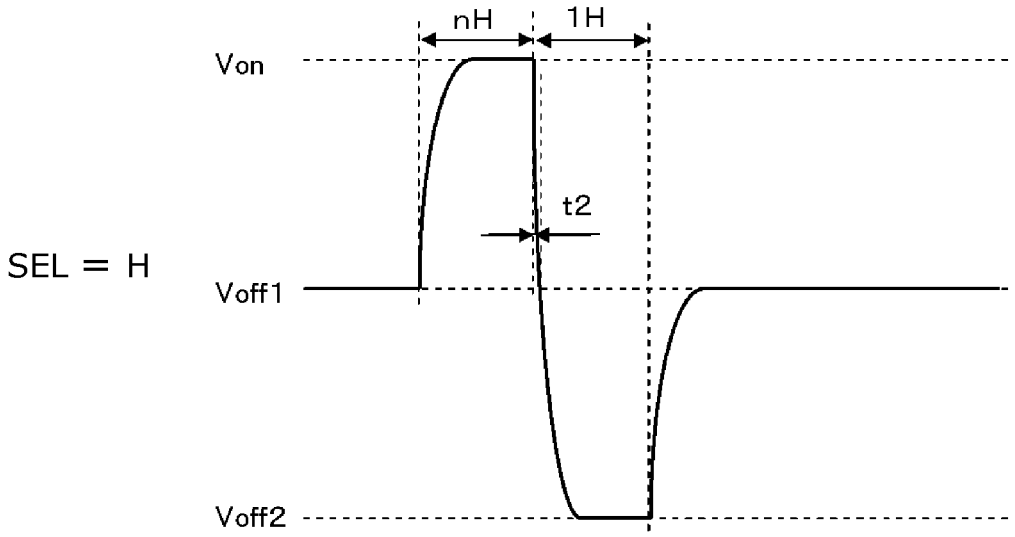
FIG. 20B is a diagram for explaining a method for driving an EL display according to an embodiment.

An output waveform in FIG. 20B can be output from an output terminal of the gate driver IC 12. Output voltages are three voltages of off voltages (Voff1, Voff2), and an on voltage (Von). Since the three voltages are output, this drive is referred to as a three-value drive of gate voltages. Otherwise, it is referred to as a gate over drive.

As illustrated in FIG. 20A, a drive method using two voltages of an off voltage (Voff1) and an on voltage (Von) is referred to as a normal drive of gate voltages or a two-value drive of gate voltages.

The two-value drive of gate voltages (FIG. 20A) or the three-value drive of gate voltages (FIG. 20B) is determined based on a logic voltage to be applied to SEL terminals.

The voltage Von is a voltage for turning on a transistor 11 of a pixel 16. The voltages Voff1 and Voff2 are voltages for turning off the transistor 11 of the pixel 16. More specifically, the voltage Von ranges from 15 (V) to 30 (V) inclusive. The voltage Voff2 ranges from −15 (V) to −8 (V) inclusive. The voltage Voff1 ranges from −8 (V) to −3 (V) inclusive.

Figure 21:
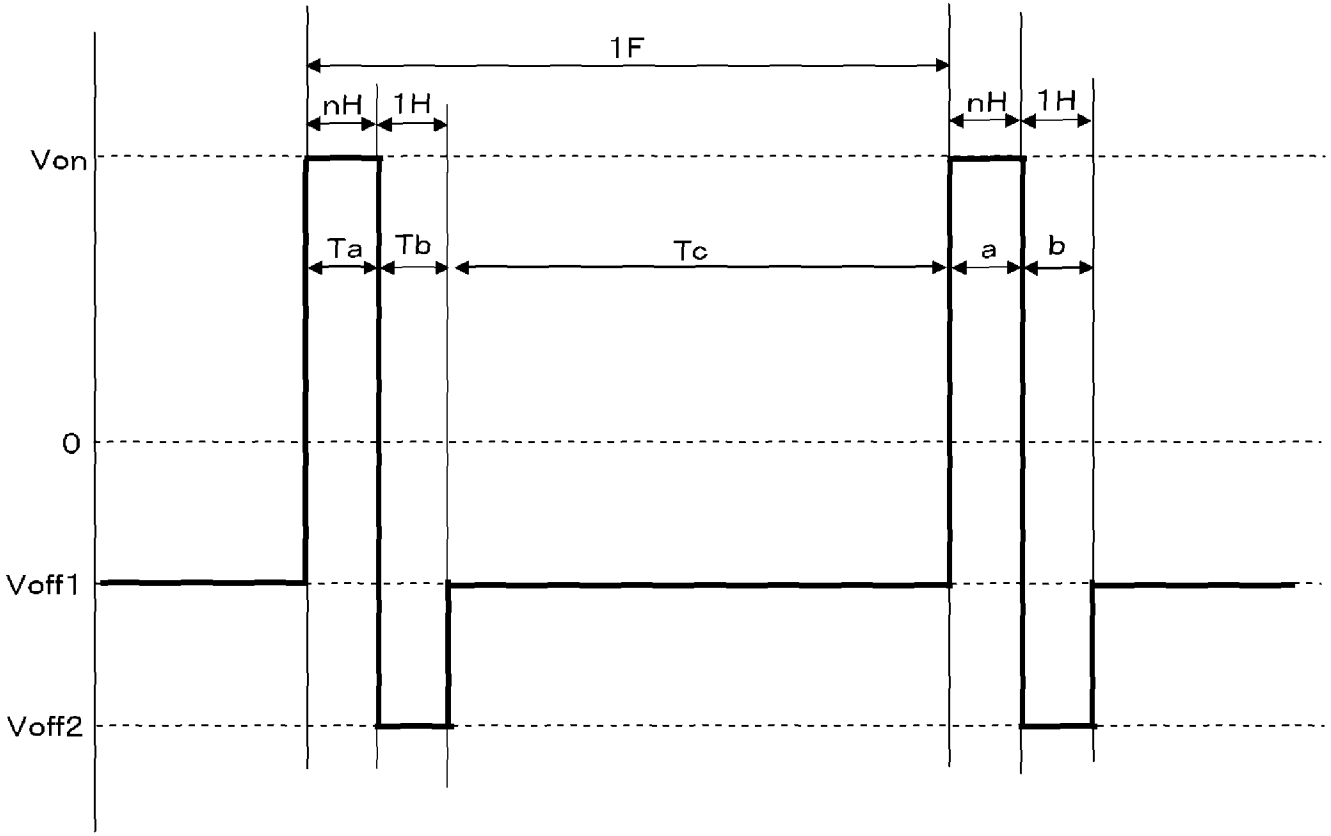
FIG. 21 is a diagram for explaining a method for driving an EL display according to an embodiment.

FIG. 21 is a diagram illustrating a three-value drive of gate voltages. A period Ta in which an on voltage (Von) is output is an nH period (n is an integer of 1 or larger, and H is a horizontal scanning period or a selection period of a pixel row). A period Tb in which a Voff2 is applied is a 1 H period. In addition, 1 F (F is a frame period or a field period)=Ta+Tb+Tc is satisfied.

In each of FIG. 21, FIGS. 22A and 22B, and FIGS. 20A and 20B, a two-value drive of gate voltages and the three-value drive of gate voltages are written assuming that transistors 11 are n-channel transistors. When the transistors 11 are p-channel transistors, the polarity of each of signal waveforms is inverted.

Figure 22A:
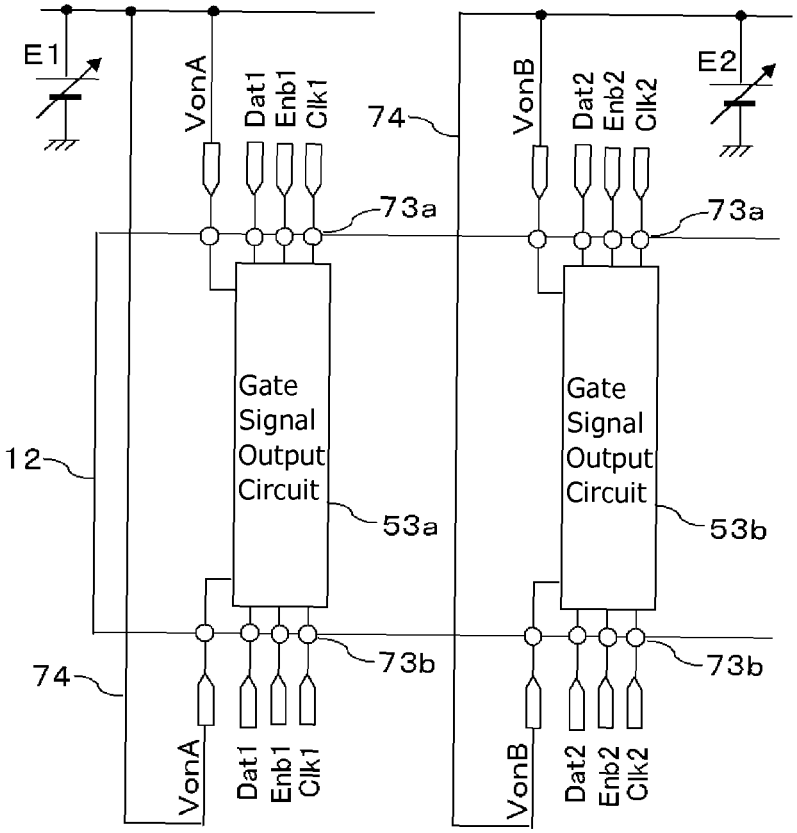
FIG. 22A is a diagram for explaining a gate driver IC for use in an EL display according to an embodiment.
Figure 22B:
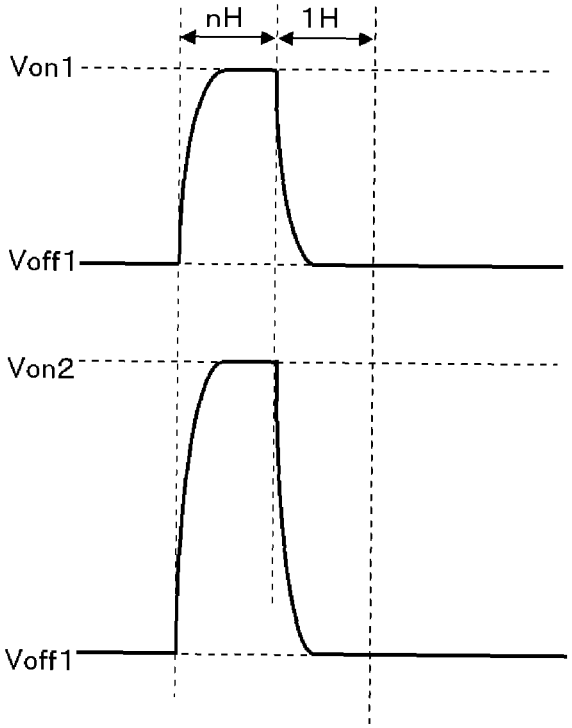
FIG. 22B is a diagram for explaining a gate driver IC for use in an EL display according to an embodiment.

Each of FIGS. 22A and 22B is a diagram illustrating an on voltage Von, and shows an example of the two-value drive of gate voltages.

As illustrated in FIG. 22A, an on voltage VonA of a gate signal output circuit 53*a* is set in a voltage circuit E1 outside a COF. The voltage circuit E1 is a switching power supply circuit, a regulator circuit, or the like. The voltage circuit E1 outputs a voltage Von of the gate signal output circuit 53*a*. An on voltage VonB of a gate signal output circuit 53*b* is set in a voltage circuit E2 outside the COF. The voltage circuit E2 is a switching power supply circuit, a regulator circuit, or the like. The voltage circuit E2 outputs a voltage Von of the gate signal output circuit 53*b*. Von terminals are formed or arranged at least two positions on a gate driver IC 12.

As illustrated in FIG. 22B, it is possible to vary the amplitude of a voltage to be applied to gate signal lines 17 by setting the magnitudes of voltages Von (Von1, Von2). In FIG. 22B, the upper half thereof shows the voltage Von1 denoting an on voltage, and the lower half shows the voltage Von2 denoting an off voltage. Von1<von2 is satisfied. These voltage settings can be performed by the respective gate signal output circuits 53 (53*a*, 53*b*). The application time of a voltage Von is assumed to be an nH (n is an integer of 1 or larger), and n can be varied by a controller (not illustrated).

As in the case of the voltages Von (Von1, Von2), voltages Voff (Voff1, Voff2) can also be varied or adjusted by the respective gate signal output circuits 53 (53*a*, 53*b*). These configurations are the same as in FIGS. 22A and 22B, and thus the same descriptions are not repeated.

Although the voltages Von (Von1, Von2) and voltages Voff (Voff1, Voff2) can be varied or adjusted by the respective gate signal output circuits 53 (53*a*, 53*b*) in each of FIGS. 22A and 22B, and FIGS. 20A and 20B, the present disclosure is not limited thereto. For example, among the voltages Von (Von1, Von2) in the plurality of gate signal output circuits 53 (53*a*, 53*b*), an arbitrary one or more of the plurality of voltages Von may be varied, adjusted, or set. In addition, either the voltage Voff1 or the voltage Voff2 may be varied, adjusted, or set.

FIG. 21 is a diagram illustrating the three-value drive of gate voltages. A voltage Von is applied to a pixel row selected by a shift register 51 in a horizontal scanning (1 H) period (Period Ta: a pixel row selection period) or in a longer period. An application period Tb of a voltage Voff2 is a 1 H period. A voltage Voff1 is applied in Period Tc, and a voltage Voff1 is applied and retained in Period Ta and periods other than Period Tb.

The application period Ta of the voltage Von is an nH period (n is an integer of 1 or larger) in which synchronization with a Clk signal is realized. The three-value drive of gate voltages in FIG. 21 is performed on gate signal lines 17*a* in FIG. 49, gate signal lines 17*a* illustrated in FIG. 48, and gate signal lines 17*a* in FIG. 44 to be described later. In other words, the three-value drive of gate voltages is performed on gate signal lines 17 to which transistors 11 for writing a video signal to pixels 16 are connected.

The voltage Voff2 is applied in the 1 H period (Period Tb) in order to quickly stop selecting (turning off) pixels selected for being applied with a video signal, after writing the video signal thereto. In addition, the voltage Voff1 is retained (in Period Tc) in order to prevent a deep voltage (Voff2) from being applied to the gate terminal of the transistors 11 so as to prevent a change such as a Vt shift from occurring and changing a transistor characteristic.

As illustrated in FIG. 20A, in the two-value drive of gate voltages, it takes long time t1 to change from the voltage Von to the voltage Voff1. The long t1 causes a leak of the video signal written to the pixels in the period, resulting in a crosstalk between vertically adjacent pixels.

As illustrated in FIG. 20B, when the three-value drive of gate voltages is performed, it takes very short time t2 to change from the voltage Von to the voltage Voff1. Accordingly, no leak of the video signal written to the pixels occurs, and no crosstalk between vertically adjacent pixels occurs.

After an application period of the voltage Von, the voltage Voff2 is applied in a 1 H period or a period (Period Tb) shorter than the 1 H period. After an application period of the voltage Voff2, the voltage Voff1 is applied to the gate signal line 17 corresponding to the selected pixel row, and the gate signal line is retained at the voltage Voff1 in a period (Period Tc) before a next frame period in which a voltage Von is applied.

In the case of the two-value drive of gate voltages (a normal drive of gate voltages), there is no Period Tb as illustrated in FIG. 21, and thus no voltage Voff2 is applied to a selected pixel row. Accordingly, the voltage Von is applied in the period (Period Ta) selected by the shift register 51; and, in the period (Period Tc), the voltage Voff1 is applied, the off voltage is applied to the gate signal line 17, and the transistors 11 connected to the gate signal line 17 are retained in an off state.

After an application period of the voltage Von, the voltage Voff2 is applied in a 1 H period or in a period shorter than the 1 H period. After an application period of the voltage Voff2, the voltage Voff1 is applied to the gate signal line 17 corresponding to the selected pixel row, and the gate signal line 17 is retained at the voltage Voff1 in a period before a next frame period in which a voltage Von is applied.

It is to be noted that the two-value drive of gate voltages and the three-value drive of gate voltages are set by a logic signal to be applied to SEL (SEL1, SEL2) terminals. As illustrated in each of FIGS. 20A and 20B, a gate signal output circuit 53 is set to the mode of two-value drive of gate voltages when the logic voltage to be applied to the SEL (SEL1, SEL2) terminals is "L". When the logic voltage to be applied to the SEL (SEL1, SEL2) terminals is "H", the gate signal output circuit 53 is set to the mode of three-value drive of gate voltages.

As illustrated in FIG. 21, the voltage Voff2 applied in Period Tb after Period Ta (the period in which the video signal is written to the pixel row) reduces, to t2, the period for a transition from the Von voltage application state to when the Voff1 voltage level for turning off the transistors 11 is reached as illustrated in FIG. 20B. As illustrated in FIG. 20A, in the two-value drive of gate voltages, it takes long time t1 to change from the Von voltage level to the Voff1 voltage level.

In the t1 period in the two-value drive of gate voltages, the transistors connected to the gate signal lines 17 (17*a*, 17*b*) are not in a completely off state, and thus, for example, video signals written to the pixels 16 leak. On the other hand, in the t1 period in the three-value drive of gate voltages, since the applied voltage Voff2 reduces, to t2, the period for the transition from the Von voltage level to the Voff1 voltage level, no video signals written to the pixels 16 do not leak. Accordingly, no crosstalk, signal leak, etc. occur, which enables generation of an excellent display image.

In the embodiment described with reference to FIG. 9, setting the SEL1 terminal to the "H" logic enables setting of the gate signal output circuit 53*a* to the three-value drive of gate voltages. Setting the SEL2 terminal to the "H" logic enables setting of the gate signal output circuit 53*b* to the three-value drive of gate voltages. As described above, in the present disclosure, the SEL terminals enable a switch between the two-value drive of gate voltages and the three-value drive of gate voltages independently or indivisually for the gate signal output circuits 53 corresponding respectively to the gate signal lines 17.

The gate signal output circuit 53*a* is set to the three-value drive of gate voltages by setting the SEL1 terminal to the "H" logic, and the gate signal output circuit 53*b* is set to the three-value drive of gate voltages by setting the SEL2 terminal to the "H" logic. The gate signal output circuit 53*c* is set to the three-value drive of gate voltages by setting a SEL3 terminal to the "H" logic, and the gate signal output circuit 53*d* is set to the three-value drive of gate voltages by setting a SEL4 terminal to the "H" logic.

FIG. 15 illustrates a possible configuration in which the SEL terminals are two terminals (SEL1, SEL2), the logic signal applied to these two terminals is decoded for use in selecting one of the four gate signal output circuits 53 (53*a*, 53*b*, 53*c*, 53*d*). The three-value drive of gate voltages is performed by the gate signal line 17 to which the transistor which writes the video signal to the pixels 16. The gate signal line 17 is only one of the gate signal lines 17 (17*a*, 17*b*) passing through each of the pixels. In other words, even when the plurality of gate signal driver circuits are formed in the gate driver IC 12, one of them can be set to be subject to the three-value drive of gate voltages, and the other gate signal driver circuit may be subject to the two-value drive of gate voltages.

For example, when eight gate signal driver circuits are arranged or formed on a single gate driver IC 12, the number of SEL terminals may be three, and a decoder (3-8 decoder) for selecting one of the eight 3-bit gate signal line driver circuits may be configured.

As described above, in the present disclosure, the SEL terminals enable a switch between the two-value drive of gate voltages and the three-value drive of gate voltages independently or indivisually for the gate signal output circuits 53 corresponding respectively to the gate signal lines 17.

In the present disclosure, the gate signal line 17 connected to the transistors for wringing a video signal is driven by a both-side drive (performed by the two gate driver ICs 12 arranged right and left of a display screen 25). The other gate signal lines for which fast slew rate is not required is driven by a one-side drive (performed by one of the gate driver ICs 12 arranged right and left of the display screen 25).

In this embodiment of the present disclosure, the both-side drive means a drive performed by the two gate driver ICs 12 (12*a*, 12*b*) arranged right and left of the display screen 25. However, this is a non-limiting example. The both-side drive means any drive performed by the gate driver IC 12*a*. For example, the both-side drive includes a drive in which two gate driver ICs (12*a*, 12*b*) are connected or arranged at one side of a gate signal line 17.

In other words, the both-side drive is a drive method in which the single gate signal line 17*a* is driven by the plurality of gate driver ICs 12 (12*a*, 12*b*). Although descriptions are given assuming that the gate signal line 17*a* is driven by the gate driver ICs 12 (12*a*, 12*b*), this is a non-limiting example. For example, the present disclosure covers a configuration in which gate driver circuits (not illustrated) are formed or arranged directly on a panel board 31 according to a technique using TAOS, or a low or high temperature polysilicon, and the gate driver circuits drive gate signal lines 17.

Accordingly, the present disclosure covers a configuration in which gate driver circuits are connected to both sides of a single gate signal line 17. The present disclosure further covers a configuration in which a gate driver IC 12 is connected to one side of a single gate signal line 17, and a gate driver circuit is connected to the other end. The present disclosure further covers a configuration in which two gate driver circuits are connected to one side of a single gate signal line 17.

The present disclosure is explained mainly taking, as an example, a method for applying a video signal voltage to pixels 16 (a program voltage method). However, this disclosure is a non-limiting example. A method for applying a video signal current to pixels 16 (a program current method) is also possible. A digital drive method, such as a PWM drive, for causing pixels 16 to display the video signal in a flickering or digitally flickering manner. Another drive method is also possible. The drive method may be a luminescence area variation drive in which a luminescence area represents a luminescence intensity.

The PWM drive is, for example, a method in which a voltage of a predetermined value is applied to pixels 16 through switch transistors 11*b* to turn on or off switch transistors 11*d*, so that a video is displayed in grayscale according to the number of bits corresponding to the grayscale.

In addition, the switch transistors 11*d* are controlled to turn on and off to generate a belt-shaped black display (non-display) on the display screen 25 so as to control the amount of current flowing on the display screen 25.

Figure 23:
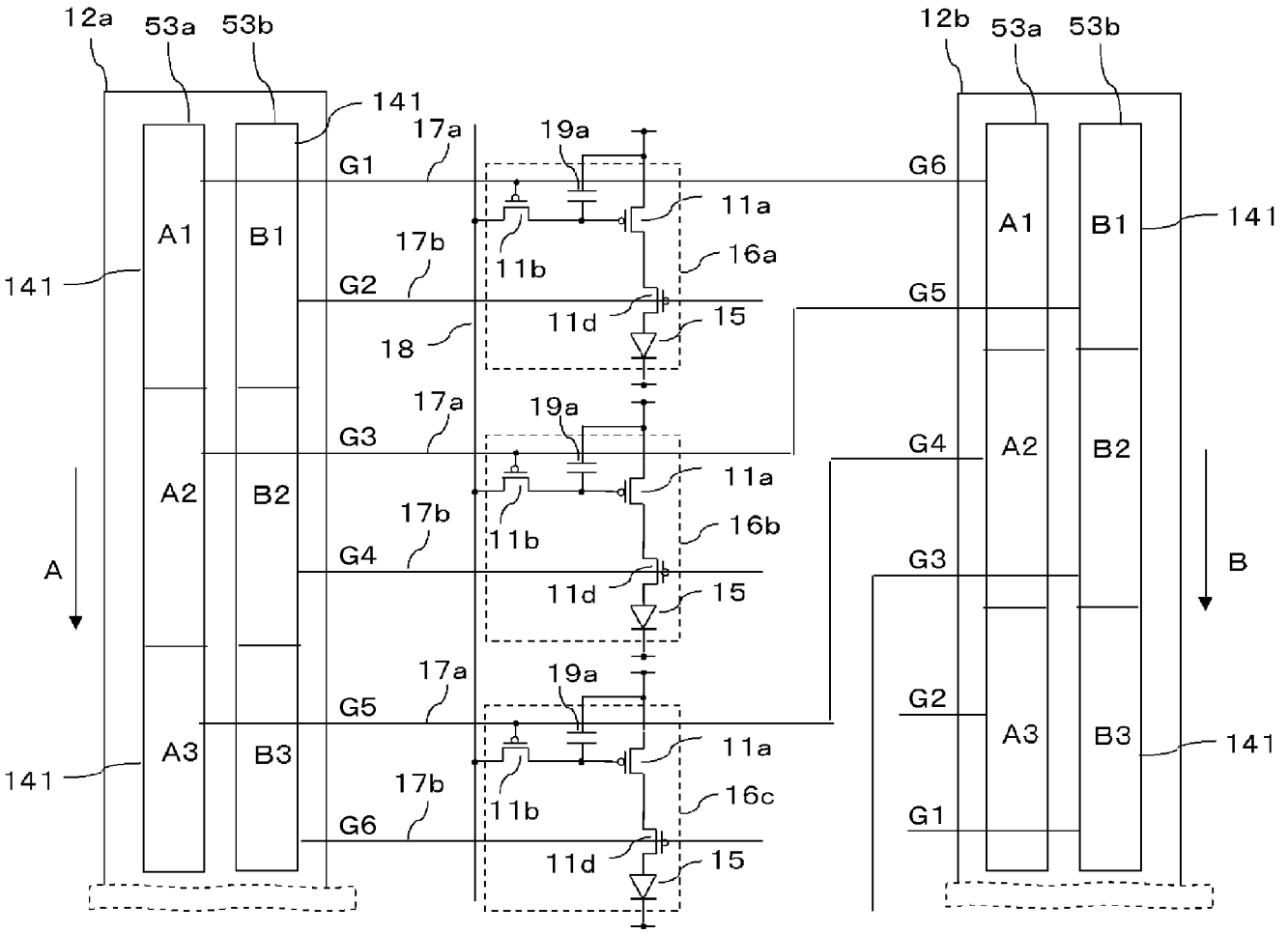
FIG. 23 is a diagram for explaining an EL display according to an embodiment.

FIG. 23 is a diagram for explaining a method for driving an EL display according to the present disclosure. In this disclosure, a gate driver IC 12*a* and a gate driver IC 12*b* are gate driver ICs having the same specifications. The gate driver IC 12*a* and the gate driver IC 12*b* are arranged in line symmetric with respect to the center axis of the display screen. The gate driver IC 12*a* and the gate driver IC 12*b* are different in logics of UD terminals (terminals which set scanning directions, not illustrated). In other words, the UD terminal of the gate driver IC 12*a* is set to perform scanning in Direction A, and the UD terminal of the gate driver IC 12*b* is set to perform scanning in Direction B.

Two gate signal output circuits 53 (53*a*, 53*b*) are arranged or formed in the gate driver ICs 12 (12*a*, 12*b*). A1, A2, A3, . . . and B1, B2, B3, . . . of the gate signal output circuits 53 denote data units (referred to as blocks 141) whose data is shifted according to a clock of a shift terminal (Clk terminal).

The gate signal output circuit 53*a* of the gate driver IC 12*a* drives a gate signal line 17*a*. The gate signal output circuit 53*b* of the gate driver IC 12*a* drives a gate signal line 17*b*.

In the gate signal output circuit 53*a*, Blocks A1 and B1 drive (control) pixels 16*a*, Blocks A2 and B2 drive (control) pixels 16*b*, and Blocks A3 and B3 drive (control) pixels 16*c*. The same applies to the succeeding blocks. In other words, in the gate driver IC 12*a*, an input of a clock (Clk) shifts the pixel row selection position by a pixel row.

In the gate signal output circuit 53*b*, Block A1 drives (controls) pixels 16*a*, Block B2 drives (controls) pixels 16*b*, and Block B2 drives (controls) pixels 16*c*. The same applies to the succeeding blocks. In other words, in the gate driver IC 12*b*, an input of a clock shifts the pixel row selection position by two pixel rows.

Accordingly, in order to cause the gate driver IC 12*a* and the gate driver IC 12*b* to select a pixel row in synchronization with each other, there is a need to cause the gate driver IC 12*b* to operate at a clock speed that is the half of the clock speed of the gate driver IC 12*a*.

The gate driver IC 17*a* of each pixel row is connected to the gate signal output line 53*a* of the gate driver IC 12*a*. In addition, the gate signal line 17*a* passing through an odd pixel row is connected to the gate signal output circuit 53*a* of the gate driver 12*a*, and the gate signal line 17*b* passing through an even pixel row is connected to the gate signal output circuit 53*b* of the gate driver 12*b*. The gate signal line 17*b* of each pixel row is connected to the gate signal output circuit 53*b* of the gate driver IC 12*a*.

With these connections, the gate signal line 17*a* of each pixel row is subject to a both-side drive by (i) the gate signal output circuit 53*a* of the gate driver IC 12*a* and (ii) the gate signal output circuit 53*a* and the gate signal output circuit 53*b* of the gate driver IC 12*b*. Accordingly, it is possible to drive, at a high slew rate, the gate signal line 17*a* to which the switch transistors 11*b* for applying a video signal to pixels are connected.

The gate signal line 17*b* is driven only by the gate signal output circuit 53*b* of the gate driver IC 12*a*. However, the switch transistor 11*d* does not require fast on and off actions. Accordingly, it is possible to realize practically sufficient characteristics by performing the one-side drive only by the gate signal output circuit 53*b* of the gate driver IC 12*a*.

The gate driver IC 12*a* drives the gate signal line 17*a* and the gate signal line 17*b*. The gate driver IC 12*b* drives only the gate signal line 17*a*. The gate driver IC 12*a* and the gate driver IC 12*b* have basically the same configurations. Accordingly, the number of gate driver ICs 12*b* arranged right of or connected to a display screen 25 may be the half of the number of gate driver ICs 12*a* arranged left of or connected to the display screen 25. For this reason, compared to a conventional EL display, the number of gate driver ICs 12 (12*a*, 12*b*) can be reduced, which enables cost reduction.

Figure 24:
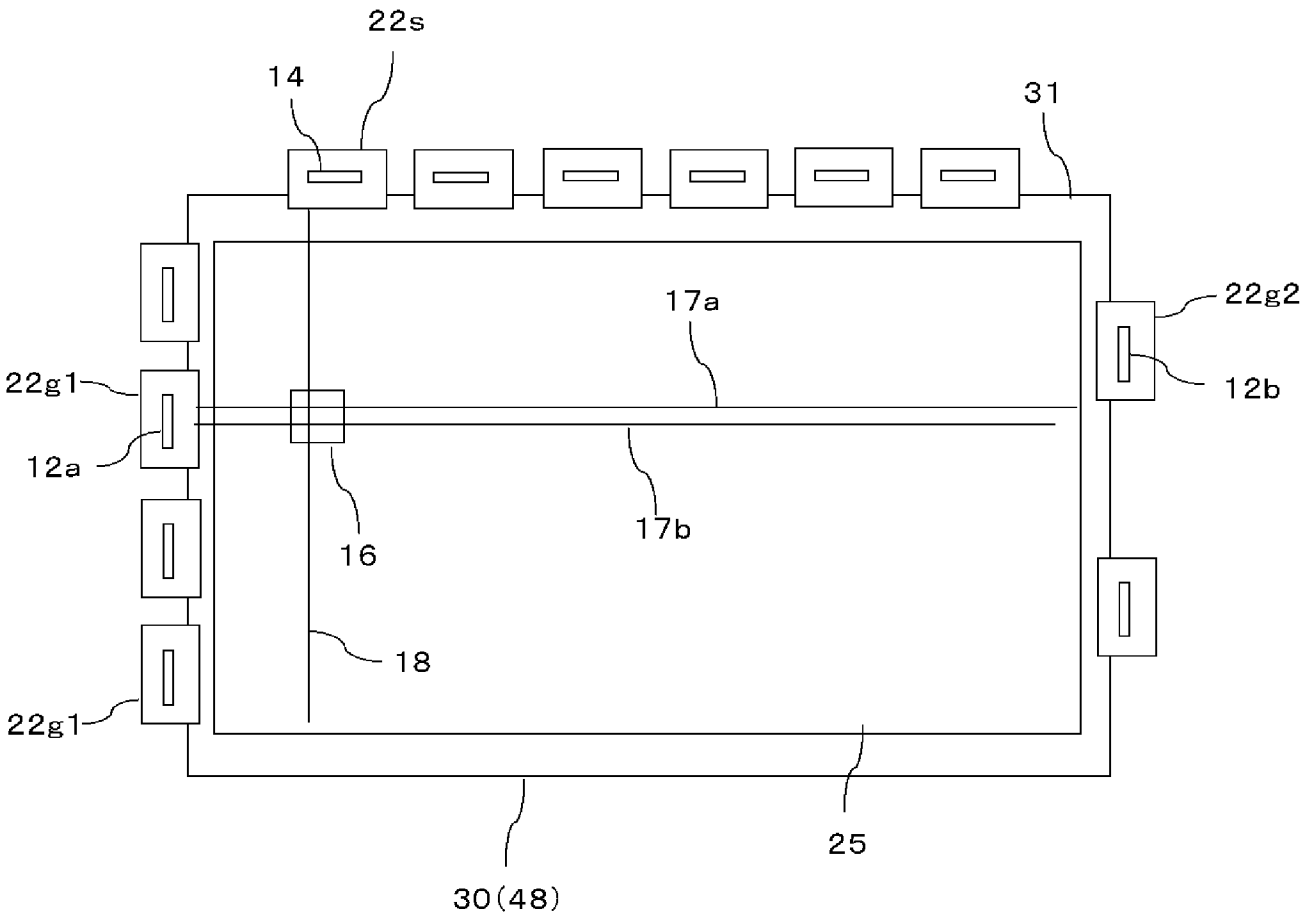
FIG. 24 is a diagram for explaining an EL display according to an embodiment.

For example, in the EL display (EL display panel) illustrated in FIG. 24, the number of gate driver ICs 12*a* arranged left of a display screen 25 is four, and the number of gate driver ICs 12*b* arranged right of the display screen 25 is two that is the half of four.

Figure 25:
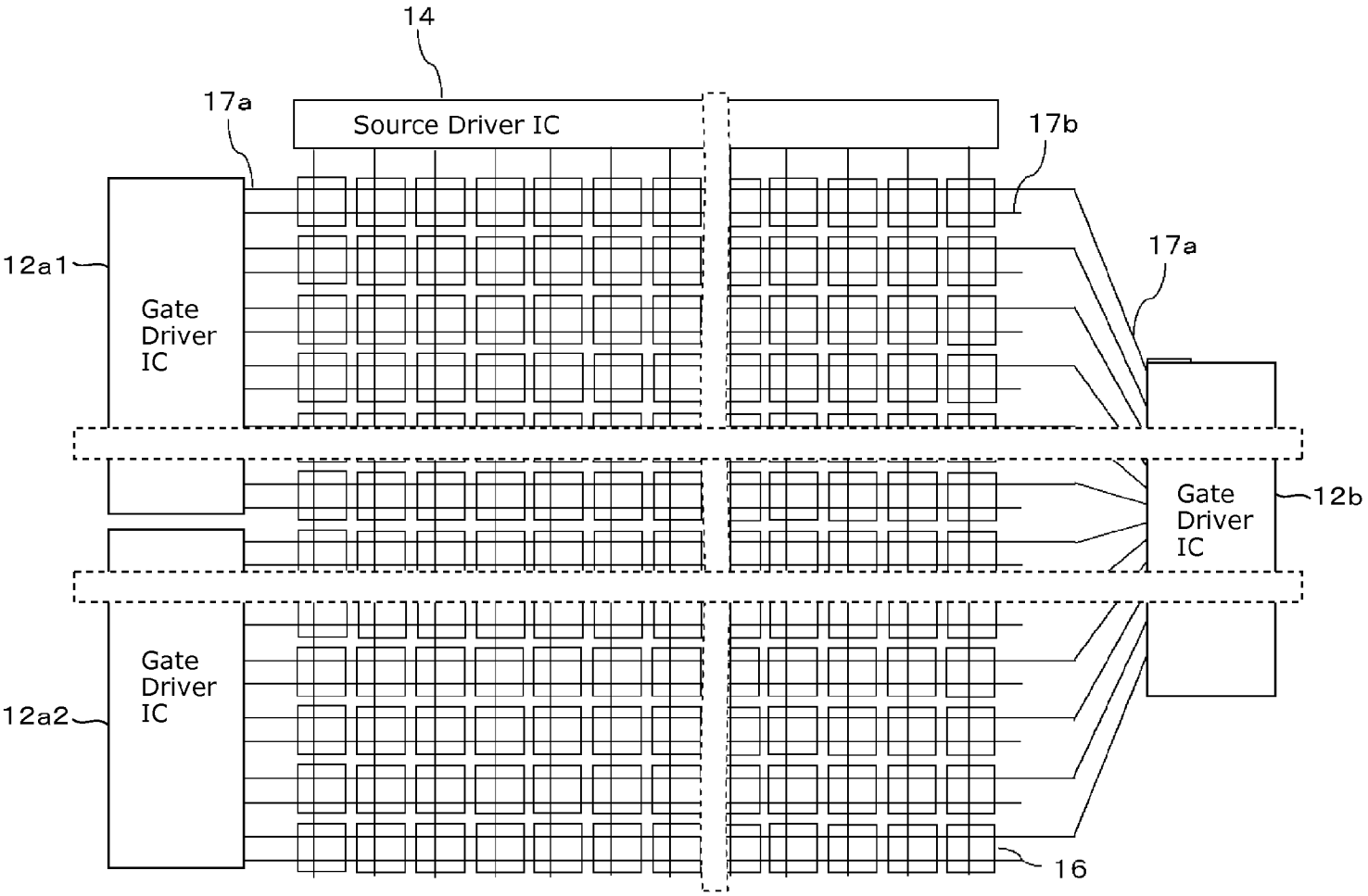
FIG. 25 is a diagram for explaining the EL display according to the embodiment.

FIG. 25 illustrates a wire-connection or a connection state of gate signal lines 17 (17*a*, 17*b*) in FIG. 24. In FIG. 25, the gate driver IC 12*b* is connected to the gate signal line 17*a*. The gate driver ICs 12*a* (12*a*1, 12*a*2) are connected to the gate signal line 17*a* and the gate signal line 17*b*. The gate signal line 17*a* and the gate signal line 17*b* receive an on voltage and an off voltage applied thereto.

Figure 26:
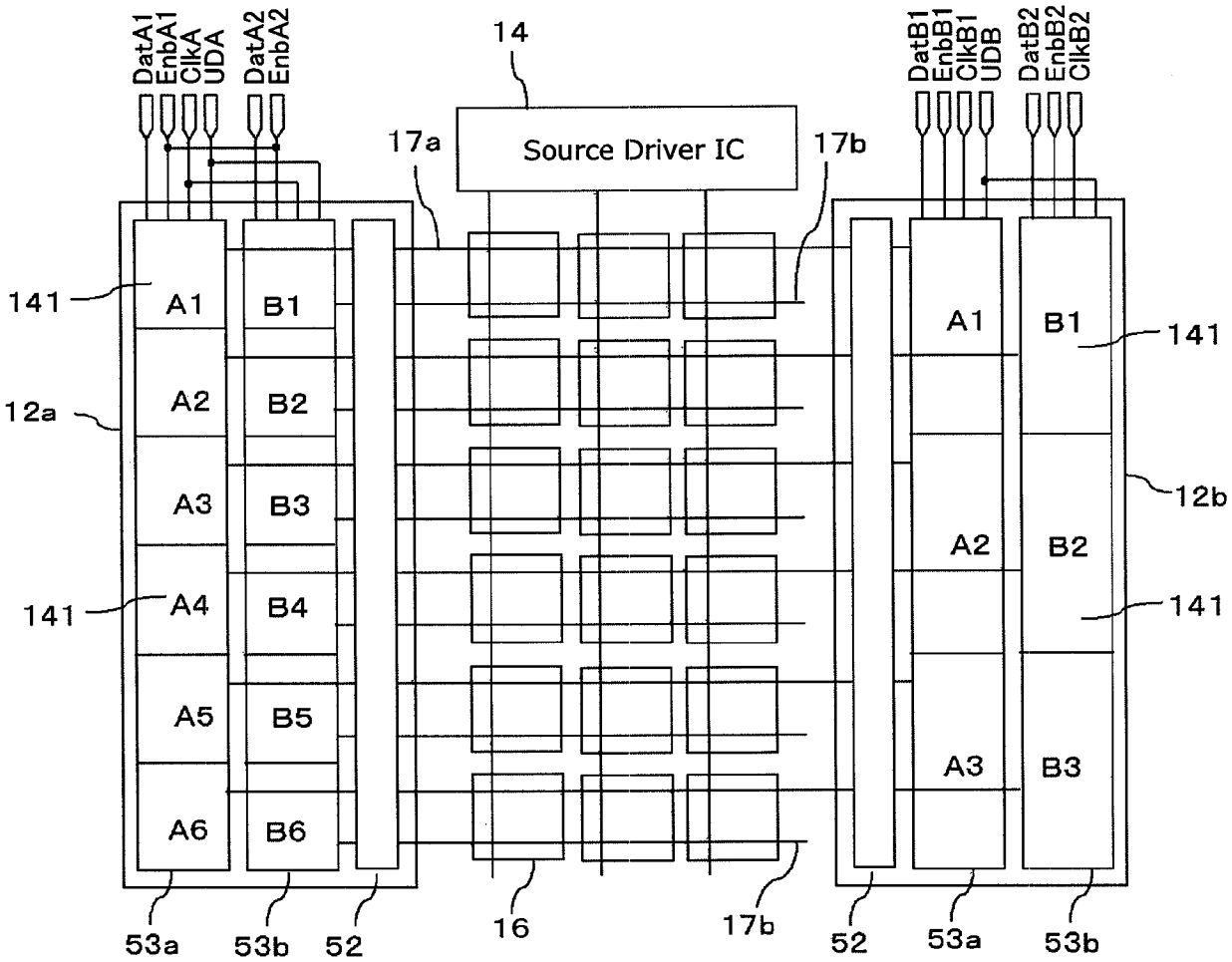
FIG. 26 is a diagram for explaining an EL display according to an embodiment.

The gate driver IC 12*a* and the gate signal line 17*b* are ICs having basically the same specifications although they are different in state of connections of control signal lines etc. (as illustrated in FIG. 26 etc.). The gate driver IC 12*b* drives the gate signal line 17*a* which needs to be subject to a both-side drive. The gate driver ICs 12*a* (12*a*1, 12*a*2) are connected to pixels. The gate driver IC 12*a* drives all gate signal lines 17 (17*a*, 17*b*). In other words, the gate driver ICs 12*a* drive the gate signal lines 17*a* which need to be subject to a both-side drive and the gate signal lines 17*b* to be subject to a one-side drive.

The plurality of gate signal output circuits 53 (53*a*, 53*b*) formed or arranged on the gate driver IC 12*b* drive the gate signal lines 17 (17*a*, 17*b*) at different pixel rows. For example, in the configuration in which the two gate signal lines 17 (17*a*, 17*b*) are provided per pixel as illustrated in FIG. 23, the gate signal output circuit 53*a* of the gate driver IC 12*b* drives the gate signal lines 17*a* passing through the odd pixel row, and the gate signal output circuit 53*b* drives the gate signal lines 17*b* passing through the even pixel row As illustrated in FIG. 26, in the case of a configuration in which four gate signal lines are provided per pixel, and two of the gate signal lines 17 (17*a*, 17*b*) are subject to a both-side drive while the other two gate signal lines 17 (17*a*, 17*b*) are subject to a one-side drive, the gate signal output circuits 53*a* and 53*b* drive the gate signal lines 17 (17*a*, 17*b*) at each of the odd pixel rows, and the gate signal output circuits 53*c* and 53*d* drive the gate signal lines 17 (17*c*, 17*d*) at each of the even pixel rows. The four gate signal output circuits 53 (53*a*, 53*b*, 53*c*, 53*d*) of the gate driver IC 12*a* are sequentially drive the four gate signal lines 17 (17*a*, 17*b*, 17*c*, 17*d*) in a listed order of a first odd pixel row, a first even pixel row, a second odd pixel row, and a second even pixel row.

FIG. 26 is a diagram illustrating an EL display according to the present disclosure. FIG. 26 illustrates control terminals etc. In the drawings of the present disclosure, parts that are unnecessary for explanation are not illustrated. In the embodiment with reference to FIG. 26, an output buffer 52 is arranged at an output side of the gate signal output circuits 53 (53*a*, 53*b*).

In FIG. 26, Dat (DatA1, DatA2, DatB1, DatB2) terminals are data input terminals of shift registers 51 (51*a*, 51*b*). By setting the Dat terminals to Data "H", on data is input to shift registers 51 (51*a*, 51*b*) according to a clock applied to clock terminals ((Clk (Clk1, ClkB1, ClkB2)). By setting the Dat terminals to Data "L", off data is input to the shift registers 51 (51*a*, 51*b*) by clocks applied to the clock terminals (Clk). When on data is retained in one of blocks 141 of one of the shift registers 51 (51*a*, 51*b*), an on voltage is applied or output to a corresponding one of gate signal lines 17 (17*a*, 17*b*, 17*c*, 17*d*), or on voltages in the gate signal line 17 is retained. When off data is retained in one of blocks 141 of one of the shift registers 51 (51*a*, 51*b*), an off voltage is applied or output to the corresponding one of the gate signal lines 17, or an off voltage in the gate signal line 17 is retained.

The on data and off data retained or latched in the shift registers 51 (51*a*, 51*b*) sequentially shift data retention states in the blocks 141 according to clock signals applied to the clock (Clk) terminals. A shift direction is changed by a logic signal applied to a UD terminal (not illustrated).

Enb terminals are terminals for controlling enable signals. By setting the Enb terminals to Data "H", an on voltage or an off voltage is output to the gate signal lines 17, in association with the on data or the off data retained or latched in the shift registers 51.

By setting the Enb terminals to Data "L", an off voltage is output to the gate signal lines 17 or an off voltage in the gate signal lines 17 is retained, irrespective of the on data or the off data retained or latched in the shift registers 51.

In FIG. 26, the gate signal output circuit 53*a* and the gate signal output circuit 53*b* of the gate driver IC 12*a* share a ClkA (clock) terminal, a UDA (up and down) terminal, and EnA ((EnbA1, EnbA2), enable) terminals. Each of the gate signal output circuit 53*a* and the gate signal output circuit 53*b* of the gate driver IC 12*a* has a corresponding one of Dat (data) terminals (DatA1, DatA2) for independent use. The EnbA1 terminal and the EnbA2 terminal are separate in the drawing sheet because the EnbA1 terminal is a terminal for controlling the gate signal line 17*a* to be an off state and the EnbA2 terminal is a terminal for controlling the gate signal line 17*b* to be an off state.

Although the clock terminal (ClkA) is not illustrated in the gate signal output circuit 53*b* of the gate driver IC 12*a* in the drawing of FIG. 26 etc. in the present disclosure, it is to be noted that the gate driver IC 12*a* has such a terminal. Although descriptions are given assuming that the gate driver ICs 12 (12*a*, 12*b*) are ICs, this is a non-limiting example. Alternatively, not to mention, the gate driver ICs 12 may be made of polysilicon or the like and formed directly on a glass board.

In FIG. 26, a gate signal output circuit 53*a* and a gate signal output circuit 53*b* of a gate driver IC 12*b* share a UDB (up and down) terminal. Each of the gate signal output circuit 53*a* and the gate signal output circuit 53*b* of the gate driver IC 12*b* has, for independent use, a corresponding one of Dat (data) terminals (DatB1, DatB2), a corresponding one of Enb (enable) terminals (EnbB1, EnbB2), and a corresponding one of Clok (clock) terminals (ClkB1, ClkB2).

Figure 27:
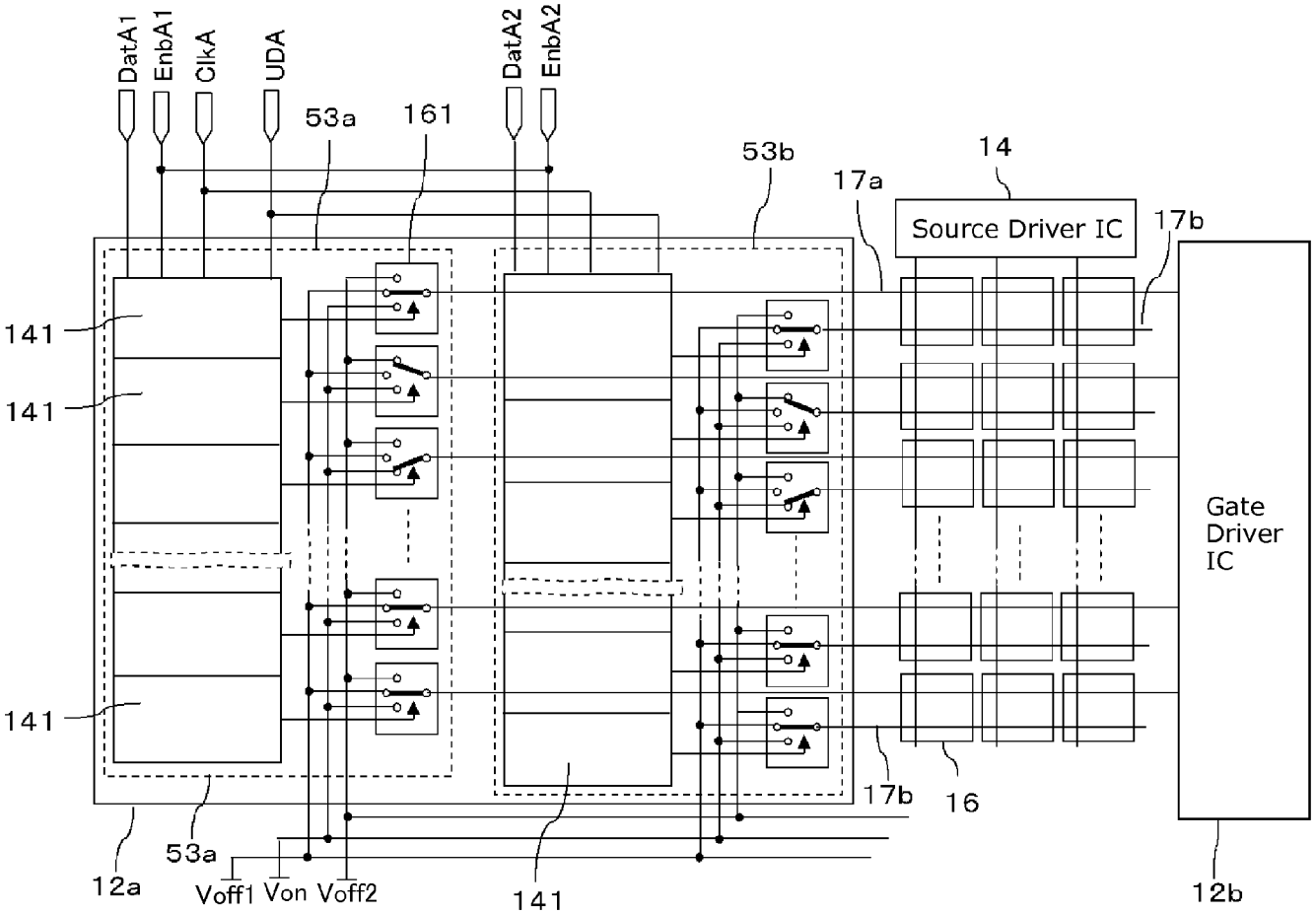
FIG. 27 is a diagram for explaining the EL display according to the embodiment.

FIG. 27 is a diagram illustrating the gate driver IC 12*a* in detail. The gate driver IC 12*b* is the same as the gate driver IC 12*a*.

The gate driver IC 12*a* includes switch circuits 161. The switch circuits 161 are intended to realize the three-value drive of gate voltages in each of FIGS. 21 and 20B, and the two-value drive of gate voltages in each of FIGS. 22B and 20A.

Each of the switch circuits 161 has functions of selecting a voltage from among a voltage Voff1, a voltage Voff2, a voltage Von, and outputting the selected voltage to a corresponding one of the gate signal lines 17.

Figure 28:
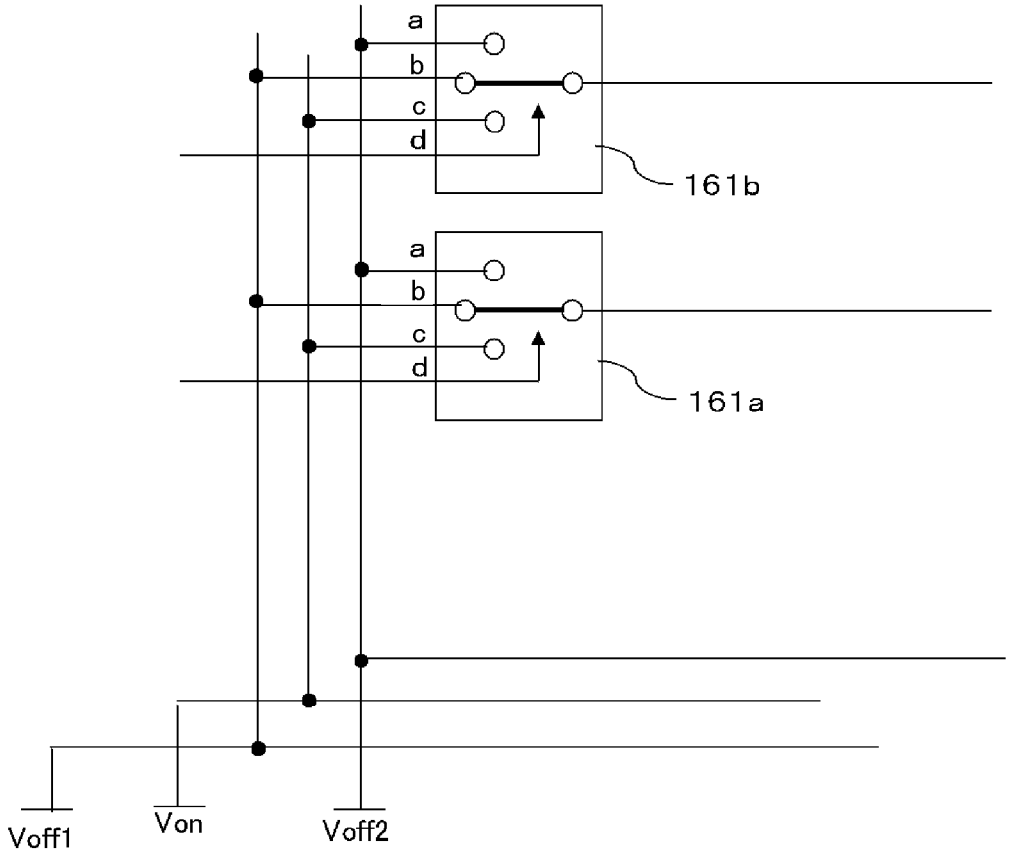
FIG. 28 is a diagram for explaining the EL display according to the embodiment.

As illustrated in FIG. 28, a voltage Voff2 is applied to a terminal of each of the switch circuits 161 (161*a*, 161*b*), and a voltage Voff1 is applied to a b terminal of the same, and a voltage Von is applied to a c terminal of the same. One of the Voff2, Voff1, and voltages Von is selected by a logic signal applied to a d terminal (2 bits). The logic signal of the d terminal is based on data (Dat) retained in each of the shift registers 51 (51*a*, 51*b*).

The three-value drive of gate voltages illustrated in FIG. 20B is realized by means of one of the switch circuits 161 switching outputs in the following listed order: from the voltage Von via the voltage Voff2 to the voltage Voff1. The two-value drive of gate voltages illustrated in FIG. 20A is realized by means of one of the switch circuits 161 switching outputs in the following listed order: from the voltage Von via the voltage Voff2 to the voltage Voff1.

Figure 29:
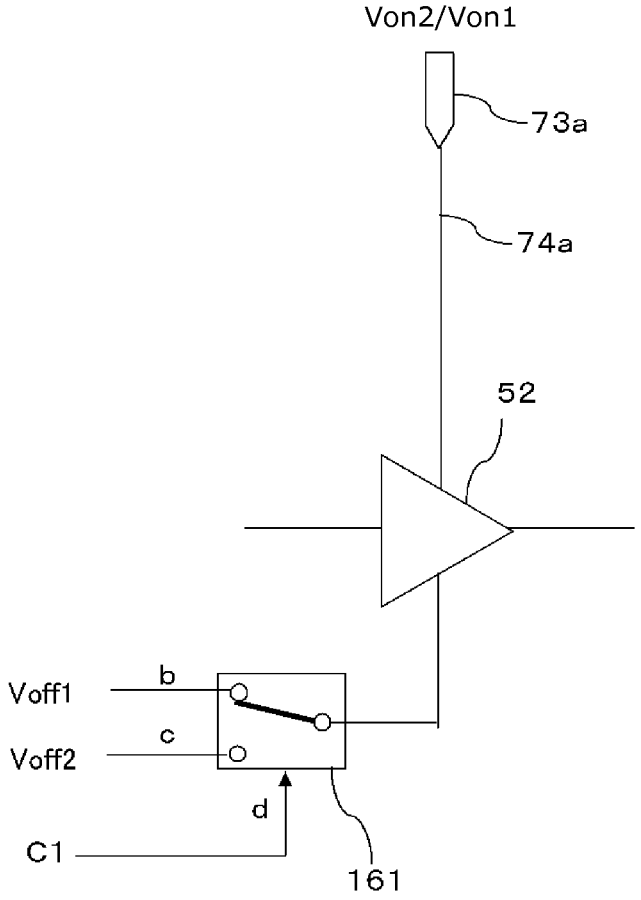
FIG. 29 is a diagram for explaining one of the gate driver ICs of the EL display according to the embodiment.

As illustrated in FIG. 29, an on voltage is applied to each of driver input terminals 73*a*. The plurality of driver input terminals 73*a* are gate signal output circuits 53 (53*a*, 53*b*) or output buffers 52 formed or configured in the gate driver ICs 12 (12*a*, 12*b*), and apply different voltages Von. These switch circuits 161 (161*a*, 161*b*) have been explained with reference to FIG. 28 etc., and thus the same explanation is not repeated.

As illustrated in FIG. 12, the two-value drive of gate voltages and the three-value drive of gate voltages are selected or set by logic signals to be applied to the SEL terminals. The SEL terminals are provided in each of gate signal output lines 53 (53*a*, 53*b*). The SEL terminals are set in a pull-down state in internal circuits of the gate driver ICs 12 (12*a*, 12*b*), and are set to the two-value drive of gate voltages in a default (the pull-down state). This is because the two-value drive of gate voltages consumes a smaller output voltage than the three-value drive of gate voltages, and has a lower risk of, for example, broking the gate driver ICs 12 (12*a*, 12*b*). By applying an H logic voltage to the SEL terminals, the gate signal output circuit 53 (53*a*, 53*b*) is set to the mode of a three-value drive of gate voltages.

The voltage Von, the voltage Voff1, the voltage Voff2 are input by external terminals of the gate driver ICs 12 (12*a*, 12*b*). In FIG. 12, the voltages Voff1 and Voff2 are illustrated as the ones shared by the gate signal output circuits 53 (53*a*, 53*b*). However, the present disclosure is not limited thereto. For example, terminals may be arranged in each of the gate signal output circuits 53 (53*a*, 53*b*) so that individual voltages Voff1 and Voff2 can be applied. The same applies to Von terminals.

The plurality of gate driver ICs 12 (12*a*, 12*b*) are mounted on a display panel. The voltage Von, voltage Voff1, and voltage Voff2 are applied in common to the plurality of gate driver ICs 12 (12*a*, 12*b*).

A voltage Von and a voltage Voff1 appropriate for each of gate signal lines 17 vary depending on a pixel circuit configuration. A requirement level for a Voff2 also varies. Accordingly, it is preferable that the voltage Von, voltage Voff1, and voltage Voff2 can be set independently according to the kind of each gate signal line 17.

For example, taking the pixel circuit in FIG. 5 as an example, it is preferable that the gate signal line 17*a*, the gate signal line 17*c*, the gate signal line 17*d* and the gate signal line 17*b* respectively have different and appropriate voltages Von. Normally, a voltage Von appropriate for the gate signal line 17*b* is higher than those of the other gate signal lines 17. This is because the voltage Von to be applied to the switch transistor 11*d* is made higher than the other so as to reduce an on resistance of the switch transistor 11*d*. In addition, it is preferable that the gate signal line 17*b* have an appropriate voltage Voff1 different from those of the gate signal line 17*a*, the gate signal line 17*c*, and the gate signal line 17*d*.

Normally, a voltage Voff1 appropriate for the gate signal line 17*b* is higher than those of the other gate signal lines 17 (17*a* to 17*d*). This is because the voltage Voff1 to be applied to the switch transistor 11*d* is made higher than the other so as to reduce an absolute value (Von−Voff1) of a voltage to be applied to the switch transistor 11*d*.

The switch transistor 11*b* performs a three-value drive of gate voltages, and the other switch transistors 11*d*, 11*c*, and 11*e* perform a two-value drive of gate voltages. Accordingly, the gate signal line 17*b* requires a voltage Voff2, but the other gate signals do not require any voltage Voff2. For this reason, as illustrated in FIG. 15, in the gate driver IC 12, each of gate signal output circuits 53 (53*a*, 53*b*) is configured to independently apply a voltage Von, a voltage Voff1, and a voltage Voff2. In addition, preferably, each of the gate signal output circuits 53 (53*a*, 53*b*) be configured to cause SEL terminals to independently set a three-value drive of gate voltages and a two-value drive of gate voltages.

A voltage Voff2 may be shared by the gate signal output circuits 53 (53*a*, 53*b*). This is because, in most cases, one of the gate signal lines 17 which requires a voltage Voff2 is identified by one of transistors 11 which applies a video signal.

A configuration in which a voltage Voff1 and a voltage Voff2 are shared by a plurality of signal output circuits 53 and voltages Von are independent is also provided here as an example. In addition, a configuration in which a voltage Von and a voltage Voff2 are shared by a plurality of signal output circuits 53 and a voltage Voff1 is independent is also provided here as another example.

Figure 30A:
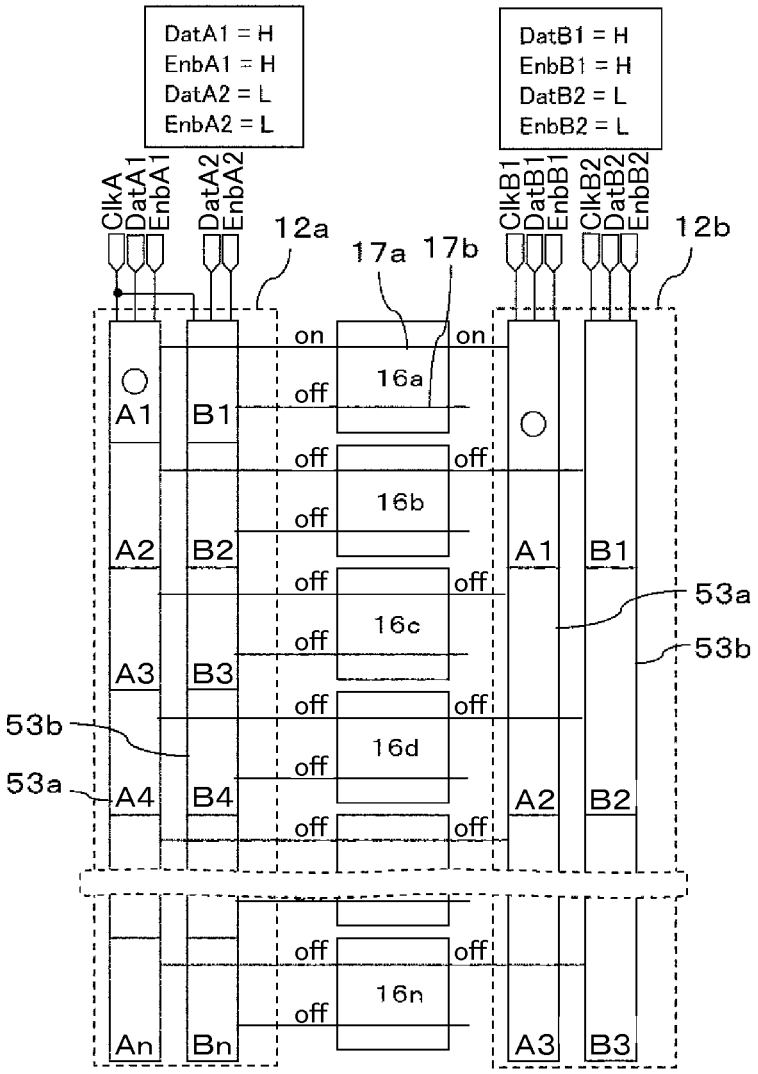
FIG. 30A is a diagram for explaining a method for driving an EL display according to an embodiment.
Figure 30B:
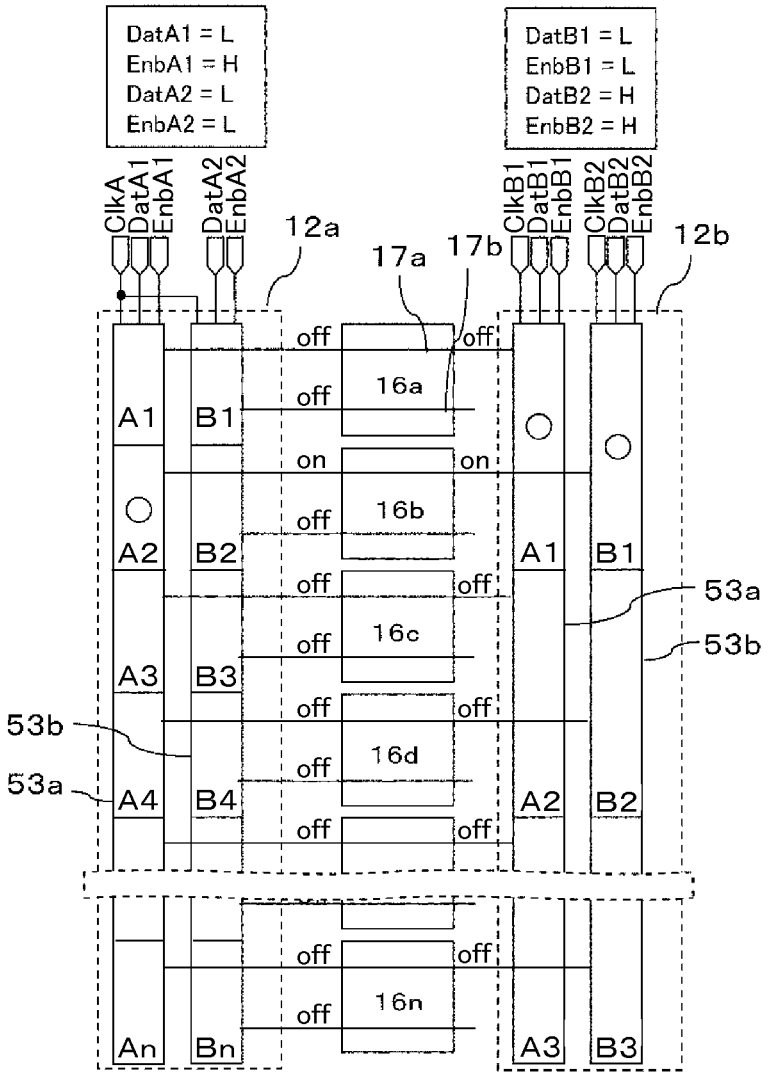
FIG. 30B is a diagram for explaining a method for driving the EL display according to the embodiment.

Each of FIGS. 30A and 30B is a diagram illustrating a method for driving an EL display (EL display panel) of the present disclosure. To facilitate understanding, descriptions are given assuming that two gate signal lines 17 (17*a*, 17*b*) pass through each of pixels 16, a gate signal line 17*a* is connected to switch transistors 11*b* which apply a video signal to the pixels 16 (16*a* to 16*n*), and is subject to a both-side drive, and a gate signal line 17*b* is subject to an one-side drive. Here, connection states and wire-connection states of terminals (DatA1, EnbA1 etc.) mounted on each of gate signal output circuits 53 (53*a*, 53*b*) of the gate driver IC 12 (12*a*, 12*b*) are examples. These terminals are described as external terminals for the gate driver ICs 12 (12*a*, 12*b*) below, but the present disclosure is not limited thereto. For example, these terminals may be wire-connected or connected inside the gate driver ICs 12 (12*a*, 12*b*).

In each of FIGS. 30A and 30B, the gate driver IC 12*a* drives the gate signal lines 17*a* and 17*b*. The gate driver IC 12*b* drives only the gate signal line 17*a*.

In each of FIGS. 30A and 30B, each of circle marks in blocks 141 indicates that data is retained in the block 141 (A1 to An, B1 to Bn) of the gate signal output circuits 53*a* and 53*b* with the circle mark, and an on voltage (voltage Von) is currently being output to the gate signal line 17*a* used by each block 141 with the circle mark. The following descriptions are given assuming that an off voltage (a voltage Voff1 or a voltage Voff2) is currently being output to each of the gate signal lines 17 (17*a*, 17*b*) passing through each of blocks 141 without any circle mark. An on voltage is output from each block 141 with the circle mark when "H" is set to an Enb terminal, but when "L" is set to the Enb terminal, an off voltage is output as an output voltage to a corresponding one of the gate signal lines 17 (17*a*, 17*b*) even from the block 141 with a circle mark.

In each of FIGS. 30A and 30B, a clock (Clk) terminal of the gate driver IC 12*a* is shared by the gate signal output circuits 53*a* and 53*b*. The gate signal output circuit 53*a* of the gate driver IC 12*b* is a ClkB1, and the gate signal output circuit 53*b* of the gate driver IC 12*b* is a ClkB2. In other words, the gate signal output circuit 53*a* and the gate signal output circuit 53*b* of the gate driver IC 12*b* operate according to different clocks. Alternatively, an identical clock is input to the gate signal output circuit 53*a* and the gate signal output circuit 53*b*, and the input clock is divided to a predetermined value in either the gate signal output circuit 53*b* or the gate driver IC 12*b*. Needless to say, the above matters are applicable to other embodiments in this DESCRIPTION.

In each of FIGS. 30A, 30B, etc., actions by the gate signal output circuit 53*b* of the gate driver IC 12*a* are not illustrated in order to facilitate understanding. With reference to each of FIGS. 30A, 30B, etc., the following descriptions are given focusing on applying an on voltage to the gate signal line 17*a* and shifting an on voltage position. Furthermore, the following descriptions are given also focusing on actions, control, drive methods, and configurations of (i) the gate signal output circuit 53*a* of the gate driver IC 12*a*, and (ii) the gate signal output circuit 53*a* and the gate signal output circuit 53*b* of the gate driver IC 12*b*.

Actions etc. of the gate signal output circuit 53*b* of the gate driver IC 12*a* are not explained. This is because actions or methods for driving the gate signal output circuit 53*b* are identical or similar to those of the gate signal output circuit 53*a* of the gate driver IC 12*a*. More specifically, this is because the method performed by the gate signal output circuit 53*a* of the gate driver IC 12*a* to select the gate signal line 17*a* or control an on voltage position is identical or similar in actions to the method performed by the gate signal output circuit 53*b* of the gate driver IC 12*a* to select the gate signal line 17*b* or control an on voltage position.

In each of FIGS. 30A, 30B, etc.: the position of data (with a circle mark) indicating the level of a voltage signal applied to the Clk (ClkA, ClkB1, ClkB2) terminal or a signal edge is shifted to another one of the blocks 141; or a voltage of a logic level assigned to the Clk terminal is input to the block 141.

To facilitate understanding or simplify the drawings, descriptions regarding a latch and a shift of data by the Clk (ClkA, ClkB1, ClkB2) terminal are not provided.

In each of FIGS. 30A and 30B, the "H" of each of Dat (DatA1, DatA2, DatB1, DatB2) terminals denotes a state in which data for outputting an on voltage to a corresponding one of the gate signal lines 17 (17*a*, 17*b*) is to be set or input, or has been input. The "L" of the Dat terminal denotes a state in which data for outputting an off voltage to the corresponding gate signal line 17 is to be set or input, or has been input. The "H" of the Enb terminal indicates a state in which an on voltage or an off voltage is output or to be output to the corresponding gate signal lines 17, based on the setting state of one or more of the blocks 141 (the block(s) 141 with the circle mark indicates that an on voltage is output to the corresponding gate signal lines 17, and each of the blocks 141 without any circle mark indicates that an off voltage is output to the corresponding gate signal lines 17). The "L" of each of the Enb (EnbA1, EnbA2, EnbB1, EnbB2) terminals indicates a state in which an off voltage is output or to be output to a corresponding one of the gate signal lines 17 (17*a*, 17*b*), irrespective of the setting state(s) of current one or more of the blocks 141 (the block(s) 141 with the circle mark indicates that an on voltage is output to the corresponding gate signal line 17, or each of the blocks 141 without any circle mark indicates that an off voltage is output to the corresponding gate signal line 17).

In each of FIGS. 30A and 30B, the DatA1 terminal and the EnbA1 terminal are connected to the gate signal output circuit 53*a* of the gate driver IC 12*a*, and the ClkA terminal is connected in common to the gate signal output circuit 53*b*. The DatA2 terminal and the EnbA2 terminal are connected to the gate signal output circuit 53*b*. In addition, the DatB1 terminal, the EnbB1 terminal, and the ClkB1 terminal are connected to the gate signal output circuit 53*a* of the gate driver IC 12*b*, and the DatB2 terminal, the EnbB2 terminal, and the ClkB2 terminal are connected to the gate signal output circuit 53*b* of the gate driver IC 12*b*.

In FIG. 30A, in the gate driver IC 12*a*, the DatA1 terminal is set to "H", the EnbA1 terminal is set to "H", the DatA2 terminal is set to "L", and the EnbA2 terminal is set to "L".

The DatA2 terminal of the gate driver IC 12*a* is set to "L" because actions regarding control of the gate signal lines 17*b* are not explained in order to facilitate understanding. The DatA2 terminal is, of course, set to "H" or "L" and the EnbA2 terminal is set to "H" or "L" since on and off control is performed for the gate signal lines 17*b* of the gate driver IC 12*a* in the method for driving the EL display (EL display panel) in the actual disclosure herein.

In FIG. 30A, in the gate driver IC 12*a*, the DatA1 terminal is set to "H", the EnbA1 terminal is set to "H", the DatA2 terminal is set to "L", and the EnbA2 terminal is set to "L". Triggered by an input of the ClkA terminal, on data (with a circle mark) is input to the block (A1) of the blocks 141 of the gate signal output circuit 53*a* of the gate driver IC 12*a*. Since the EnbA1 terminal of the gate signal output circuit 53*a* of the gate driver IC 12*a* is set to "H", an on voltage is output to the gate signal line 17*a* passing through the pixel 16*a*. Accordingly, a video signal applied to a source signal line (not illustrated) is applied to the pixel 16*a*.

Likewise, in the gate driver IC 12*b*, the DatB1 terminal is set to "H" and the EnbB1 terminal is set to "H". Triggered by an input of the ClkB1 terminal, on data (with a circle mark) is input to the block 141 (A1) of the gate signal output circuit 53*a* of the gate driver IC 12*b*. Since the EnbB1 terminal of the gate signal output circuit 53*a* of the gate driver IC 12*b* is set to "H", an on voltage is output to the gate signal line 17*a* passing through the pixel 16*a*.

With the settings or control states, the gate signal line 17*a* passing through the pixel 16*a* is subject to a both-side drive by the gate signal output circuit 53*a* of the gate driver IC 12*a* and the gate signal output circuit 53*a* of the gate driver IC 12*b*.

The DatB2 terminal is set to "L" and the EnbB2 terminal is set to "L" in the gate driver IC 12*b*, and thus, triggered by the input of the ClkB2 terminal, off data (without a circle mark) is input to the block (B1) of the blocks 141 of the gate signal output circuit 53*b* of the gate driver IC 12*b*. Since the EnbB2 terminal of the gate signal output circuit 53*b* of the gate driver IC 12*b* is set to "L", an off voltage is output to the gate signal line 17*a* passing through the pixels 16*b*. In this case, an off voltage is output to the gate signal line 17*a* of the pixel 16*b* because off data (without a circle mark) is retained in the block 141 (B1) of the gate signal output circuit 53*b* of the gate driver IC 12*b* even when the EnbB2 terminal of the gate signal output circuit 53*b* of the gate driver IC 12*b* is set to "H".

In other words, voltages (an on voltage and an off voltage) to be output to the gate signal line 17*a* of the gate driver IC 12*b* can be controlled using data latched or retained in the block 141. In addition, such control can also be performed by logic setting of the EnbB2 terminal. Accordingly, needless to say, any of these methods is possible in the method for driving the EL display (EL display panel) of the present disclosure.

With the actions and control, in FIG. 30A, a both-side drive is performed on the gate signal line 17*a* passing through the pixels 16*a*, and an off voltage is applied to the gate signal lines 17*a* passing through the other pixels 16. Needless to say, it is only necessary that an on or off voltage may be applied to the gate signal line 17*b* by the gate signal output circuit 53*b* of the gate driver IC 12*a* as necessary.

In FIG. 30B, in the gate driver IC 12*a*, the DatA1 terminal is set to "L", the EnbA1 terminal is set to "H", the DatA2 terminal is set to "L", and the EnbA2 terminal is set to "L". Triggered by an input of the ClkA terminal, off data (without a circle mark) is input to the block 141 (A1) of the gate signal output circuit 53*a* of the gate driver IC 12*a*. The on data (with a circle mark) of the block (A1) is transferred (shifted) to the block (A2) of the blocks 141.

Since the EnbA1 terminal of the gate signal output circuit 53*a* of the gate driver IC 12*a* is set to "H", an off voltage is output to the gate signal line 17*a* passing through the pixels 16*a*, and an on voltage is output to the gate signal line 17*a* passing through the pixels 16*b*. Accordingly, a video signal applied to a source signal line (not illustrated) is applied to the pixels 16*b*. The video signal firstly applied to the pixels 16*a* is retained.

Likewise, in the gate driver IC 12*b*, the DatB2 terminal is set to "H" and the EnbB2 terminal is set to "H". Triggered by an input of the ClkB2 terminal, on data (with a circle mark) is input to the block 141 (B1) of the gate signal output circuit 53*b* of the gate driver IC 12*b*. Since the EnbB2 terminal of the gate signal output circuit 53*b* of the gate driver IC 12*b* is set to "H", an on voltage is output to the gate signal line 17*a* of the pixels 16*b*.

With the settings or control states, the gate signal line 17*a* passing through the pixels 16*b* is subject to a both-side drive by the gate signal output circuit 53*a* of the gate driver IC 12*a* and the gate signal output circuit 53*b* of the gate driver IC 12*b*.

In FIG. 30B, no clock is input to the ClkB1 terminal of the gate driver IC 12*b*. Accordingly, the data retained in the block 141 (A1) of the gate signal output circuit 53*a* of the gate driver IC 12*b* is not transferred to the block 141 (A2). Since the EnbB1 terminal is set to "L", an off voltage is applied to the gate signal line 17*a* passing through the pixels 16*a*.

With the actions and control, in FIG. 30B, the gate signal 17*a* passing through the pixels 16*b* is subject to a both-side drive, and an off voltage is applied to the gate signal lines 17*a* passing through the other pixels 16 (16*c*, 16*d*, . . . 16*n*). Needless to say, it is only necessary that an on or off voltage may be applied to the gate signal line 17*b* by the gate signal output circuit 53*b* of the gate driver IC 12*a* as necessary.

Figure 31A:
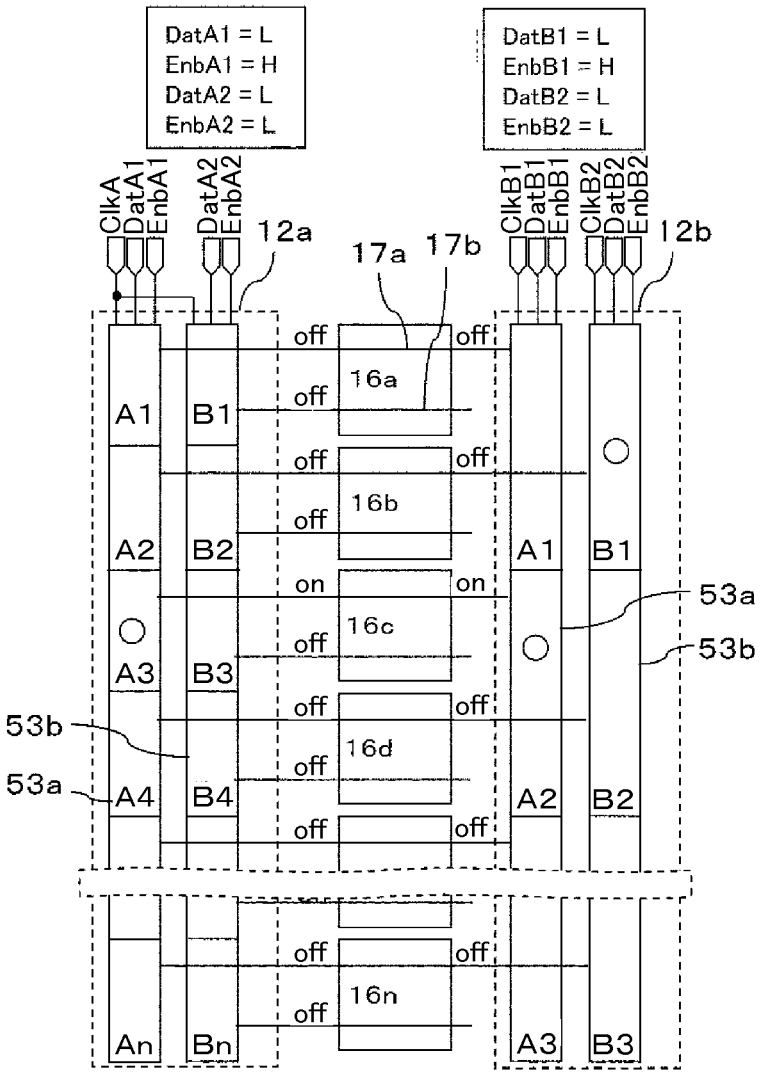
FIG. 31A is a diagram for explaining a method for driving the EL display according to the embodiment.
Figure 31B:
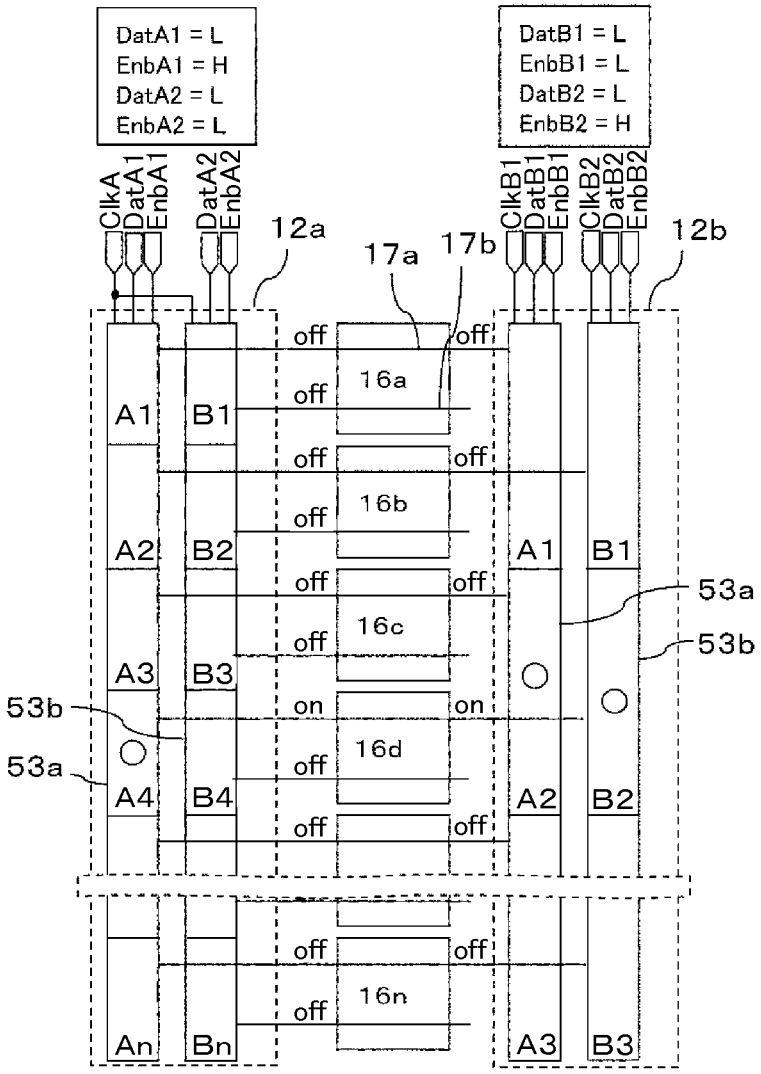
FIG. 31B is a diagram for explaining a method for driving the EL display according to the embodiment.

FIGS. 31A and 31B illustrate control similar to control illustrated in FIGS. 30A and 30B.

In FIG. 31A, in the gate driver IC 12*a*, the DatA1 terminal is set to "L", the EnbA1 terminal is set to "H", the DatA2 terminal is set to "L", and the EnbA2 terminal is set to "L". Triggered by an input of the ClkA terminal, off data (without a circle mark) is input to the block 141 (A1) of the gate signal output circuit 53*a* of the gate driver IC 12*a*. Since the EnbA1 terminal of the gate signal output circuit 53*a* of the gate driver IC 12*a* is set to "H", an off voltage is output to the gate signal line 17*a* passing through the pixels 16*a*, as a result of reflection of the data state in the block 141 (A1). In addition, triggered by the input of the ClkA terminal, data of the block 141 (A2) is transferred to the block (A3) of the blocks 141. An on voltage is output to the gate signal line 17*a* passing through the pixels 16*c*, and a video signal applied to a source signal line (not illustrated) is applied to the pixels 16*c*.

Likewise, in the gate driver IC 12*b*, the DatB1 terminal is set to "L" and the EnbB1 terminal is set to "H". Triggered by an input of the ClkB1 terminal, off data (without a circle mark) is input to the block 141 (A1) of the gate signal output circuit 53*a* of the gate driver IC 12*b*. The data of the block 141 (A1) of the gate signal output circuit 53*a* of the gate driver IC 12*b* is transferred to the block 141 (A2). Since the EnbB1 terminal of the gate signal output circuit 53*a* of the gate driver IC 12*b* is set to "H", an off voltage is output to the gate signal line 17*a* of the pixel 16*a*, and an on voltage is output to the gate signal line 17*a* passing through the pixels 16*c*.

With the settings or control states, the gate signal line 17*a* passing through the pixels 16*c* is subject to a both-side drive by the gate signal output circuit 53*a* of the gate driver IC 12*a* and the gate signal output circuit 53*a* of the gate driver IC 12*b*.

Since the DatB2 terminal is set to "L" and the EnbB2 terminal is set to "L" in the gate driver IC 12*b* and there is no input to the ClkB2 terminal, data of the gate signal output circuit 53*b* of the gate driver IC 12*b* is not shifted. Accordingly, the data retained in the block 141 (B1) of the gate signal output circuit 53*b* of the gate driver IC 12*b* is not transferred to the block 141 (B2). Since the EnbB1 terminal is set to "L", an off voltage is applied to the gate signal line 17*a* passing through the pixel 16*b*.

With the settings or control states, the gate signal line 17*a* passing through the pixels 16*c* is subject to a both-side drive by the gate signal output circuit 53*a* of the gate driver IC 12*a* and the gate signal output circuit 53*a* of the gate driver IC 12*b*.

With the actions and control, in FIG. 31A, a both-side drive is performed on the gate signal line 17*a* passing through the pixels 16*c*, and an off voltage is applied to the gate signal lines 17*a* of the other pixels. Needless to say, it is only necessary that an on or off voltage may be applied to the gate signal line 17*b* by the gate signal output circuit 53*b* of the gate driver IC 12*a* as necessary.

In FIG. 31B, in the gate driver IC 12*a*, the DatA1 terminal is set to "L", the EnbA1 terminal is set to "H", the DatA2 terminal is set to "L", and the EnbA2 terminal is set to "L". Triggered by an input of the ClkA terminal, off data (without a circle mark) is input to the block 141 (A1) of the gate signal output circuit 53*a* of the gate driver IC 12*a*. Since the EnbA1 terminal of the gate signal output circuit 53*a* of the gate driver IC 12*a* is set to "H", an off voltage is output to the gate signal line 17*a* of the pixel 16*a*, as a result of reflection of the data state in the block 141 (A1). In addition, triggered by an input of the ClkA terminal, data of the block 141 (A3) is transferred to the block 141 (A4). An on voltage is output to the gate signal line 17*a* passing through the pixels 16*d*, and a video signal applied to a source signal line 18 (not illustrated) is applied to the pixels 16*d*.

Likewise, in the gate driver IC 12*b*, the DatB2 terminal is set to "L" and the EnbB2 terminal is set to "H". Triggered by an input of the ClkB2 terminal, off data (without a circle mark) is input to the block 141 (B1) of the gate signal output circuit 53*a* of the gate driver IC 12*b*. The data of the block 141 (B1) of the gate signal output circuit 53*a* of the gate driver IC 12*b* is transferred to the block 141 (B2). Since the EnbB1 terminal of the gate signal output circuit 53*b* of the gate driver IC 12*b* is set to "H", an off voltage is output to the gate signal line 17*a* passing through the pixels 16*b*, and an on voltage is output to the gate signal line 17*a* of the pixels 16*d*.

With the settings or control states, the gate signal line 17*a* passing through the pixels 16*d* is subject to a both-side drive by the gate signal output circuit 53*a* of the gate driver IC 12*a* and the gate signal output circuit 53*b* of the gate driver IC 12*b*.

Since the DatB2 terminal is set to "L" and the EnbB2 terminal is set to "L" in the gate driver IC 12*a* and there is no input to the ClkB1 terminal, data of the gate signal output circuit 53*a* of the gate driver IC 12*b* is not shifted. Accordingly, the data retained in the block 141 (A1) of the gate signal output circuit 53*a* of the gate driver IC 12*b* is not transferred to the block 141 (A2). Since the EnbB1 terminal is set to "L", an off voltage is applied to the gate signal line 17*a* passing through the pixels 16*c*.

With the settings or control states, the gate signal line 17*a* passing through the pixels 16*d* is subject to a both-side drive by the gate signal output circuit 53*a* of the gate driver IC 12*a* and the gate signal output circuit 53*b* of the gate driver IC 12*b*.

With the actions and control, in FIG. 31B, a both-side drive is performed on the gate signal line 17*a* passing through the pixels 16*c*, and an off voltage is applied to the gate signal lines 17*a* passing through the other pixels 16*c*. Needless to say, it is only necessary that an on or off voltage may be applied to the gate signal line 17*b* by the gate signal output circuit 53*b* of the gate driver IC 12*a* as necessary.

As described above, the gate signal line 17*a* passing through the pixel 16*c* is subject to the both-side drive by means that: the gate driver IC 12*a* shifting the data positions of the gate signal output circuits 53*a* and 53*b* in synchronization with the ClkA terminal; and the gate driver IC 12*b* controlling the gate signal output circuits 53*a* and 53*b* according to different clocks (ClkB1, ClkB2) alternately or independently and controlling the EnbB1 terminal and the EnbB2 terminal alternately or independently.

In this embodiment, the clock ClkB1 of the gate signal output circuit 53*a* and the clock ClkB2 of the gate signal output circuit 53*b* of the gate driver IC 12*b* are caused to act alternately, and the data positions (with and without a circle mark) in the blocks 141 are shifted. However, the present disclosure is not limited thereto.

For example, in each of FIGS. 31A and 30B, a circle mark is present in each of the block 141 (A2) of the gate signal output circuit 53*a* and the block 141 (B1) of the gate signal output circuit 53*b*. When the clocks ClkB1 and ClkB2 are input to the gate signal output circuits 53*a* and 53*b* at the same time, the positions of circle marks are shifted to the positions of blocks 141 illustrated in FIG. 31B. In other words, the positions of the circle marks are shifted to the position of the block 141 (A2) in the gate signal output circuit 53*a* and the position of the block 141 (B2) of the gate signal output circuit 53*b*.

When the enable terminal EnbB1 of the gate signal output circuit 53*a* is set to "H" and the enable terminal EnbB2 of the gate signal output circuit 53*b* is set to "L" in the state of FIG. 31B, an on voltage is applied to the gate signal line 17*a* passing through the pixels 16*c* and an off voltage is applied to the gate signal line 17*a* passing through the pixels 16*d*. At this time, when the gate driver IC 12*a* applies an on voltage to the gate signal line 17*a* of the pixels 16*c*, the gate signal line 17*a* passing through the pixels 16*c* is subject to a both-side drive. When the enable terminal EnbB1 of the gate signal output circuit 53*a* is set to "L" and the enable terminal EnbB2 of the gate signal output circuit 53*b* is set to "H" in the sate of FIG. 31B, an on voltage is applied to the gate signal line 17*a* passing through the pixels 16*d* and an off voltage is applied to the gate signal line 17*a* passing through the pixels 16*a*. At this time, when the gate driver IC 12*a* applies an on voltage to the gate signal line 17*a* of the pixels 16*d*, the gate signal line 17*a* passing through the pixels 16*d* is subject to a both-side drive.

As described above, the drive methods of the present disclosure can of course be performed also by, for example, controlling the gate driver IC 12*a* and the gate driver IC 12*b*, or controlling the gate signal output circuit 53*a* and the gate signal output circuit 53*b* of each of the gate driver ICs 12. These matters apply also to control of the gate signal line 17*b*. Needless to say, these are also applicable in other embodiments of the present disclosure.

The above embodiment describes a case where a single mark is provided to some of blocks 141 of each of the gate signal output circuits 53 (53*a*, 53*b*). However, the present disclosure is not limited thereto. Data (with or without a circle mark) input to each of shift registers 51 (51*a*, 51*b*) inside the gate signal output circuits 53 (53*a*, 53*b*) is made through the clock terminals (Clk) and the data terminals (Dat). Accordingly, it is only necessary to control or operate the data terminals and the clock terminals in order to input data to shift registers 51 (51*a*, 51*b*) etc. Accordingly, consecutive data items with a circle mark can be input to the shift registers 51, and discrete data items with a circle mark can be serially input to the shift registers 51 (51*a*, 51*b*).

Figure 32A:
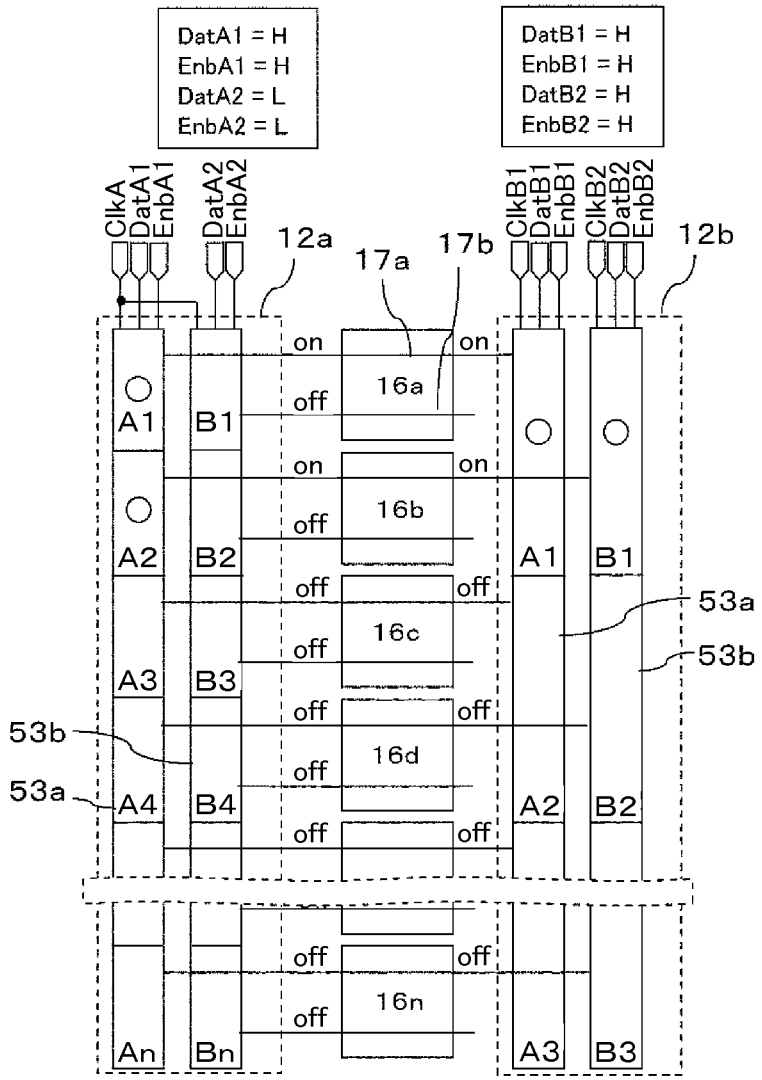
FIG. 32A is a diagram for explaining a method for driving the EL display according to the embodiment.
Figure 32B:
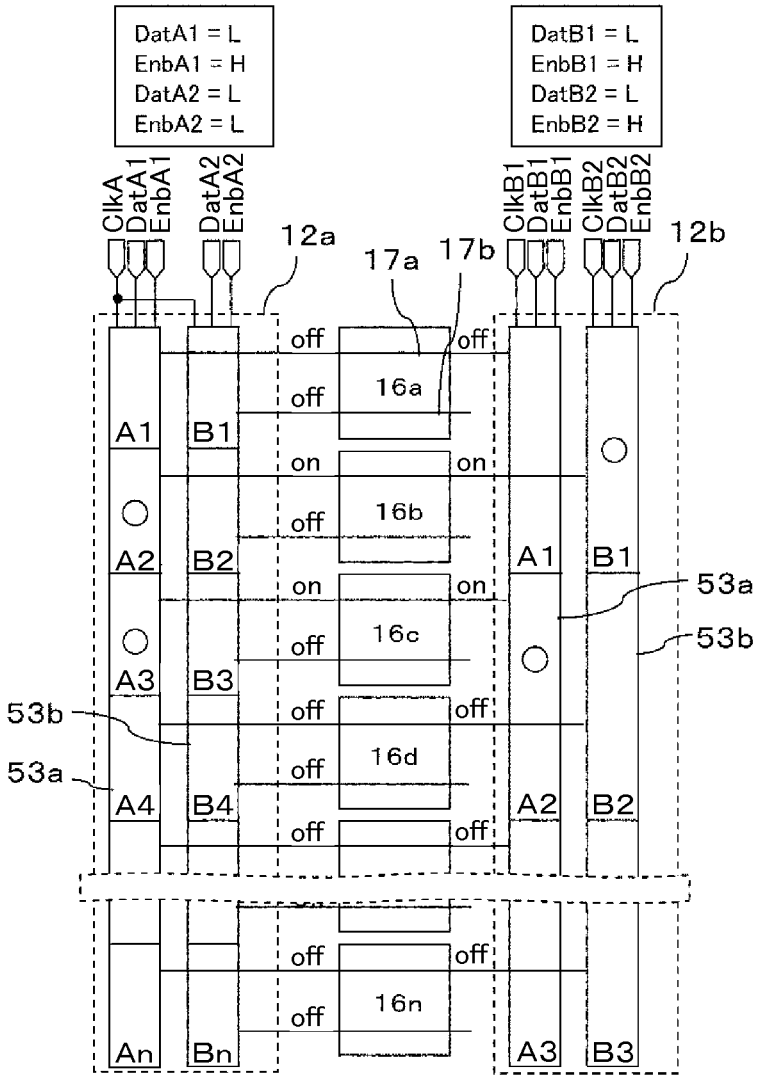
FIG. 32B is a diagram for explaining a method for driving the EL display according to the embodiment.

Each of FIGS. 32A and 32B illustrates an embodiment in which consecutive data items with a circle mark are input to either the gate signal output circuits 53 (53*a*, 53*b*) or the shift registers 51 (51*a*, 51*b*).

This embodiment of the present disclosure is given focusing on an example of consecutive data items with a circle mark, as illustrated for the purpose of facilitating understanding. In reality, not to mention, data items without a circle mark are retained in blocks 141 other than blocks 141 with a circle mark in the shift register 51.

In FIG. 32A, the gate driver IC 12*a* is in a state where the DatA1 terminal is set to "H", and a clock is input to the ClkA terminal twice (no description regarding the gate signal output circuit 53*b* of the gate driver IC 12*a* is provided here). Accordingly, a circle mark (an on voltage position) is retained in each of the blocks 141 (A1, A2) of the gate signal output circuit 53*a* of the gate driver IC 12*a*. By setting the EnbA1 terminal of the gate signal output circuit 53*a* of the gate driver IC 12*a* to "H", an on voltage is applied (output) to each of the gate signal lines 17*a* each passing through the pixel 16*a* or the pixel 16*b*.

On the other hand, by applying an "H" logic to the DatB1 and DatB2 terminals of the gate driver IC 12*b* and inputting a clock signal to the ClkB1 and ClkB2 terminals once, a circle mark position (on voltage position) is retained in the block 141 (A1) of the gate signal output circuit 53*a* and the block 141 (B1) of the gate signal output circuit 53*b* of the gate driver IC 12*b*. By setting the EnbB1 terminal and the EnbB2 terminal of the gate signal output circuit 53*a* of the gate driver IC 12*b* to "H", an on voltage is applied (output) to each of the gate signal lines 17*a* each passing through the pixels 16*a* or the pixels 16*b*. The EnbA1 terminal of the gate driver IC 12*a* is set to With the settings or control states, each of the gate signal lines 17*a* each passing through the pixels 16*a* or the pixels 16*b* is subject to a both-side drive by the gate signal output circuit 53*a* of the gate driver IC 12*a* and the gate signal output circuits 53*a* and 53*b* of the gate driver IC 12*b*.

FIG. 32B illustrates a state created by setting the DatA1 terminal of the gate signal output circuit 53*a* of the gate driver IC 12*a* to "L", and inputting a clock to the ClkA terminal once in the state of FIG. 32A. The circle mark positions of the gate signal output circuit 53*a* are shifted by one block 141 from the positions in FIG. 32A to the positions of blocks 141 (A2, A3). The state is a state in which the DatB1 and DatB2 terminals of the gate signal output circuit 53*a* of the gate driver IC 12*b* are set to "L", and a clock is input to the ClkB1 terminal once. The circle mark position of the gate signal output circuit 53*a* of the gate driver IC 12*b* is shifted by one block from the position in FIG. 32A to the position of the block 141 (A2). It is to be noted that no clock is input to the ClkB2 terminal in the gate signal output circuit 53*b* of the gate driver IC 12*b*, and thus the circle mark position remains at the block 141 (B1). The EnbB1 and EnbB2 terminals of the gate driver IC 12*b* are set to "H".

With the settings or control states, the gate signal lines 17*a* each passing through the pixels 16*b* or the pixels 16*c* are subject to a both-side drive by the gate signal output circuit 53*a* of the gate driver IC 12*a* and the gate signal output circuits 53*a* and 53*b* of the gate driver IC 12*b*. Accordingly, compared to FIG. 32A, the on voltage position to the gate signal line 17*a* is shifted by one pixel in FIG. 32B.

Figure 33A:
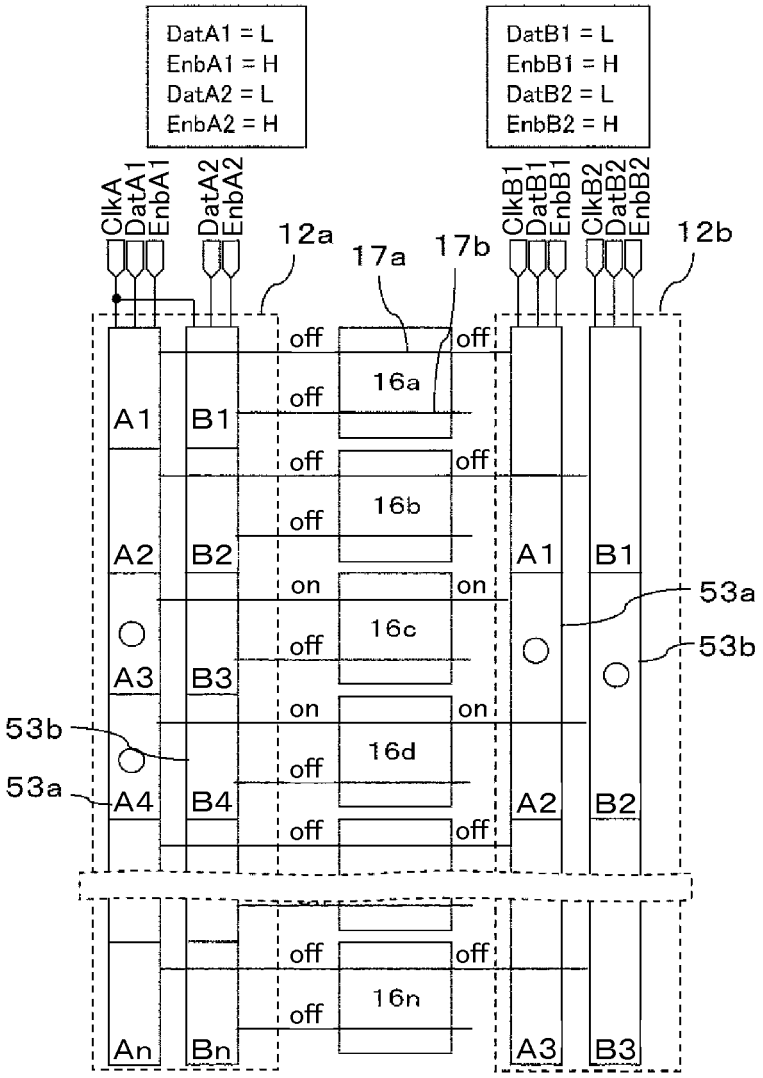
FIG. 33A is a diagram for explaining a method for driving the EL display according to the embodiment.

FIG. 33A illustrates a state created by setting the DatA1 terminal of the gate signal output circuit 53*a* of the gate driver IC 12*a* to "L", and inputting a clock to the ClkA terminal once in the state of FIG. 32B. The circle mark positions in the gate signal output circuit 53*a* are shifted by one block 141 to positions of the blocks 141 (A3, A4). The state is a state in which DatB1 and DatB2 terminals of the gate signal output circuit 53*a* of the gate driver IC 12*b* are set to "L", and a clock is input to the ClkB2 terminal once. One of the circle mark positions in the gate signal output circuit 53*b* of the gate driver IC 12*b* is shifted by one block to the position of the block 141 (B2). Accordingly, the circle mark positions of the gate driver IC 12*b* are the blocks 141 (A2, B2). The EnbB1 and EnbB2 terminals of the gate driver IC 12*b* are set to "H".

With the settings or control states, the gate signal lines 17*a* each passing through the pixels 16*c* or the pixels 16*d* are subject to a both-side drive by the gate signal output circuit 53*a* of the gate driver IC 12*a* and the gate signal output circuits 53*a* and 53*b* of the gate driver IC 12*b*. Accordingly, compared to FIG. 32B, the on voltage position to the gate signal line 17*a* is shifted by one pixel in FIG. 33A.

Figure 33B:
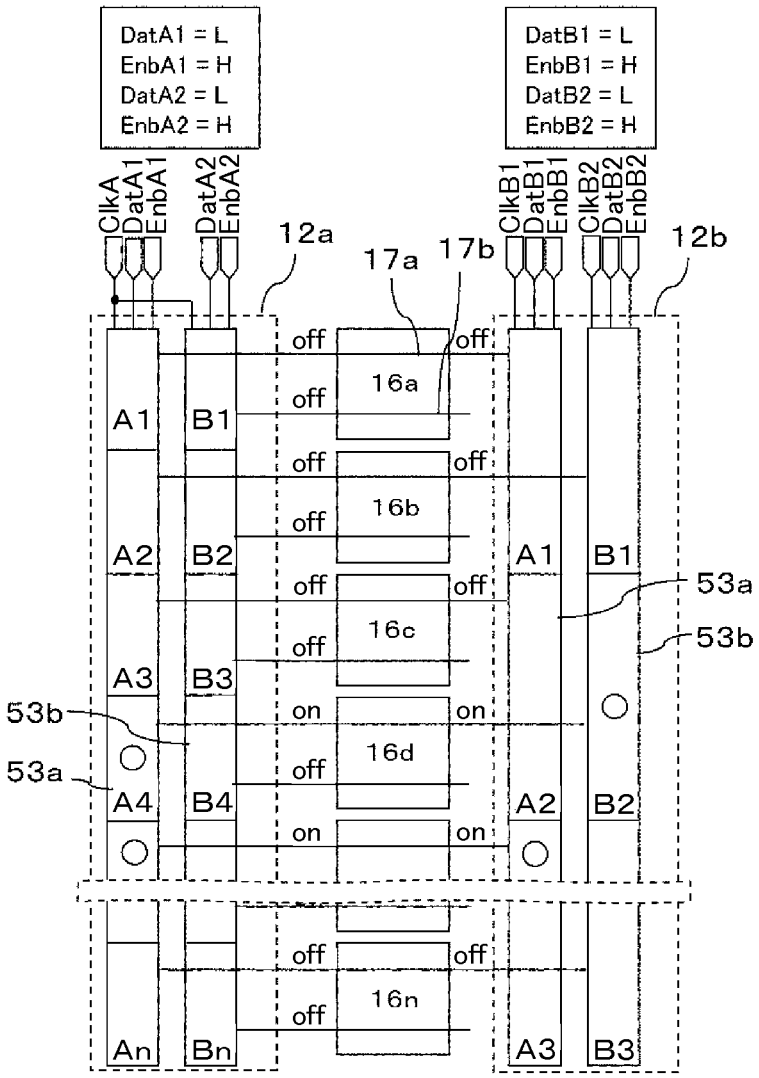
FIG. 33B is a diagram for explaining a method for driving the EL display according to the embodiment.

FIG. 33B illustrates a state created by setting the DatA1 terminal of the gate signal output circuit 53*a* of the gate driver IC 12*a* to "L", and inputting a clock to the ClkA terminal once in the state of FIG. 33A. The circle mark positions of the gate signal output circuit 53*a* are shifted by one block 141 from the positions in FIG. 33A to the positions of the blocks (A4, A5). The state is a state in which the DatB1 and DatB2 terminals of the gate signal output circuit 53*a* of the gate driver IC 12*b* are set to "L", and a clock is input to the ClkB1 terminal once. One of the circle mark positions of the gate signal output circuit 53*a* of the gate driver IC 12*b* is shifted by one block from the position in FIG. 32A to the position of the block 141 (A3). Accordingly, the circle mark positions of the gate driver IC 12*b* are the blocks 141 (A3, B2). The EnbB1 and EnbB2 of the gate driver IC 12*b* are set to "H".

With the settings or control states, the gate signal lines 17*a* each passing through the pixels 16*d* or the pixels 16*e* are subject to a both-side drive by the gate signal output circuit 53*a* of the gate driver IC 12*a* and the gate signal output circuits 53*a* and 53*b* of the gate driver IC 12*b*. Accordingly, compared to FIG. 33A, the on voltage position to the gate signal line 17*a* is shifted by one pixel in FIG. 33B.

As described above, the consecutive circle mark positions are sequentially shifted to the positions of blocks 141 of the shift registers 51. With reference to FIGS. 32A, 32B, 33A, and 33B, descriptions are given assuming that both of the gate driver IC 12*a* and the gate driver IC 12*b* perform control or operate when the circle mark positions are consecutive. However, needless to say, the present disclosure is not limited thereto. Circle mark positions may be discrete at one of the sides of the gate driver IC 12*a* and the gate driver IC 12*b*, and/or three or more circle mark positions may be consecutive.

Figure 34A:
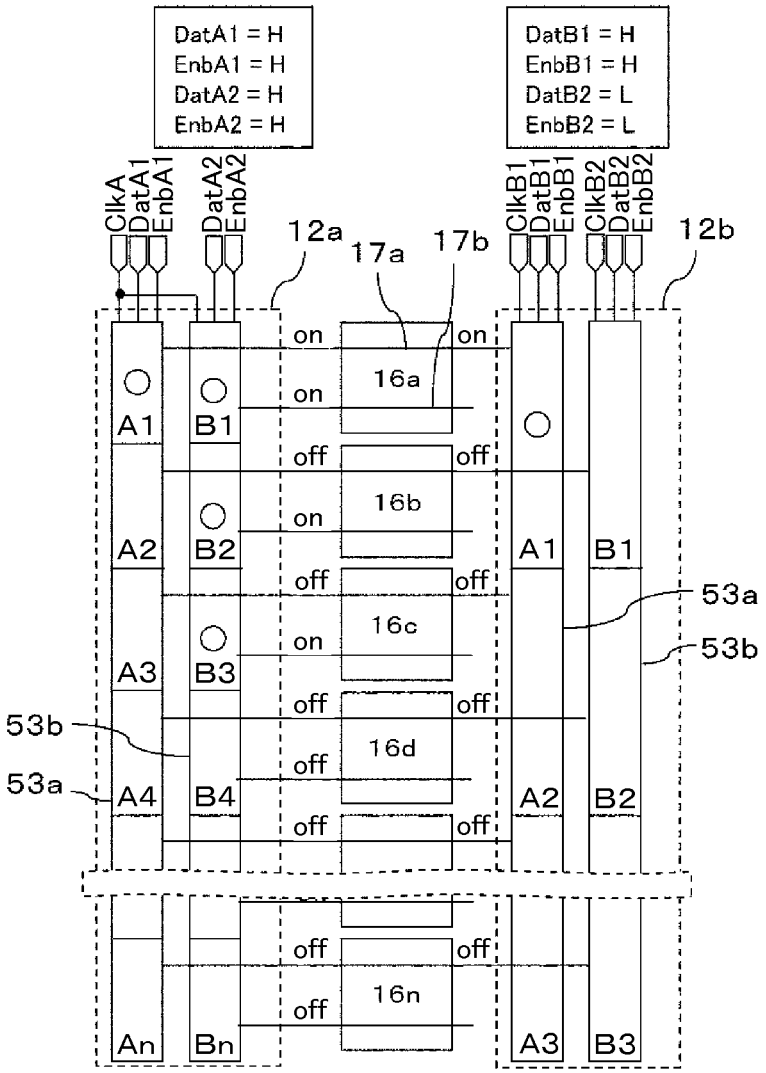
FIG. 34A is a diagram for explaining a method for driving the EL display according to the embodiment.
Figure 34B:
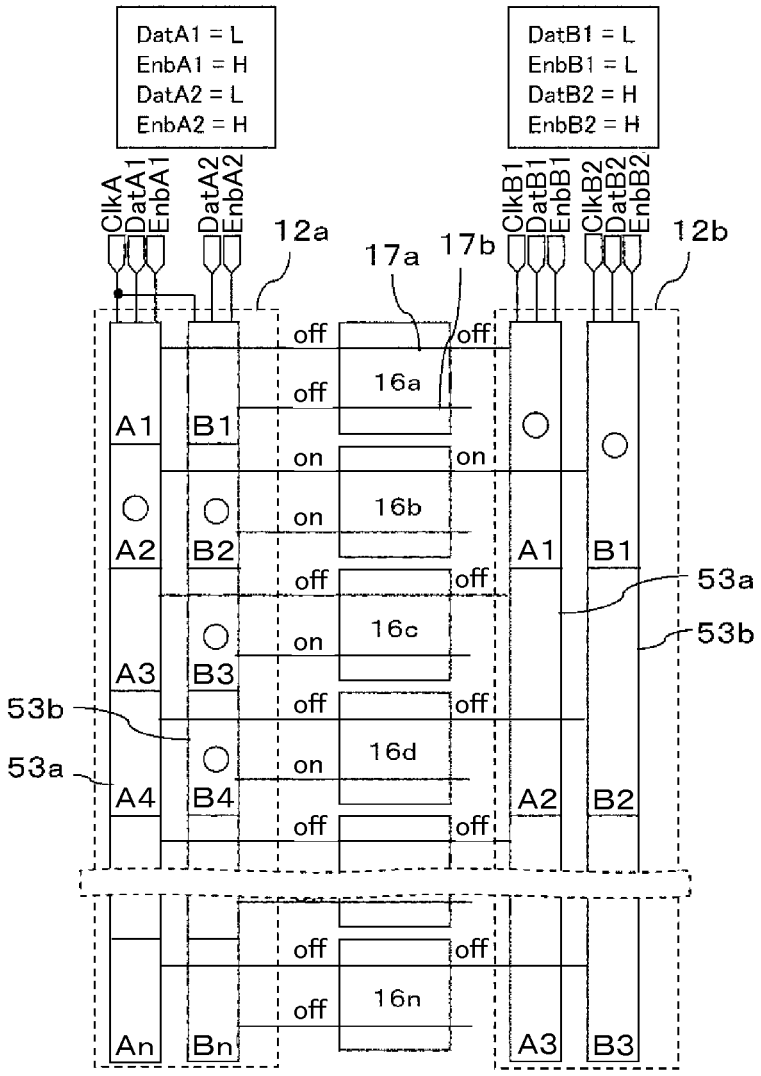
FIG. 34B is a diagram for explaining a method for driving the EL display according to the embodiment.

Each of FIGS. 34A and 34B is a diagram illustrating control or an operation of the gate signal output circuit 53*b* of the gate driver IC 12*a*. The actions or operations of the gate driver IC 12*b* are identical or similar to the actions described earlier, and thus is not described here.

FIG. 34A illustrates a state in which the DatA2 terminal of the gate signal output circuit 53*b* of the gate driver IC 12*a* is set to "H", and a clock is input to the ClkA terminal three times. When data items (with a circle mark) are input to the gate signal output circuit 53*b*, and circle mark positions in some of the blocks 141 are shifted to the positions of the blocks 141 (B1, B2, B3). FIG. 34A illustrates a state in which the DatA1 terminal of the gate signal output circuit 53*a* of the gate driver IC 12*a* is set to "H", and a clock is input to the ClkA terminal once. The EnbA1 and EnbA1 terminals of the gate driver IC 12*a* are set to "H".

In the above settings and control states, an on voltage is output to the gate signal lines 17*b* each passing through the pixels 16*a*, 16*b*, or 16*c*. In addition, an on voltage is output to the gate signal line 17*a* passing through the pixels 16*a*. Accordingly, the gate signal line 17*a* passing through the pixels 16*a* is subject to a both-side drive, and the gate signal lines 17*b* each passing through the pixels 16*a*, 16*b*, or 16*c* are subject to a one-side drive. In the pixel configuration in FIG. 50, the switch transistor 11*d* are connected to the gate signal line 17*b*, and controls a current that the driver transistors 11*a* flow into EL elements 15. Accordingly, an on voltage applied to the gate signal line 17*b* switches on the switch transistors 11*d* so that the EL elements 15 receive supply of the current and turn on. On the other hand, the EL elements 15 do not receive supply of a current when the switch transistors 11*d* are off, and are in an off state.

With the above actions or operations, it is possible to turn on or off an arbitrary pixel row of the EL display (EL display panel) by controlling or operating the gate signal output circuit 53*b* of the gate driver IC 12*a*. In addition, a duty drive can be performed by switching-on positions. Needless to say, the above embodiments are also applicable to other embodiments in the present disclosure. In addition, the above embodiments can be combined with other embodiments.

FIG. 34B illustrates a state in which the DatA2 terminal of the gate signal output circuit 53*b* of the gate driver IC 12*a* is set to "L", and a clock is input to the ClkA terminal once. When data items (without a circle mark) are input to the gate signal output circuit 53*b*, and circle mark positions in some of the blocks 141 are shifted to the positions of the blocks 141 (B2, B3, B4). FIG. 34B illustrates a state in which the DatA1 terminal of the gate signal output circuit 53*a* of the gate driver IC 12*a* is set to "L", and a clock is input to the ClkA terminal once. The EnbA1 and EnbA1 terminals of the gate driver IC 12*a* are set to "H".

In the above settings and control states, an on voltage is output to the gate signal lines 17*b* each passing through the pixels 16*b*, 16*c*, or 16*d*. In addition, an on voltage is output to the gate signal line 17*a* passing through the pixels 16*b*. Accordingly, the gate signal line 17*a* passing through the pixel 16*b* is subject to a both-side drive, and the gate signal lines 17*b* each passing through the pixels 16*b*, 16*c*, or 16*d* are subject to a one-side drive.

As described above, each of the gate signal lines 17*a* is subject to the both-side drive by the gate signal output circuit 53*a* of the gate driver IC 12*a* and the gate signal output circuits 53*a* and 53*b* of the gate driver IC 12*b*. The gate signal output circuit 53*b* of the gate driver IC 12*a* performs a one-side drive on the gate signal line 17*b*.

As described above, the consecutive circle mark positions are sequentially shifted to positions of blocks 141 of the shift registers 51, and a duty drive etc. is performed.

In the present disclosure as described above, the gate driver IC 12*a* and the gate driver IC 12*b* have the same gate driver ICs 12 intended to realize or perform either a both-side drive or a one-side drive on each gate signal line 17 by controlling or operating control terminals (such as Dat terminals, Enb terminals, Clk terminals) according to positions (a right position of the display screen 25, a left position of the display screen 25) at which the EL display (EL display panel) is mounted.

Accordingly, by generating gate drivers IC 12 (12*a*, 12*b*) of one kind according to the present disclosure and mounting them on EL displays having a wide variety of pixel circuits, the EL displays which realize excellent image display can be provided. The gate driver ICs 12 (12*a*, 12*b*) of the present disclosure can be appropriate for such a wide variety of pixel circuits. Accordingly, the gate driver ICs 12 (12*a*, 12*b*) can be used as general-purpose ones. Since mass production of these ICs is possible, the cost can be reduced.

In addition, the gate driver ICs 12 (12*a*, 12*b*) of the present disclosure can set scanning directions for the shift registers using a vertical inverse setting logic terminal (the UD terminal, for example see FIG. 15). Accordingly, the gate driver ICs 12*a* and 12*b* can be arranged right and left of the display screen 25 and used. Accordingly, it is possible to easily perform a both-side drive or a one-side drive of each gate signal line 17. In addition, it is possible to reduce the number of gate driver ICs 12 (12*a*, 12*b*) and reduce cost by performing a one-side drive.

Furthermore, the three-value drive of gate voltages and the two-value drive of gate voltages are realized by performing control or setting on SEL terminals etc. In particular, since an EL display (EL display panel) includes a plurality of gate signal lines 17 passing through pixels 16, the physical positions of the gate signal lines 17 which should be subject to a both-side drive for pixels are not determined until the pixels are laid out (the physical positions are, for example, the positions of the gate signal lines 17*a* which apply a video signal to corresponding ones of the pixels 16). However, it is unpractical to develop or design gate driver ICs 12 (12*a*, 12*b*) etc. after the pixel layout design was completed because it takes significantly long time to complete manufacturing the EL display (EL display panel). In the present disclosure, the gate driver ICs 12 (12*a*, 12*b*) can be mounted on any of positions (a right position of the display screen 25, a left position of the display screen 25) in the EL display (the EL display panel). Furthermore, it is possible to easily perform a both-side drive or a one-side drive on each gate signal line 17 by, for example, controlling the gate signal output circuit 53. It is possible to select and perform either the three-value drive of gate voltages or the two-value drive of gate voltages on any of the gate signal lines 17.

In addition, as illustrated in each of FIGS. 14, 12, 17, and 18, for example, logic setting of each driver IC is performed by branching an input control line 261 etc. from a panel side. Accordingly, since the number of lines to be formed on the COF can be reduced, the panel module without a gate printed board (PCB) can easily be configured to be thin.

As illustrated in each of FIGS. 8A, 8B, 9, 19, and 21, since the number of lines to be formed on the COF can be reduced by forming an internal line inside each driver IC, the panel module without a gate printed board (PCB) can easily be configured to be thin.

In addition, the pixels according to the present disclosure are similar to the pixels 16 illustrated in FIG. 5, and are not described in detail here.

Figure 35:
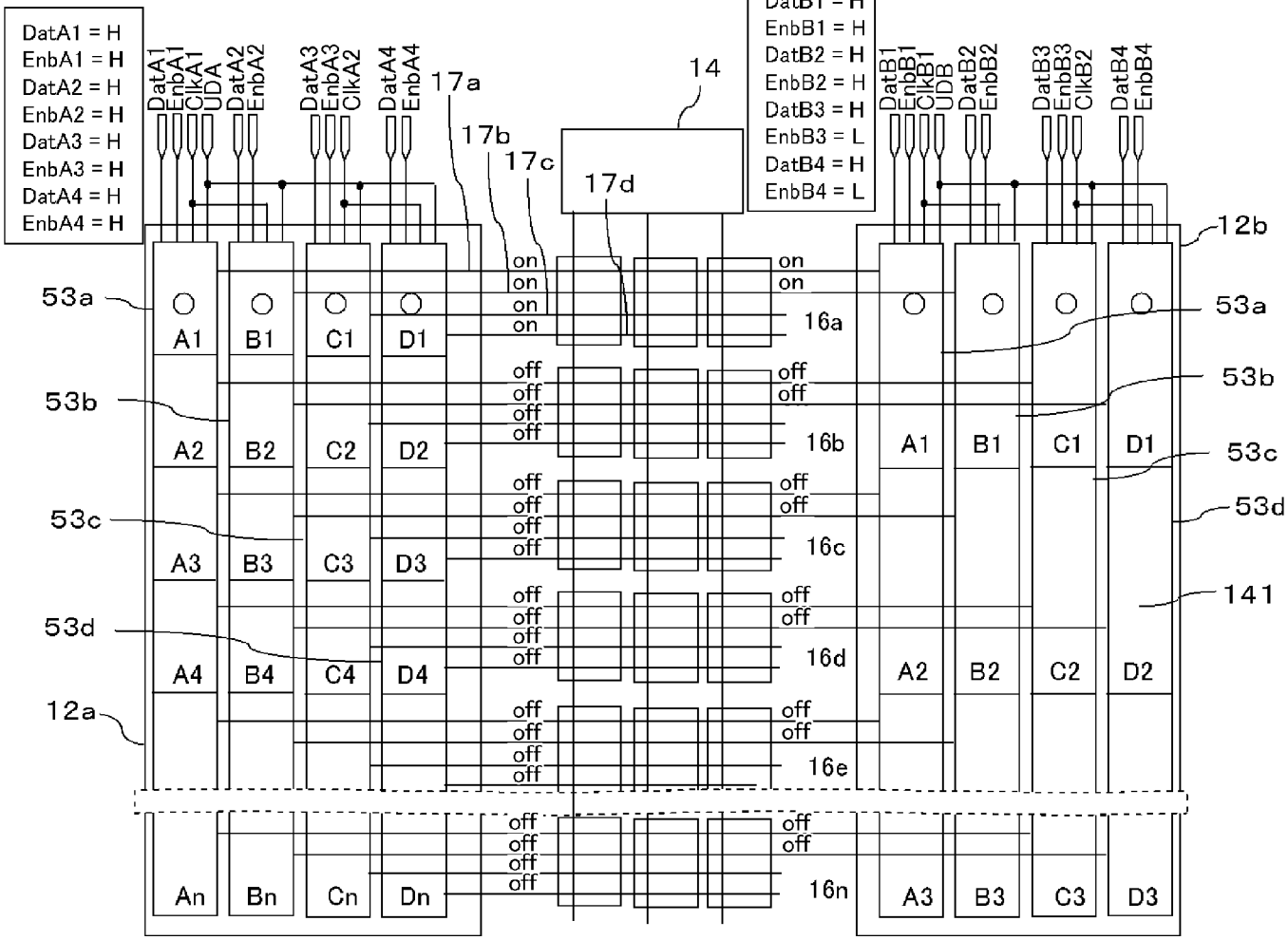
FIG. 35 is a diagram for explaining a method for driving an EL display according to an embodiment.

FIG. 35 is a diagram illustrating a method for driving an EL display (EL display panel) of the present disclosure. In FIG. 35 etc., a scanning direction of gate drivers IC 12 (12*a*, 12*b*) is set by providing settings of logic terminals of control terminals (UDA, UDB) according to a vertical inverse method. The scanning direction of the gate driver IC 12*a* and the gate driver IC 12*b* is a direction from top to down in the drawing sheets.

The gate driver ICs 12 (12*a*, 12*b*) have identical or similar specifications or configurations. Accordingly, the UDA terminal of the gate driver IC 12*a* and the UDB terminal of the gate driver IC 12*b* are provided with opposite logic settings. For example, when the UDA terminal is set to "H", the UDB terminal is set to "L".

One (ClkA1 terminal) of clock terminals (Clk terminals) is shared by gate signal output circuits 53*a* and 53*b* of each of the gate driver ICs 12 (12*a*, 12*b*), and another one (ClkA2 terminal) of the clock terminals (Clk terminals) is shared by gate signal output circuits 53*c* and 53*d* of each of the gate drivers IC 12 (12*a*, 12*b*). This configuration is intended to cause the gate signal output circuits 53*a* and 53*b* to operate at an identical clock and cause the gate signal output circuits 53*c* and 53*d* to operate at an identical clock in the gate driver IC 12*b*, and to apply the wire-connection state of the gate driver IC 12*b* (the connection state of the Clk terminal) to the gate driver IC 12*a*.

Since the gate signal output circuits 53*a*, 53*b*, 53*c*, and 53*d* are operated at an identical clock in the gate driver IC 12*a* according to the drive method illustrated with reference to FIGS. 35A and 35B etc., it is to be noted that these four gate signal output circuits 53 may be configured to operate at an identical clock by integrating the Clk terminals (ClkA1, ClkA2) into one.

In FIG. 35, in the gate driver IC 12*a*: a DatA1 terminal and an EnbA1 terminal are connected to the gate signal output circuit 53*a*; and a DatA2 terminal and an EnbA2 terminal are connected to the gate signal output circuit 53*b*.

In the gate driver IC 12*a*: a DatA3 terminal and an EnbA3 terminal are connected to the gate signal output circuit 53*c*; and a DatA4 terminal and an EnbA4 terminal are connected to the gate signal output circuit 53*d*.

In the gate driver IC 12*b*: a DatB1 terminal and an EnbB1 terminal are connected to the the gate signal output circuit 53*a*; and a DatB2 terminal and an EnbB2 terminal are connected to the gate signal output circuit 53*b*. In the gate driver IC 12*b*: a DatB3 terminal and an EnbB3 terminal are connected to the gate signal output circuit 53*c*; and a DatB4 terminal and an EnbB4 terminal are connected to the gate signal output circuit 53*d*.

In FIG. 35, the DatA1 terminal, the DatA2 terminal, the DatA3 terminal, and the DatA4 terminal of the gate driver IC 12*a* are set to "H", and triggered by a clock input of the ClkA2 terminal, data with a circle mark is set to blocks 141 (A1, B1, C1, D1) of the gate driver IC 12*a*. In addition, since the EnbA1 terminal, the EnbA2 terminal, the EnbA3 terminal, and the EnbA4 terminal of the gate driver IC 12*a* are set to "H", an on voltage is applied to gate signal lines 17*a*, 17*b*, 17*c*, and 17*d* passing through pixels 16*a* (the pixel row in which the pixels 16*a* are positioned). An off voltage is applied to the gate signal lines 17 passing through the other pixels 16 (16*b*, 16*c*, . . . ).

The DatB1 terminal, the DatB2 terminal, the DatB3 terminal, and the DatB4 terminal of the gate driver IC 12*b* are set to "H", and triggered by clock inputs of the ClkB1 and ClkB terminals, data with a circle mark is set to the blocks 141 (A1, B1, C1, D1) of the gate driver IC 12*a*.

Since the EnbB1 terminal and the EnbB2 terminal of the gate driver IC 12*b* are set to "H", and the EnbB3 terminal and the EnbB4 terminal are set to "L", an on voltage is applied to the gate signal lines 17*a* and 17*b* of the pixels 16*a*, and an off voltage is applied to the gate signal lines 17*c* and 17*d* passing through the pixels 16*a*. An off voltage is applied to the gate signal lines 17 passing through the other pixels 16.

With the setting states, the gate signal lines 17*a* and 17*b* passing through the pixels 16*a* are subject to a both-side drive. The gate signal lines 17*c* and 17*d* passing through the pixels 16*a* (the pixel row in which the pixels 16*a* are positioned) are subject to a one-side drive. As described above, by using the identical gate driver ICs 12 and arranging the gate driver ICs 12*a* and 12*b* right and left of a display screen 25, the present disclosure makes it possible to easily perform a both-side drive and a one-side drive. Here, the scanning direction of the gate driver ICs 12*a* and 12*b* are inverted.

The gate signal line 17*a* is connected to switch transistors 11*b* which apply a video signal. It is possible to turn on or off the switch transistors 11*b* quickly by performing a both-side drive on the gate signal line 17*a*. Furthermore, it is possible to turn on or off the switch transistors 11*b* further quickly by performing a three-value drive of gate voltages on the gate signal output circuit 53*a* which drives the gate signal lines 17*a*. Accordingly, it is possible to realize excellent image (video) writing on the display screen 25.

The switch transistors 11*d* which function or act at the time of offset cancellation are connected to the gate signal line 17*b*. It is possible to turn on or off the switch transistors 11*d* quickly by performing a both-side drive on the gate signal line 17*b*. Furthermore, it is possible to turn on or off the switch transistors 11*b* further quickly by performing a three-value drive of gate voltages on the gate signal output circuit 53*b* which drives the gate signal line 17*a*. Accordingly, an excellent offset cancellation is performed.

Here, the voltage value of an on voltage (Von) to be applied to an input terminal (VonB terminal) for an on voltage of the gate signal output circuit 53*b* is set to be higher than the voltage values of input terminals (VonA, VonC, VonD) for the other on voltages. For example, the setting is performed such that a voltage VonB>a voltage VonA is satisfied. Preferably, the VonB voltage is set to be from +3 (V) to +15 (V) inclusive with respect to the voltage VonA. Preferably, the voltage VonB is set to be from +5 (V) to +10 (V) inclusive with respect to the voltage VonA. It is possible to reduce the on resistances of the switch transistors 11*d* by increasing the voltage vonB (the on voltages of the switch transistors 11*d*). Accordingly, it is possible to reduce a voltage fall between channels of the switch transistors 11*d*, and to thus reduce an anode voltage Vdd and power consumed by the EL display (EL display panel).

As described above, according to the present disclosure, it is possible to arbitrarily set or apply an on voltage Von of the gate signal output circuit 53. In addition, it is possible to set the drive method of the gate signal output circuit 53 (a two-value drive of gate voltages, a three-value drive of gate voltages, etc.). Accordingly, it is possible to provide excellent image display, and to reduce power to be consumed by the EL display (EL display panel). Needless to say, the above embodiments are also applicable to other embodiments in the present disclosure. In addition, the above embodiments can of course be combined with other embodiments.

The gate signal line 17*c* and the gate signal line 17*d* drive switch transistors 11*e* and 11*c*. The switch transistors 11*e* each have a function for applying a reference voltage (voltage Vref) to the gate terminal of a corresponding one of driver transistors 11*a*. Application of the voltage Vref does not need to be performed quickly. Accordingly, a one-side drive is sufficient for the gate signal line 17*c*. The switch transistors 11*c* each have a function for applying an initial voltage (voltage Vini) to a second terminal of the corresponding driver transistor 11*a*. Application of the voltage Vini does not need to be performed quickly. Accordingly, a one-side drive is sufficient for the gate signal line 17*d*.

As described above, the gate signal lines 17 (17*a*, 17*b*) that require a both-side drive is driven by the gate driver IC 12*a* and the gate driver IC 12*b*. The gate signal lines 17 (17*c*, 17*d*) that require a one-side drive is driven by the gate driver IC 12*a*. It is possible to reduce the number of gate driver ICs 12*b* by performing the drives or arranging the gate driver ICs 12, and to thus reduce the cost of the EL display (EL display panel). As the gate driver IC 12*a* and the gate driver IC 12*b*, the gate driver ICs 12 having identical specifications (same kind ones) can be employed. Accordingly, it is possible to increase flexibility of the gate driver ICs 12, and to reduce the cost for developing and designing the gate driver ICs 12.

Figure 36:
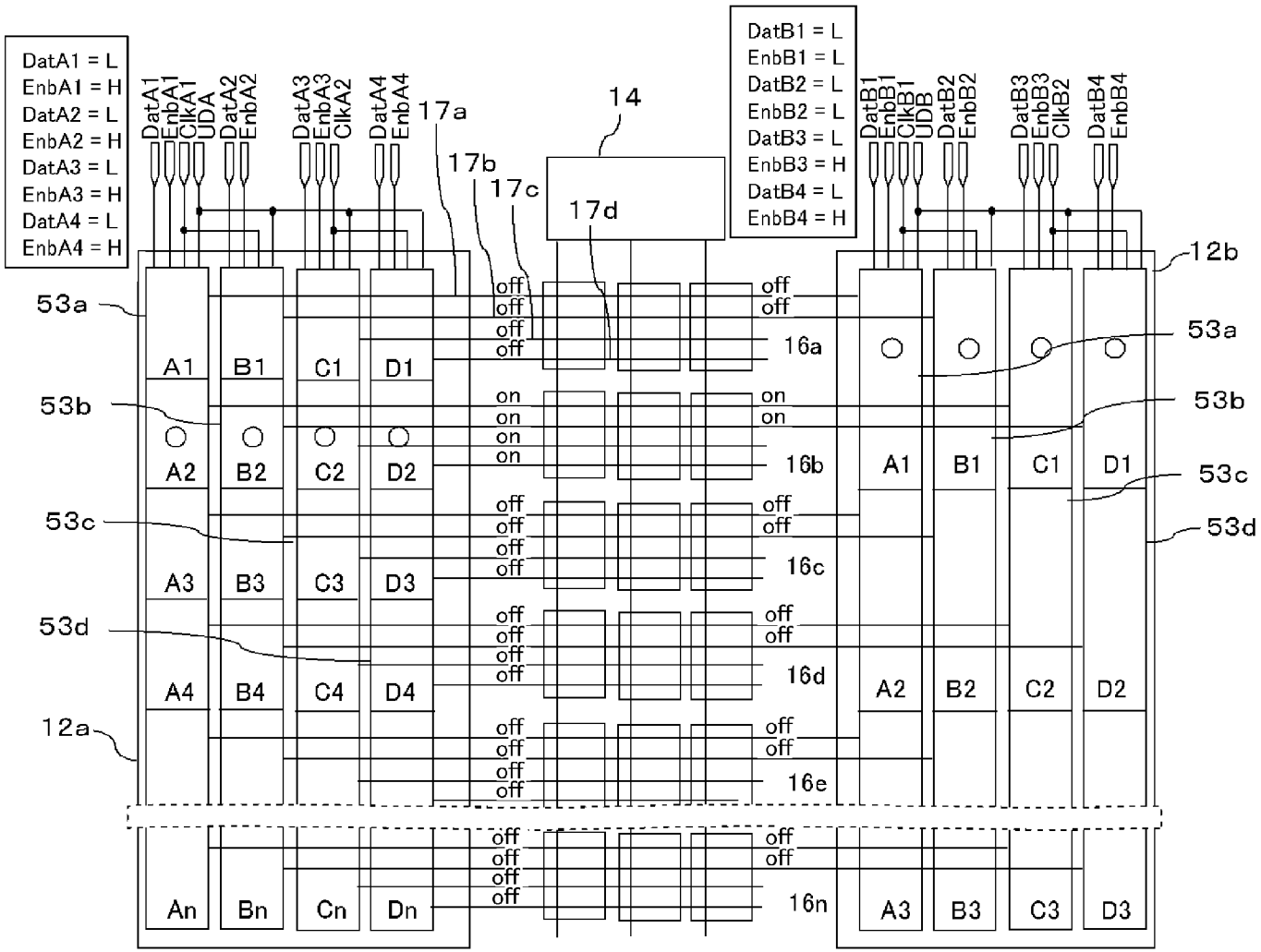
FIG. 36 is a diagram for explaining a method for driving the EL display according to the embodiment.

FIG. 36 is a diagram illustrating a state next to a state in FIG. 35. In FIG. 35, the DatA1 terminal, the DatA2 terminal, the DatA3 terminal, and the DatA4 terminal of the gate driver IC 12*a* are set to "L", and triggered by clock inputs of the ClkA1 and ClkA2 terminals, data with a circle mark is set to the blocks 141 (A1, B1, C1, D1) of the gate driver IC 12*a*.

Data items with a circle mark of the blocks 141 (A1, B1, C1, D1) of the gate driver IC 12*a* are shifted in the shift registers, and are retained in blocks 141 (A2, B2, C2, D2). In addition, since the EnbA1 terminal, the EnbA2 terminal, the EnbA3 terminal, and the EnbA4 terminal of the gate driver IC 12*a* are set to "H", an on voltage is applied to the gate signal lines 17*a*, 17*b*, 17*c*, and 17*d* passing through the pixels 16*b* and driven by the gate driver IC 12*a*. An off voltage is applied to the gate signal lines 17 passing through the other pixels 16 (16*a*, 16*c*, . . . ).

The DatB1 terminal, the DatB2 terminal, the DatB3 terminal, and the DatB4 terminal of the gate driver IC 12*b* are set to "L", and clock inputs of the ClkB1 and ClkB2 terminals have not been provided from the state of FIG. 35. Accordingly, the data items with a circle mark in the blocks 141 (A1, B1, C1, D1) are retained as they are in the gate driver IC 12*a*.

The EnbB1 terminal and the EnbB2 terminal of the gate driver IC 12*b* are set to "L", and the EnbB3 terminal and the EnbB4 terminal of the gate driver IC 12*b* are set to "H". Accordingly, an off voltage is applied to the gate signal lines 17*a* and 17*b* passing through the pixels 16*a*, and an on voltage is applied to the gate signal lines 17*a* and 17*b* passing through the pixels 16*b* (the pixel row in which the pixels 16*b* are positioned). An off voltage is applied to the gate signal lines 17 passing through the other pixels 16.

With the setting states, the gate signal lines 17*a* and 17*b* passing through the pixels 16*b* (the pixel row in which the pixels 16*b* are positioned) are subject to a both-side drive. The gate signal lines 17*c* and 17*d* passing through the pixels 16*b* (the pixel row in which the pixel 16*b* is positioned) are subject to a one-side drive.

Figure 37:
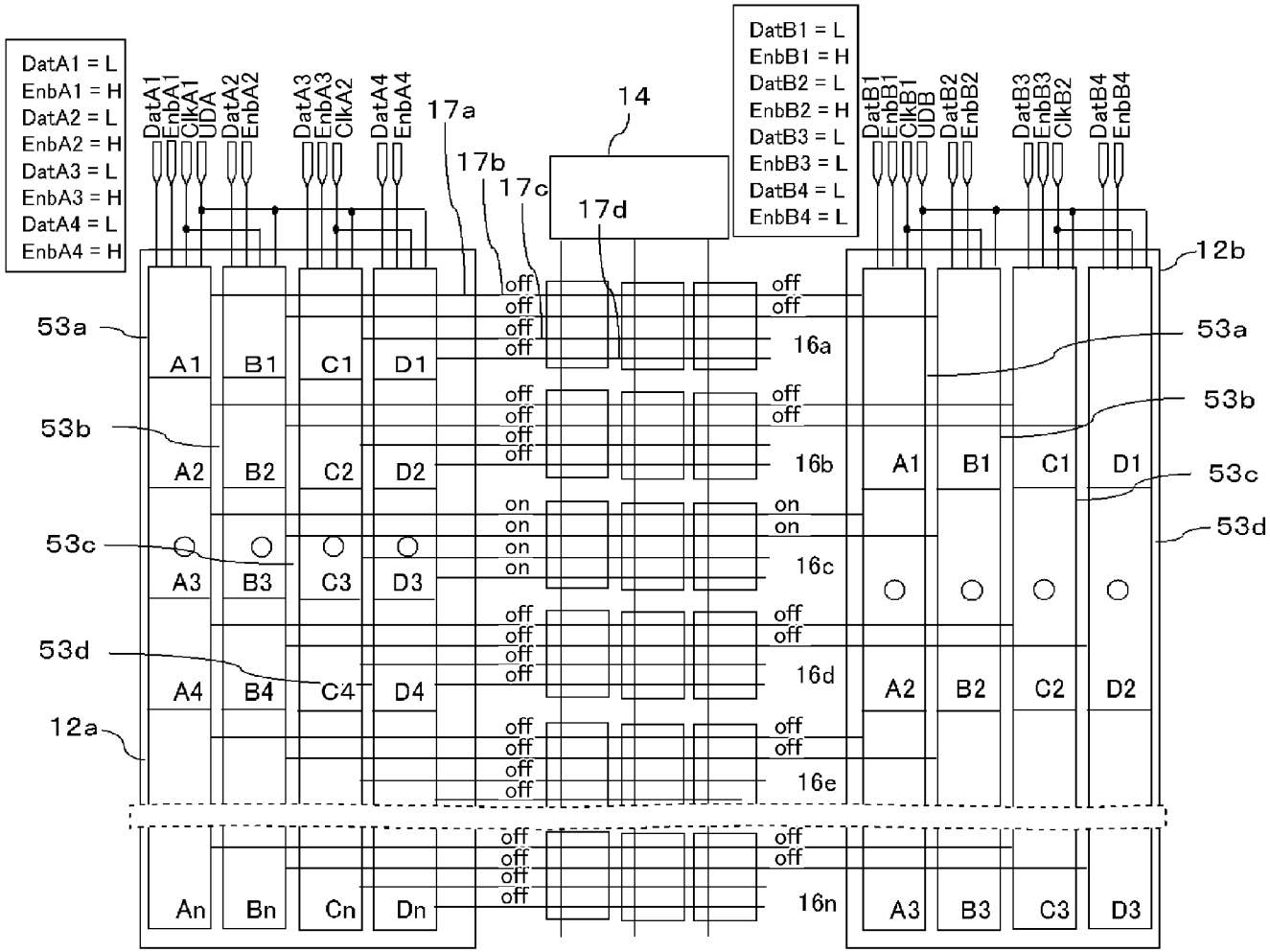
FIG. 37 is a diagram for explaining a method for driving the EL display according to the embodiment.

FIG. 37 is a diagram illustrating a state next to the state in FIG. 36. In FIG. 37, the DatA1 terminal, the DatA2 terminal, the DatA3 terminal, and the DatA4 terminal of the gate driver IC 12*a* are set to "L", and triggered by clock inputs of the ClkA1 and ClkA2 terminals, data with a circle mark (off data) is set to the blocks 141 (A1, B1, C1, D1) of the gate driver IC 12*a*. Data items with a circle mark of the blocks 141 (A2, B2, C2, D2) of the gate driver IC 12*a* are shifted in the shift registers, and are retained in blocks 141 (A3, B3, C3, D3). In addition, since the EnbA1 terminal, the EnbA2 terminal, the EnbA3 terminal, and the EnbA4 terminal of the gate driver IC 12*a* are set to "H", an on voltage is applied to the gate signal lines 17*a*, 17*b*, 17*c*, and 17*d* passing through the pixels 16*c* and driven by the gate driver IC 12*a*. An off voltage is applied to the gate signal lines 17 passing through the other pixels 16 (16*a*, 16*b*, 16*d* . . . ).

The DatB1 terminal, the DatB2 terminal, the DatB3 terminal, and the DatB4 terminal of the gate driver IC 12*b* are set to "L", and a clock is input to the two ClkB1 and ClkB2 terminals. Accordingly, data items with a circle mark in the blocks 141 (A1, B1, C1, D1) of the gate driver IC 12*b* are shifted to the blocks 141 (A2, B2, C2, D2) and retained therein.

The EnbB1 terminal and the EnbB2 terminal of the gate driver IC 12*b* are set to "H", and the EnbB3 terminal and the EnbB4 terminal of the gate driver IC 12*b* are set to "L". Accordingly, an on voltage is applied to the gate signal lines 17*a* and 17*b* passing through the pixels 16*c* (the pixel row in which the pixels 16*c* are positioned), and an off voltage is applied to the gate signal lines 17*a* and 17*b* passing through pixels 16*d*. An off voltage is applied to the gate signal lines 17 passing through the other pixels 16.

With the setting states, the gate signal lines 17*a* and 17*b* passing through the pixels 16*c* (the pixel row in which the pixels 16*c* are positioned) are subject to a both-side drive. The gate signal lines 17*c* and 17*d* passing through the pixels 16*c* (the pixel row in which the pixels 16*c* are positioned) are subject to a one-side drive.

Figure 38:
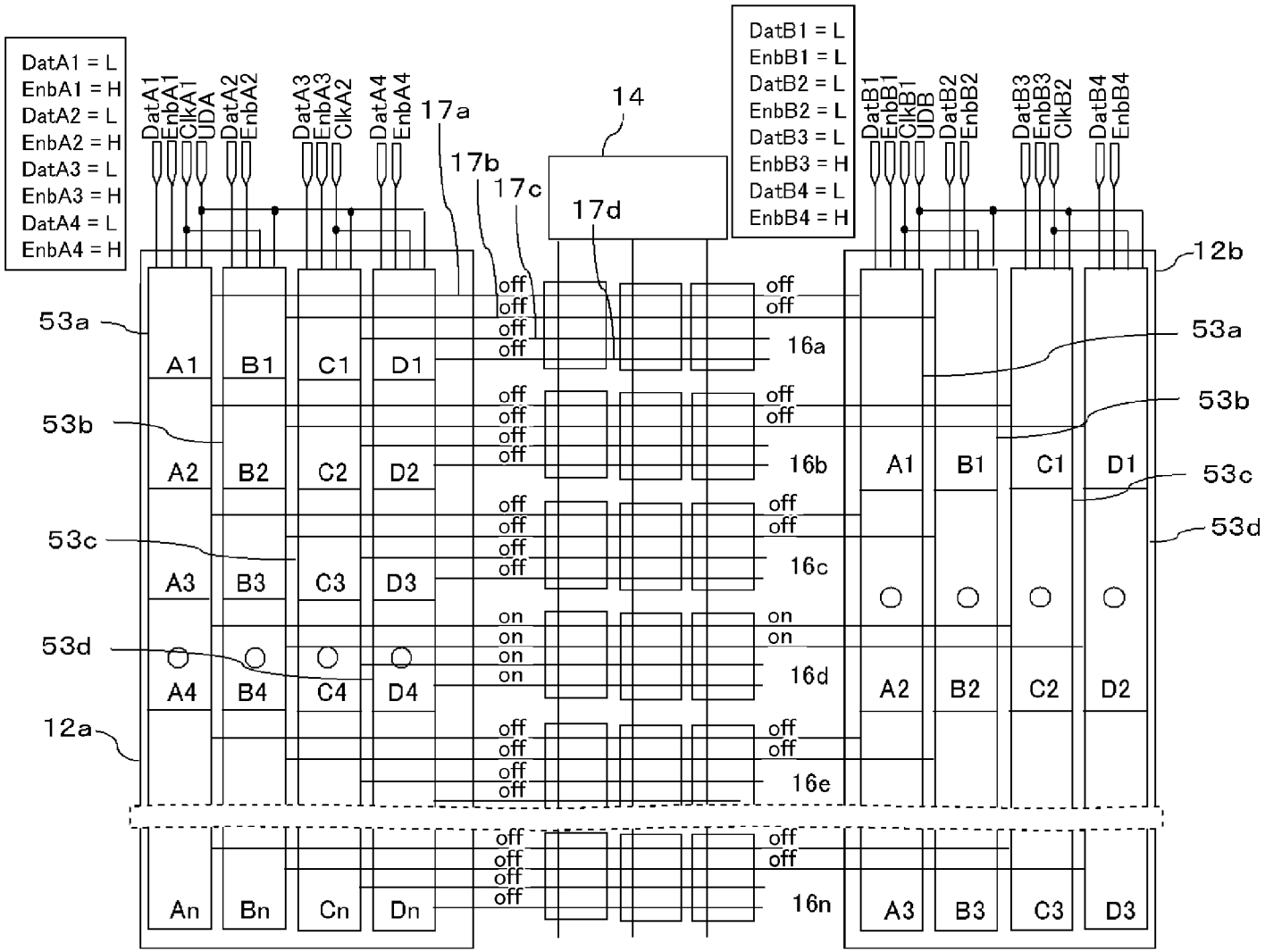
FIG. 38 is a diagram for explaining a method for driving the EL display according to the embodiment.

FIG. 38 is a diagram illustrating a state next to the state in FIG. 37. In FIG. 37, the DatA1 terminal, the DatA2 terminal, the DatA3 terminal, and the DatA4 terminal of the gate driver IC 12*a* are set to "L", and triggered by a clock input of the ClkA2 terminal, data with a circle mark is set to the blocks 141 (A1, B1, C1, D1) of the gate driver IC 12*a*.

Data items with a circle mark of the blocks 141 (A3, B3, C3, D3) of the gate driver IC 12*a* are shifted in the shift registers, and are retained in the blocks 141 (A4, B4, C4, D4). In addition, since the EnbA1 terminal, the EnbA2 terminal, the EnbA3 terminal, and the EnbA4 terminal of the gate driver IC 12*a* are set to "H", an on voltage is applied to the gate signal lines 17*a*, 17*b*, 17*c*, and 17*d* passing through the pixels 16*d* (the pixel row in which the pixels 16*d* are positioned) and driven by the gate driver IC 12*a*. An off voltage is applied to the gate signal lines 17 passing through the other pixels 16 (16*a*, 16*b*, 16*c*, 17*e* . . . ).

The DatB1 terminal, the DatB2 terminal, the DatB3 terminal, and the DatB4 terminal of the gate driver IC 12*b* are set to "L", and no clocks have been input to the ClkB1 and ClkB2 terminals have not been provided from the state of FIG. 29. Accordingly, the data items with a circle mark in the blocks 141 (A2, B2, C2, D2) are retained as they are in the gate driver IC 12*b*.

The EnbB1 terminal and the EnbB2 terminal of the gate driver IC 12*b* are set to "L", and the EnbB3 terminal and the EnbB4 terminal of the gate driver IC 12*b* are set to "H". Accordingly, an on voltage is applied to the gate signal lines 17*a* and 17*b* passing through the pixels 16*d*, and an off voltage is applied to the gate signal lines 17*a* and 17*b* passing through the pixels 16*c*. An off voltage is applied to the gate signal lines 17 passing through the other pixels 16.

With the setting states, the gate signal lines 17*a* and 17*b* passing through the pixels 16*d* (the pixel row in which the pixels 16*d* are positioned) are subject to a both-side drive. The gate signal lines 17*c* and 17*d* passing through the pixels 16*d* (the pixel row in which the pixels 16*d* are positioned) are subject to a one-side drive.

In each of FIGS. 35 to 39, only a data item with a circle mark is retained in one of the shift resisters 51 of some of the gate signal output circuits 53 in one of the gate drivers IC 12. However, as described in the earlier embodiments, the present disclosure is not limited thereto.

Figure 39:
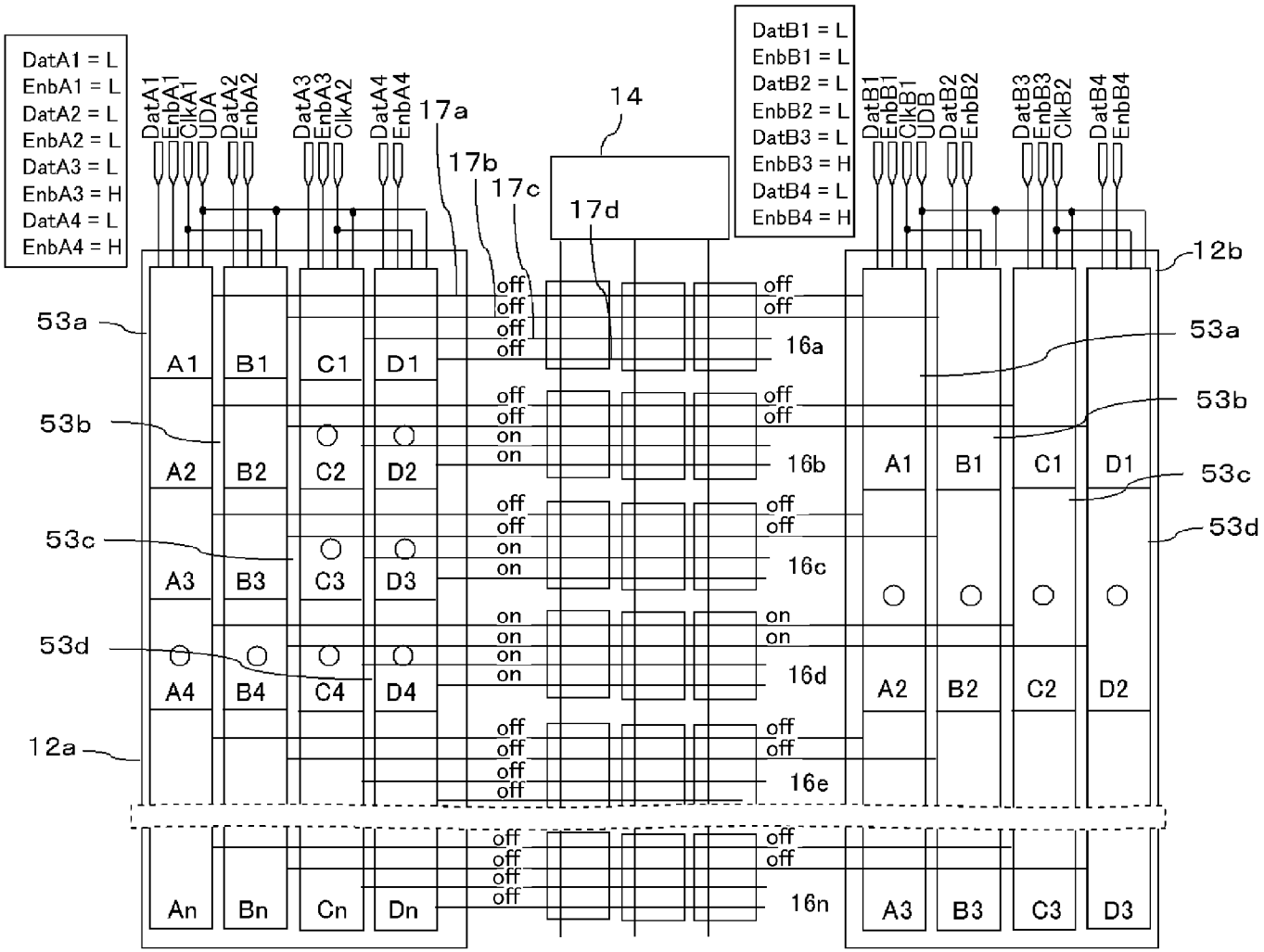
FIG. 39 is a diagram for explaining a method for driving the EL display according to the embodiment.

FIG. 39 is a diagram illustrating an embodiment in which a plurality of data items with a circle mark or consecutive data items with a circle mark are retained and shifted in some of the shift registers 51 in the gate signal output circuit 53. FIG. 39 illustrates, as examples, the gate signal output circuits 53*c* and 53*d* of the gate driver IC 12*a*.

In FIG. 39, each of the DatA3 terminal and the DatA4 terminal of the gate driver IC 12*a* is set to "L" or "H", and triggered by a clock input of the ClkA2 terminal, a data item with or without a circle mark is set to each of the blocks 141 (C1, D1) of the gate driver IC 12*a*. Data items with a circle mark are sequentially retained and shifted in the blocks 141 of the shift registers 51 by inputting a clock Clk with the Dat terminals kept in the "H" state. Data items without a circle mark are sequentially retained and shifted in the blocks 141 of the shift registers 51 by inputting a clock Clk with the Dat terminals kept in the "L" state.

FIG. 39 illustrates a state in which data items with a circle mark are sequentially retained in the blocks 141 (C2, C3, C4, D2, D3, D4) of the gate signal output circuits 53*c* and 53*d* by means of the clock Clk was input three times with the Dat terminals kept in the "H" state. Accordingly, an on voltage is output or applied to the gate signal lines 17*c* and 17*d* of the pixels 16*b*, 16*c*, and 16*d*.

Figure 40:
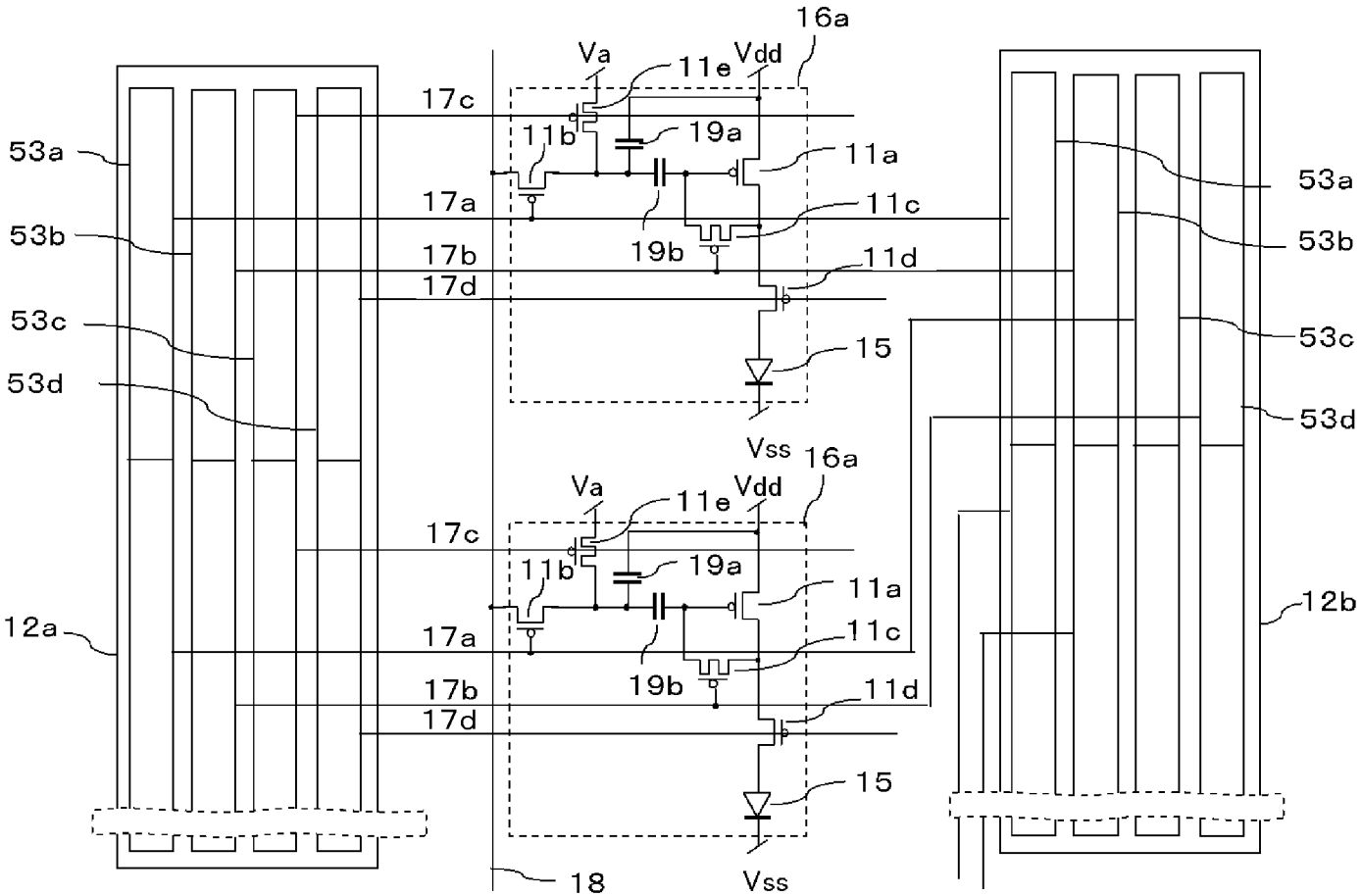
FIG. 40 is a diagram for explaining a method for driving the EL display according to the embodiment.

Although this embodiment has been described taking a pixel configuration in FIG. 5 as an example, the present disclosure is not limited thereto. For example, a pixel configuration illustrated in FIG. 40 is also possible. Needless to say, this embodiment is also applicable to other embodiments in the present disclosure. In addition, this embodiment can of course be combined with other embodiments.

As in FIG. 5, in the embodiment of the EL display illustrated in FIG. 40, the four signal lines 17 that are the gate signal line 17*a*, the gate signal line 17*b*, the gate signal line 17*c*, and the gate signal line 17*d* pass through each of the pixels 16. The gate signal output circuit 53*a* of the gate driver IC 12*a* is arranged for the gate signal line 17*a*, and the gate signal output circuit 53*b* of the gate driver IC 12*a* is arranged for the gate signal line 17*b*. The gate signal output circuit 53*c* of the gate driver IC 12*a* is arranged for the gate signal line 17*c*, and the gate signal output circuit 53*d* of the gate driver IC 12*a* is arranged for the gate signal line 17*d*.

In each pixel 16 in FIG. 40, a first terminal of the P-channel driver transistor 11*a* is connected to an electrode or a line of an anode voltage Vdd, and a second terminal thereof is connected to a first terminal of the switch transistor 11*d*. The gate terminal of the switch transistor 11*d* is connected to the gate signal line 17*b*. The second terminal of the switch transistor 11*d* is connected to a first terminal of the EL element 15. A second terminal of the EL element 15 is connected to an electrode or a line to which a cathode voltage Vss is applied.

In FIG. 40, the transistors are P-channel transistors, but this is a non-limiting example and the transistors may be N-channel transistors. In addition, one or more P-channel transistors and one or more N-channel transistors may coexist.

A first terminal of the switch transistor 11*e* is connected to an electrode or a line to which a reset voltage Va is applied, and a second terminal of the switch transistor 11*e* is connected to the gate terminal of the driver transistor 11*a*. The gate terminal of the switch transistor 11*e* is connected to the gate signal line 17*c*.

A first terminal of the switch transistor 11*b* which provides the pixel 16 with a video signal is connected to the source line 18, and a second terminal of the switch transistor 11*b* is connected to a first terminal of a second capacitor 19*b*. A second terminal of the second capacitor 19*b* is connected to the gate terminal of the driver transistor 11*a*. The gate terminal of the switch transistor 11*b* is connected to the gate signal line 17*a*.

A first terminal of a first capacitor 19*a* is connected to an anode voltage Vdd, a second terminal of the first capacitor 19*a* is connected to the first terminal of the second capacitor 19*b* of the gate terminal of the driver transistor 11*a*.

A first terminal of the switch transistor 11*c* is connected to the gate terminal of the driver transistor 11*a*, and a second terminal of the switch transistor 11*c* is connected to a second terminal of the driver transistor 11*a*. The gate terminal of the switch transistor 11*c* is connected to the gate signal line 17*b*.

Multiple gates (at least dual gates) are used for at least one of the switch transistors 11*b* and 11*e* in combination with an LDD structure, which makes it possible to reduce off leak and realize excellent contrast and offset cancellation. In addition, an excellent high luminance display and image display can be obtained.

The gate signal line 17*a* and the gate signal line 17*c* are driven at both sides by the gate driver IC 12*a* and the gate driver IC 12*b*. In addition, the gate signal line 17*c* and the gate signal line 17*d* are driven at one side by the gate driver IC 12*a*.

In FIG. 40, a both side drive is performed on the gate signal line 17*a* connected to the switch transistor 11*b* which applies a video signal to the pixel 16. In addition, a both side drive is performed on the gate signal line 17*b* connected to the switch transistor 11*c* which performs an operation or control at the time of offset cancelling of the driver transistor 11*a*.

Needless to say, the drive methods according to the present disclosure are applicable also to the pixel configuration in FIG. 40 etc. This embodiment is of course also applicable to other embodiments in the present disclosure. In addition, this embodiment can of course be combined with other embodiments.

FIG. 40 illustrates details of the configuration or structure of the gate driver ICs 12 (12*a*, 12*b*) in FIG. 35 etc.

In FIG. 40, an output buffer 52 is arranged or formed at the output side of the gate signal output circuit 53. A terminal (Buf terminal) for switching or setting buffer performances is connected or arranged to the output buffer 52. The Buf terminal is the terminal for setting or switching the buffer performances. In the embodiment illustrated in FIG. 40, each of Buf terminals can set in three bits representing any of eight combinations of buffer performances as the cube-of-2 combinations. In other words, the buffer performances can be set at eight levels ranging from weak to strong.

Each of control terminals (Enb, Dat, Clk) are arranged or formed at at least two positions in the gate signal output circuit 53. SEL terminals are arranged between driver output terminals 72 and the Von terminals.

An output from the gate signal output circuit 53 is output from a connection terminal 71 after passing through the driver output terminal 72 of the gate driver IC 12 and a COF line 74. A gate signal line 17 is connected to the connection terminal 71.

Control signals such as Dat1, Dat2, Enb1, Enb2, Clk1, Clk2 etc. are bi-directional signals. Accordingly, data can be transferred in a direction from connection terminals 75*a* to 75*b*, and also in a direction of connection terminals 75*b* to 75*a*. The data transfer direction is switched by logic control performed by a transfer direction switching terminal (not illustrated).

The gate driver IC 12 includes a switch circuit 161. The switch circuit 161 is a switch circuit for realizing three-value drives of gate voltages in FIG. 20B, and two-value drives of gate voltages in FIG. 20A.

The three-value drive of gate voltages illustrated in FIG. 20B is realized by means of the switch circuit 161 switching outputs in the following listed order from a voltage Von via a voltage Voff2 to a voltage Voff1. The two-value drive of gate voltages illustrated in FIG. 20A is realized by means of the switch circuit 161 switching outputs in the following listed order from the voltage Von to the voltage Voff1.

Needless to say, this embodiment is also applicable to other embodiments in the present disclosure. In addition, this embodiment can of course be combined with other embodiments.

Figure 41:
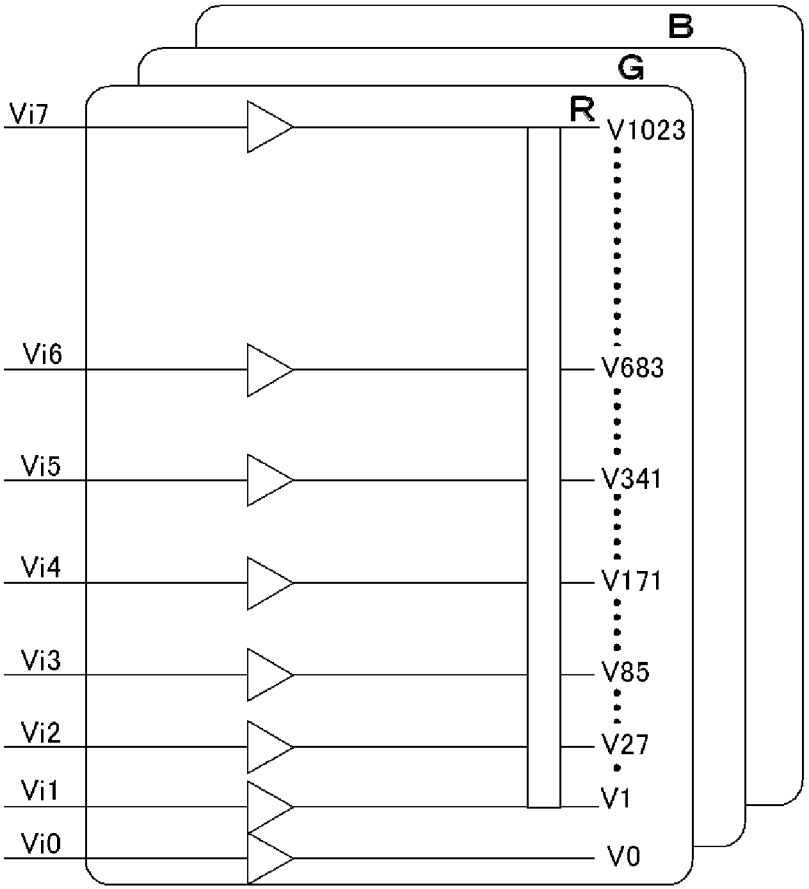
FIG. 41 is a diagram for explaining a gate driver IC of an EL display according to an embodiment.

FIG. 41 is a diagram illustrating gamma circuits of a source driver IC (circuit) 14 of the EL display (EL display panel) according to the present disclosure. The gamma circuits comprise independent red (R), green (G), and blue (B) gamma circuits each outputs signals of a grayscale representing $2^{10}$ (1024) levels of brightness.

Each of the R, G, and B gamma circuits includes a ladder resistor provided with eight taps (Vi0, Vi1, Vi2, Vi3, Vi4, Vi5, Vi6, and Vi7) each connected to a terminal of the source driver IC (circuit) 14.

The tap position of Vi0 is a minimum grayscale of video signals (a minimum voltage value or an origin). The tap position of Vi7 is a maximum grayscale of video signals (a maximum voltage value).

The tap position of Vi1 corresponds to a voltage value equal to 1/1024 of a video signal amplitude or a voltage value approximate thereto.

The tap position of Vi2 corresponds to a voltage value equal to 1/36 of the video signal amplitude or a voltage value approximate thereto.

The tap position of Vi3 corresponds to a voltage value equal to 1/12 of the video signal amplitude or a voltage value approximate thereto.

The tap position of Vi4 corresponds to a voltage value equal to 1/6 of the video signal amplitude or a voltage value approximate thereto.

The tap position of Vi5 corresponds to a voltage value equal to 1/3 of the video signal amplitude or a voltage value approximate thereto.

The tap position of Vi6 corresponds to a voltage value equal to 2/3 of the video signal amplitude or a voltage value approximate thereto.

Figure 42:
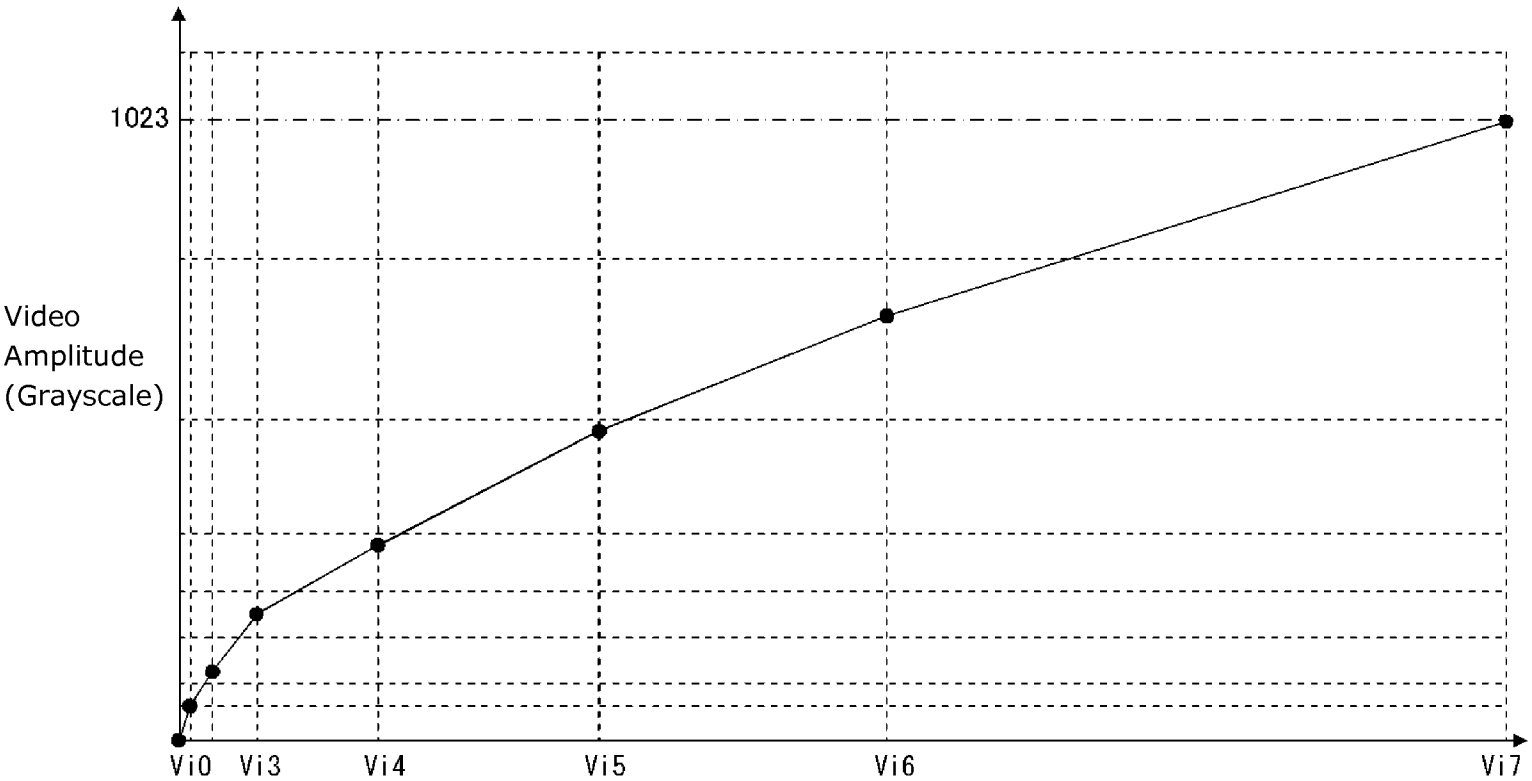
FIG. 42 is a diagram for explaining a source driver IC for use in an EL display according to an embodiment.

A gamma curve can be set or changed as illustrated in FIG. 42 by applying or setting a voltage to each of the tap positions (Vi0 to Vi7) each intended to receive an input or (setting) of a voltage. Each gamma circuit of the source driver IC 14 applies a voltage to each of Vi0, Vi1, and Vi7 terminals. Preferably, no voltage is applied to the other terminals in order to retain linearity of the video signals. It is preferable that the voltages to be applied to the Vi1 and Vi7 terminals of red (R), green (G), and blue (B) can be independently set, and a single Vi0 terminal is shared between the RGB gamma circuits.

The amplitude of the video signals can be changed by changing or modifying the tap positions (Vi0 to Vi7) at which the voltages are to be input (set). For example, as illustrated in FIG. 9, the amplitude of the video signals can be changed by changing Vi1 to Vi1' and Vi7 to Vi7'. A gamma curve between Vi1 to Vi7 can be linear by using Vi2 to Vi6 in an open state (in which no voltage is applied).

Figure 14:
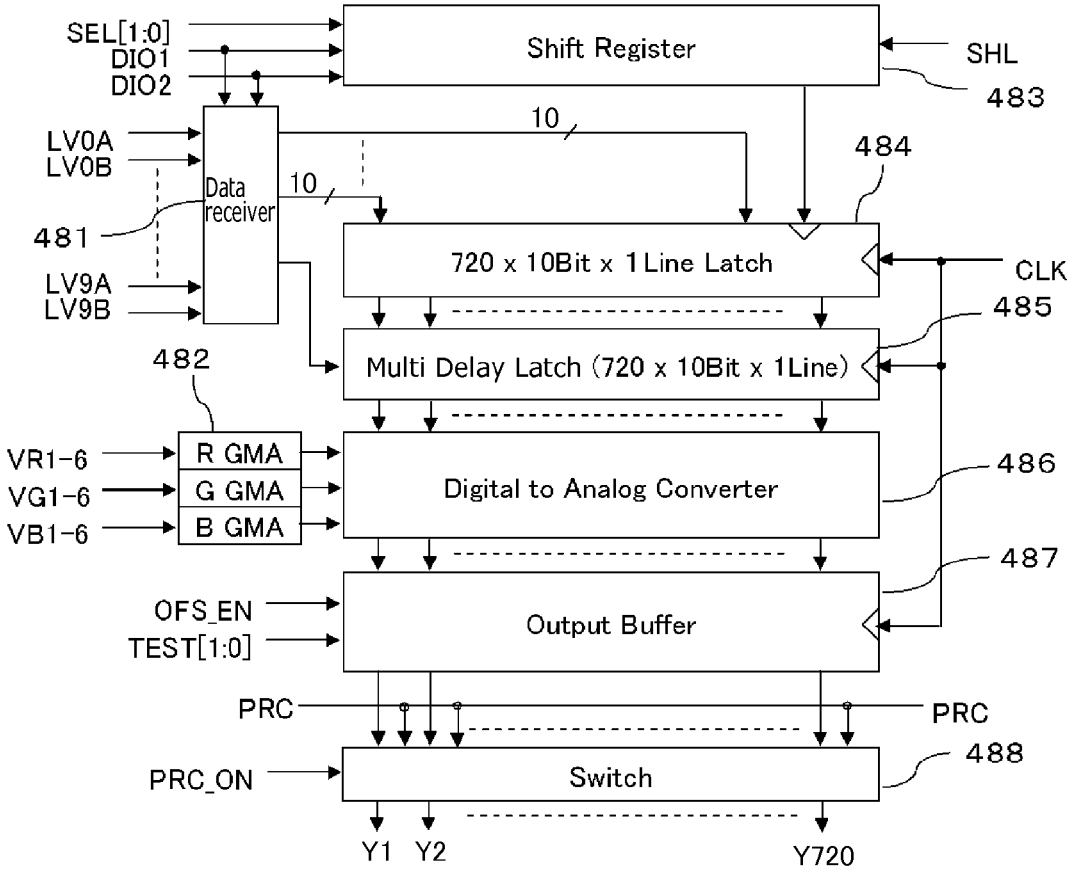
FIG. 14 is a diagram for explaining a gate driver IC of an EL display according to an embodiment.

When the voltages Vi1 and Vi7 are changed, the amplitude of the video signals is also changed. When the amplitude of the video signals is changed, output voltages (on voltages and off voltages) of the gate driver ICs 12 are changed. As described earlier, each gate driver IC 12 of the present disclosure can change or set an on voltage (Von) and off voltages (Voff1, Voff2). Accordingly, for example, a combination with the source driver IC (circuit) 14 in FIG. 14 provides synergy effects. FIG. 14 is a block diagram of the source driver IC 14 in the EL display according to the present disclosure.

According to the present disclosure, the switch transistors 11 which apply video signals to the pixels 16 perform a both-side drive.

In addition, the switch transistors 11 which act or contribute at the time of offset cancellation perform a both-side drive. On the other hand, an one-side drive is sufficient for some of the switch transistors (e.g. switch transistors 11*d*) which do not affect image display even if an on or off delay occurred.

As described above, according to the present disclosure, one of a both-side drive or a one-side drive is selected based on on or off time required for the transistors 11 of the pixels 16 or based on a load capacity of each gate signal line 17. Here, a three-value drive of gate voltages or a two-value drive of gate voltages is selected.

As described above, relationships between the video for image display and (i) rise or fall times of gate signal lines or (ii) on or off times of the transistors 11 are important. In other words, it is important that relationships between video signal systems and control systems of the switch transistors 11 are set or adjusted to the optimum ones.

For this reason, according to the present disclosure, a delay circuit 485 is formed or provided in the source driver IC 14 as illustrated in FIG. 14. The delay circuit 485 is a circuit for adjusting or setting output timings for a video signal Vs using each of source signal lines Y1 to Y720 or blocks of the source signal lines Y1 to Y720.

In FIG. 14, a SEL (1:0) for switching shift directions is applied to a shift register 483. Start pulses DIO1 and DIO2 of the shift register 483 are applied.

Ten combinations of comparator input signals LV0A, LV0B to LV9A, LV9B are output to a digital receiver 481. A video signal from the digital receiver 481 is latched in a latch circuit 484, and retained in a period of 1 H (one horizontal scanning period) or 2 H (two horizontal scanning periods).

A video signal from the latch circuit 484 is input to the delay circuit 485, and the delay circuit 485 delays the video signal according to a preset action or a control method.

An output of the delay circuit 485 is applied to a digital-analog (DA) conversion circuit 486. The DA conversion circuit 486 outputs an analog voltage on which gamma conversion was performed, according to voltages VXi0 to VXi7 (X: R, G, or B) set in gamma setting circuits 482.

An output from the DA conversion circuit 486 is input to a buffer circuit 487, and is output to the source signal lines Y1 to Y720 via a switch circuit 488. The buffer circuit 487 is configured to have settings of a plurality of buffer performances such as Strong, Middle, and Weak.

The switch circuit 488 is a switch circuit capable of selecting one of a precharge voltage or a video signal voltage. When a precharge voltage is selected, the precharge voltage is applied to a corresponding one of the source signal lines Y1 to Y720, and electric charge accumulated in the corresponding one of the source signal lines Y1 to Y720 is forcibly charged or released.

Figure 43:
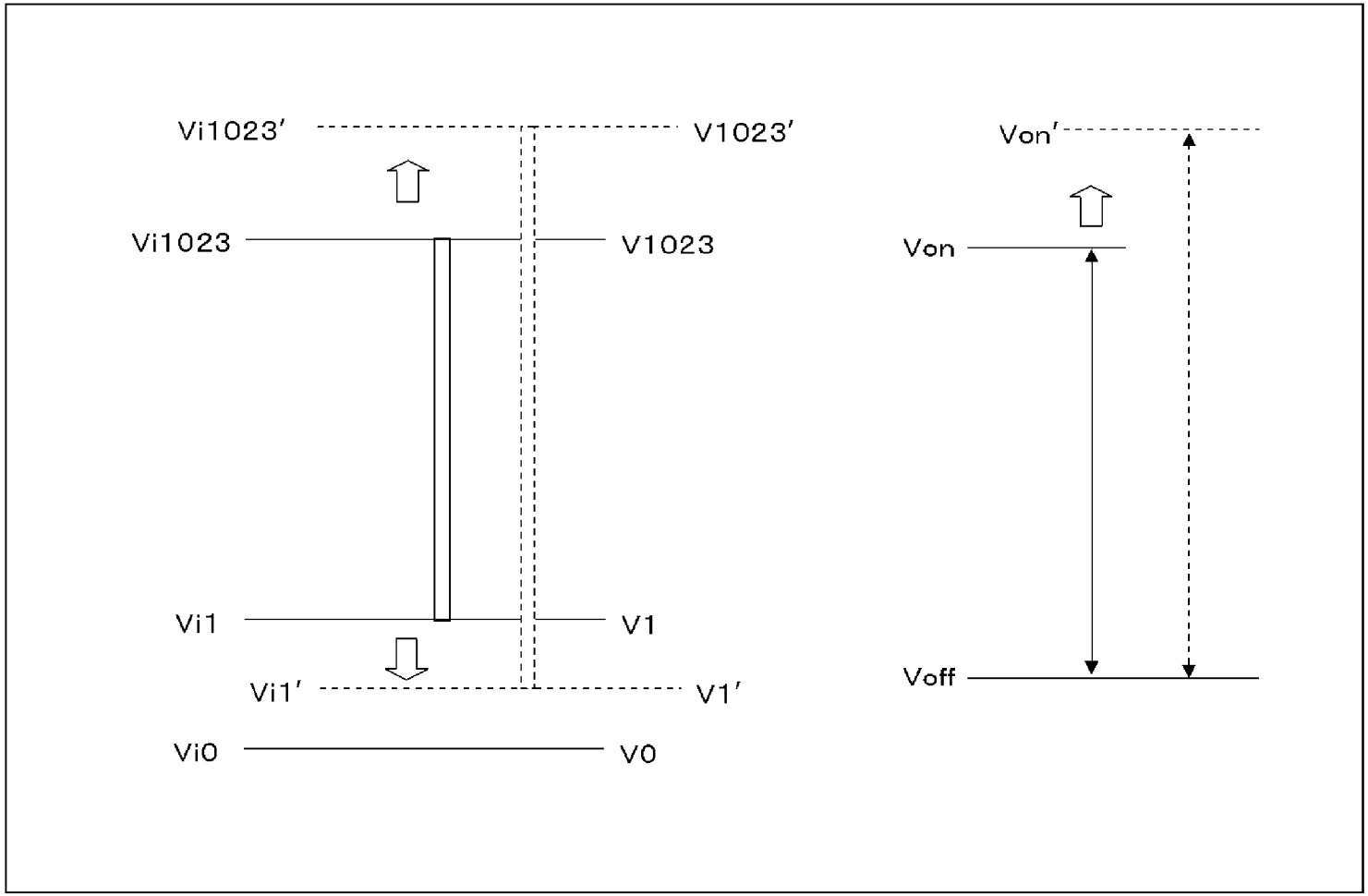
FIG. 43 is a diagram for explaining a source driver IC for use in an EL display according to an embodiment.

It is preferable that gamma characteristics be set to be linear as illustrated in FIG. 43 in order to facilitate settings of delay times of video signals in the delay circuit 485, according to the present disclosure. In order to make gamma characteristics to be linear, a predetermined voltage is applied to each of Tap for a voltage VXi1 corresponding to Level 1 in a grayscale and Tap for a voltage VXi7 corresponding to Level 1023 in the grayscale, and no voltage is applied to taps (for voltages VXi2 to VXi6) between Taps for the voltage VXi1 and a voltage VXi7. Here, a voltage common among RGB is applied to a terminal for a voltage VXi0. In FIG. 43, Levels 1 and 1023 in the grayscale are changed or set, and the other voltage input taps are not connected. Accordingly, input levels and output levels in the grayscale are linear between Levels 1 and 1023 in the grayscale. In other words, there is no gamma curve, and if an input level is the hundredth one, an output level is also the hundredth one.

Voltage settings to the terminals for the voltages VXi0 to VXi7 (X denotes R, G, or B) can be performed from outside the source driver IC (circuit) 14. A gamma curve can be arbitrarily set by setting voltages.

Needless to say, this embodiment is also applicable to other embodiments in the present disclosure. In addition, this embodiment can of course be combined with other embodiments.

The present disclosure has been explained taking EL display panels as examples in this specification, but the technical ideas of the present disclosure are not limited to the EL display panels. For example, the matters relating to the methods for the COFs in the present disclosure are of course applicable to LCDs etc.

Details (or part of the details) in the above embodiment described with reference to the drawings are applicable to various kinds of electronic devices. More specifically, the details are applicable to display parts of such electronic devices.

Examples of such electronic devices include: video cameras; digital cameras; goggles type displays; navigation systems; audio reproduction devices (car audio devices, audio compositions, etc.); computers; gaming machines; mobile information terminals (mobile computers, mobile telephones, mobile gaming machines, or electronic book readers, etc.); image reproduction devices with recording media (specifically, devices capable of reproducing images recorded on the recording media such as digital versatile discs (DVDs) and having a display on which the images can be displayed).

Figure 45:
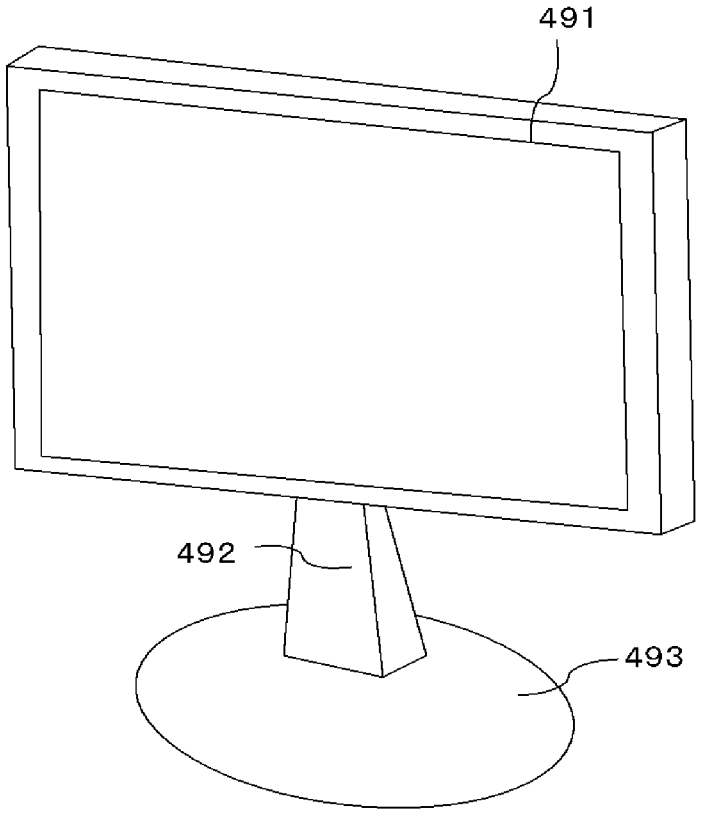
FIG. 45 is a diagram for explaining a display apparatus including an EL display according to an embodiment.

FIG. 45 is a display including a casing 492, a stand 493, and an EL display (EL display panel) according to the present disclosure. The display illustrated in FIG. 45 has a function for displaying various kinds of information (still images, videos, text images, etc.). Functions of the display illustrated in FIG. 45 are not limited thereto, and can have various functions.

Figure 46:
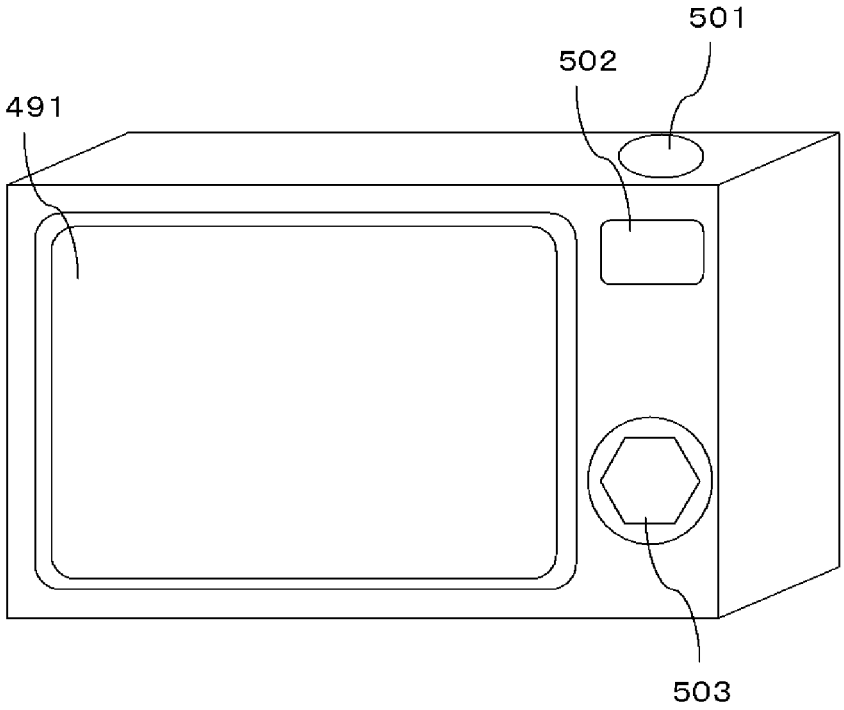
FIG. 46 is a diagram for explaining a display apparatus including an EL display according to an embodiment.

FIG. 46 is a camera including a shutter 501, a view finder 502, and a cursor 503. The camera illustrated in FIG. 5 has a function for capturing still images. The camera illustrated also has a function for capturing videos. Functions of the display illustrated in FIG. 5 are not limited thereto, and can have various functions.

Figure 47:
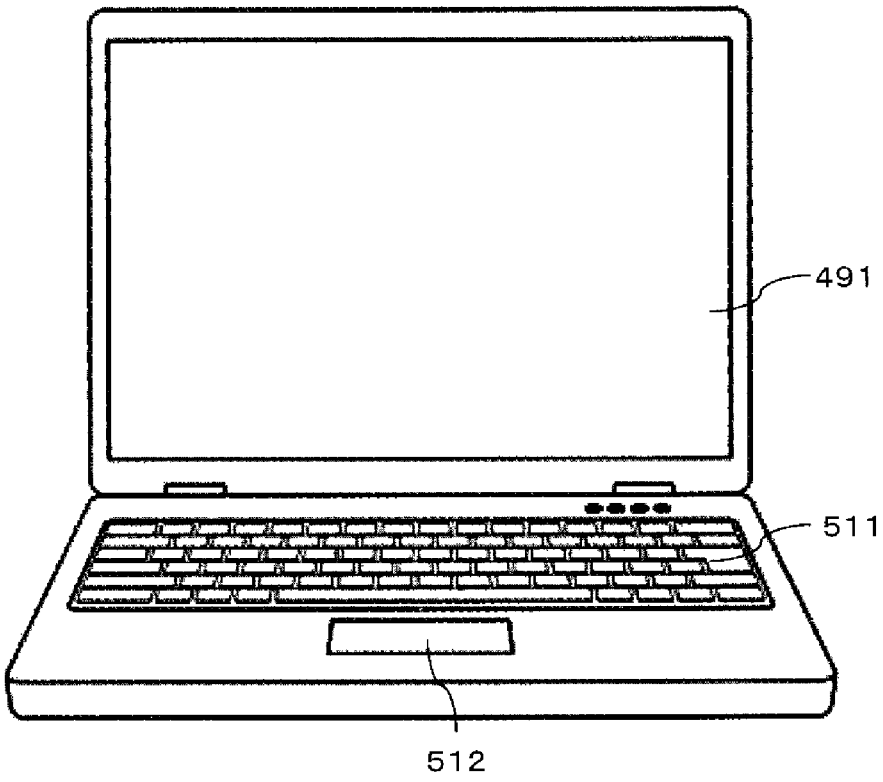
FIG. 47 is a diagram for explaining a display apparatus including an EL display according to an embodiment.

FIG. 47 illustrates a computer including a keyboard 511 and a touch pad 512. The computer illustrated in FIG. 47 has a function for displaying various kinds of information (still images, videos, text images, etc.) on a display part. Functions of the computer illustrated in FIG. 47 are not limited thereto, and can have various functions.

This applies to other drawings. The matters and content illustrated in the drawings or described in this embodiment of the specification according to the present disclosure are also applicable to other embodiments. The EL display panel illustrated in the drawings or described in this embodiment disclosed herein is applicable to EL displays according to the present disclosure.

For example, needless to say, as an EL display 491 of a note type personal computer in FIG. 47, one of the EL displays (EL display panels) illustrated in the drawings or described in this embodiment of the present disclosure can be employed, to comprise an information apparatus.

In the specification and drawings, generic names may be used to refer to the identical, similar, or related ones. For example, when both gate signal lines 17 and source signal lines 18 are described at the same time, these lines may be described or illustrated as signal lines 17 (18). A glass substrate 48 and a sealing substrate 30 may be referred to as substrates 30 (48).

Parts assigned with the same numbers or symbols have identical or similar shapes, materials, functions, relevant matters, perform identical or similar actions, or provide identical or similar effects.

In the embodiments of the specification and the drawings, matters, structures, effects etc. as described in other embodiments of the specification and the drawings are applicable unless otherwise specified, and thus the identical or similar descriptions etc. are not repeated.

The details illustrated in the drawings etc. can be combined with other embodiments etc. even when no such indication is provided. For example, it is possible to configure an information display device as illustrated in FIG. 45, 46, or 47 by adding a touch panel etc. on the EL display panel as illustrated in FIG. 1 or 2.

In this disclosure, for convenience' sake, configurations with only a panel are normally referred to as EL display panels, and configurations including a peripheral circuit such as a COF 22*g* as illustrated in FIG. 48 are referred to as EL displays. The EL display panels according to the present disclosure may conceptually be panel modules, and the the EL displays according to the present disclosure may conceptually be system apparatuses such as information apparatuses. The EL display panels may conceptually be the system apparatuses such as information apparatuses in a broad sense.

Although the COF 22*g* or the gate driver ICs 12 have been described in each of the embodiments of the present disclosure, the technical idea of the present disclosure is of course also applicable to the COF 22*s* or the source driver IC 14 in the embodiment.

Accordingly, the matters described in the specification are of course applicable to the COF 22*s* or the source driver IC 14, and also to the EL display including the same. This embodiment is of course also applicable to other embodiments in the present disclosure. In addition, this embodiment can be of course combined with other embodiments.

Although the driver transistors 11*a* and the switch transistors 11 (11*b*, 11*c*, 11*d*, 11*e*) have been described as thin-film transistors in the present disclosure, the present disclosure is not limited to the thin-film transistors. Thin-film diodes (TFD) or the like can be used to configure the same.

Such thin-film elements are non-limiting examples, and transistors formed on a silicon wafer are also possible. For example, transistors may be firstly formed on a silicon wafer, then pealed off from the silicon wafer, and finally printed on a glass board.

As a matter of course, the transistors 11 may be FETs, MOS-FETs, MOS transistors, or bi-polar transistors.

It is preferable that the transistors 11 according to the present disclosure be configured to have a lightly doped drain (LDD), irrespective of whether each transistor 11 is an N-channel transistor or a P-channel transistor.

Each transistor 11 may be made any of a high temperature polysilicon (HTPS), a low temperature polysilicon (LTPS), a continuous grain silicon (CGS), a transparent amorphous oxide semiconductor (TAOS, IZO), an amorphous silicon (AS), or an infrared RTA.

In FIG. 49, all of transistors included in pixels are configured as P-channel transistors. However, the present disclosure is not limited only to the configuration in which the transistors 11 included in the pixels are P-channel transistors. Only N-channel transistors may be used in the configuration. Alternatively, both of N-channel transistors and P-channel transistors may be used in the configuration. For example, the driver transistors 11*a* may be configured with both one or more P-channel transistors and one or more N-channel transistors.

Preferably, the transistors have a top gate structure. With the top gate structure, parasitic capacitance is reduced. This is because a gate electrode pattern of the top gate serves as a light blocking layer which blocks light emitted from EL elements 15, to reduce operation errors by the transistors and off-leak currents.

It is preferable to perform a process for enabling employment of copper lines or copper alloy lines as line materials for either gate signal lines or source signal lines, or both of gate signal lines and source signal lines. This is because line resistances of the signal lines can be reduced, which makes it possible to realize a larger EL display panel.

It is preferable that gate signal lines 17 driven (controlled) by a gate driver IC (circuit) 12 be configured to have a low impedance. Accordingly, the same applies to the configuration or structure of gate signal lines 17.

In particular, it is preferable that a low temperature polysilicon be employed. With the low temperature polysilicon, transistors are configured to have a top gate structure and thus have a small parasitic capacitance, P-channel transistors can be generated, and a copper wiring or copper alloy wiring process can be used. Preferably, a Tu-Cu-Ti three layer structure be employed for the copper lines.

In the case of a transparent amorphous oxide (TAOS) semiconductor, an Mo-Cu-Mo three layer structure be employed.

The thickness, size, etc. of some part are magnified or reduced to simplify explanation. This applies to the other drawings.

The panel board 31 described as a glass substrate may be a panel board 31 formed using a silicon wafer. Alternatively, the panel board 31 may be a panel board 31 formed using a metal substrate, a ceramic substrate, a plastic sheet (plate), or the like.

The materials and configurations for a sealing substrate 30 are similar to those for the panel board 31. In order to provide excellent heat dissipation, each of the sealing substrate 30 and the panel board 31 may of course be a sealing substrate 30 and a panel board 31 made of sapphire glass, or the like.

Needless to say, the embodiment is also applicable to other embodiments in the present disclosure. In addition, this embodiment can be of course combined with other embodiments.

By configuring the information devices or the like in FIGS. 45 and 46 to have the EL display (EL display panel) described in any of the above embodiments on the display part of this embodiment or perform the drive method, high quality images can be provided while reducing the cost. Tests and adjustments can be easily performed.

The embodiments can be performed in arbitrary combination with other embodiments.

INDUSTRIAL APPLICABILITY

The present disclosure makes it possible to reduce the number of control lines which are formed in serial connection on COFs can be reduced, and to provide EL displays with an excellent yield at low cost.

REFERENCE SIGNS LIST

11 Transistor
ll*a* Driver transistor
1l*b* Transistor
1l*c* Transistor
ll*d* Transistor
ll*e* Transistor
12 Gate driver IC
12*a* Gate driver IC
12*b* Gate driver IC
14 Gate driver IC
15 EL element
16 Pixel
16W Pixel
16*a* Pixel
16*b* Pixel
16*c* Pixel
16*d* Pixel
16*e* Pixel
17 Gate signal line
17*a* Gate signal line
17*b* Gate signal line
17*c* Gate signal line
17*d* Gate signal line
18 Gate signal line
19 Capacitor
19*a* Capacitor
19*b* Capacitor
22 COF
22 Flexible board
22*a*1 Flexible board
22*a*2 Flexible board
22*g* Flexible board
22*s* COF
25 Display screen
30 Sealing substrate
31 Panel board
33 Color filter
34 Insulation film
35 Display screen
36 Light blocking film
37 Connection part
38 Light scattering film
40 Anode electrode
43 Cathode electrode
44 Low resistance line
47 Bonding layer
48 Glass substrate
49 EL display panel
51 Shift register
51*a* Shift register
51*b* Shift register
51*c* Shift register
51*d* Shift register
52 Output buffer
53 Gate signal output circuit
53*a* Gate signal output circuit
53*b* Gate signal output circuit
53*c* Gate signal output circuit
53*d* Gate signal output circuit
54 Array connection line
71 Connection terminal (second connection part)
72 Driver output terminal (gate signal output terminal)
73 Driver input terminal (driver terminal)
73*a* Driver input terminal (driver terminal)
73*a*1 Driver input terminal
73*a*2 Driver input terminal
73*b* Driver input terminal (driver terminal)
73*b*1 Driver input terminal
73*b*2 Driver input terminal
74 COF line
74*a* COF line (serial connection line)
74*a*1 COF line
74*a*2 COF line
74*b* COF line (serial connection line)
74*b*2 COF line
74*c* COF line (serial connection line)
74*c*1 COF line
74*d* COF line (terminal connection line)

74*e* COF line (terminal connection line)
74*f*1 COF line
74*f*2 COF line
75 Connection terminal
75*a* Connection terminal (first connection part)
75*c* Connection terminal (gate signal connection part)
76 Operation terminal (control terminal)
76*a* Operation terminal
76*b* Operation terminal
91 Panel line
91*a* Panel line
91*a*1 Panel line
91*a*2 Panel line
91*b* Panel line
91*b*1 Panel line
91*c* Panel line
101 Voltage and signal input unit
141 Block
161 Switch circuit
261 Input control line
261*a* Input control line
261*b* Input control line
262 Internal line
262*a* Internal line
262*b* Internal line
262*c* Internal line
271 Bi-directional buffer
271*a* Bi-directional buffer
27l*b* Bi-directional buffer
481 Digital receiver
482 Gamma setting circuit
483 Shift register
484 Latch circuit
485 Delay circuit
486 DA converter circuit
487 Buffer circuit
488 Switch circuit
491 Display device
492 Casing
493 Stand
501 Shutter
502 View finder
503 Cursor
511 Keyboard
512 Touch pad
a Trajectory
b Trajectory
c Trajectory
A1 Block
A2 Block
A3 Block
A4 Block
AB Block
B1 Block
B2 Block
C1 Operation terminal
C2 Block
C6 Operation terminal
C7 Operation terminal
C8 Operation terminal
Clk Clock
Clk2 Clock data
ClkB1 Clock
ClkB2 Clock
Dat Data
DIO1 Start pulse
E1 Voltage circuit
E2 Voltage circuit
Enb Enable
EnbB1 Enable terminal
EnbB2 Enable terminal
LV0A Comparator input signal
RTA Infrared rays
S1*a* Driver input terminal
S2*b* Driver input terminal
S3*b* Driver input terminal
Ta Application period
Tb Application period
Tc Period
Va Reset voltage
Vs Video signal
Vdd Anode voltage
Vcc Logic voltage
Vini Initial voltage
Voff Off voltage
Voffl Voltage application terminal
Von On voltage
VonA On voltage
VonB On voltage
Vss Cathode voltage
Vgg Ground voltage
Vref Reset voltage
Y1 Source signal line

The invention claimed is:

1. An EL display comprising:

a panel board including a display screen on which pixels each including an EL element are arranged in a matrix;

gate signal lines arranged on a per pixel row basis;

source signal lines arranged on a per pixel column basis;

gate driver circuits mounted on a flexible board; and a source driver circuit which outputs a video signal to the source signal lines, wherein each of the gate driver circuits includes gate signal output terminals, driver terminals, and control terminals, first connection parts, gate signal connection parts, second connection parts, and third connection parts are arranged on a side of the flexible board, the flexible board includes (i) terminal connection lines which connect the gate signal output terminals and the gate signal connection parts, (ii) terminal connection lines which connect the control terminals and the second connection parts, and (iii) serial connection lines which connect the first connection parts, the driver terminals, and the third connection parts, the gate signal output terminals are arranged on a first side of each of the gate driver circuits, the driver terminals are arranged on a second side of each of the gate driver circuits, and the control terminals are arranged on a third side of each of the gate driver circuits which interconnects the first side and the second side, and panel lines formed on the panel board are connected to the second connection parts.

2. The EL display according to claim 1, wherein each of the gate driver circuits includes a plurality of shift register circuits.

3. The EL display according to claim 1, wherein at least one of the driver terminals is a terminal which sets a signal mode to be output from the one of the gate signal output terminals, the signal mode is one of (i) a first signal mode in which an on voltage and a first off voltage are applied or (ii) a second signal mode in which an on voltage, a first off voltage, and a second off voltage are applied, and the one of the first signal mode or the second signal mode is selected by the terminal which sets the signal mode.

4. The EL display according to claim 1, wherein a voltage to be applied to the panel lines connected to the second connection parts is either a logic setting voltage or a voltage to be output from the one of the gate signal output terminals.

5. The EL display according to claim 1, wherein each of the pixels is passed through by the gate signal lines, and each of the gate driver circuits includes n shift register circuits, n being an integer of 2 or larger.

6. The EL display according to claim 1, wherein a plurality of gate signal output circuits are formed in each of the gate driver circuits, and an independent voltage Von is applied to each of the gate signal output circuits.

7. The EL display according to claim 1, a first one of the gate driver circuits is arranged on a first side of the display screen, and a second one of the gate driver circuits is arranged on a second side of the display screen.

8. An EL display comprising, a panel board including a display screen on which pixels each including an EL element are arranged in a matrix;

gate signal lines arranged on a per pixel row basis;

source signal lines arranged on a per pixel column basis;

gate driver circuits mounted on a flexible board; and a source driver circuit which outputs a video signal to the source signal lines, wherein each of the gate driver circuits includes gate signal output terminals, first driver terminals, second driver terminals, and control terminals, first connection parts, gate signal connection parts, second connection parts, and third connection parts are arranged on a side of the flexible board, the flexible board includes (i) terminal connection lines which connect the gate signal output terminals and the gate signal connection parts, (ii) terminal connection lines which connect the control terminals and the second connection parts, and (iii) serial connection lines which connect the first connection parts, the driver terminals, and the third connection parts, the gate signal output terminals are arranged on a first side of each of the gate driver circuits, the first driver terminals and the second driver terminals are arranged on a second side of each of the gate driver circuits, and the control terminals are arranged on a third side of each of the gate driver circuits which interconnects the first side and the second side, and panel lines formed on the panel board are connected to the second connection parts, and the second connection parts and the control terminals are connected with the terminal connection lines.

9. The EL display according to claim 8, wherein each of the gate driver circuits includes a plurality of shift register circuits.

10. The EL display according to claim 8, wherein at least one of the driver terminals is a terminal which sets a signal mode to be output from the one of the gate signal output terminals, the signal mode is one of (i) a first signal mode in which an on voltage and a first off voltage are applied or (ii) a second signal mode in which an on voltage, a first off voltage, and a second off voltage are applied, and the one of the first signal mode or the second signal mode is selected by the terminal which sets the signal mode.

11. The EL display according to claim 8, wherein a voltage to be applied to the panel lines connected to the second connection parts is either a logic setting voltage or a voltage to be output from the one of the gate signal output terminals.

12. The EL display according to claim 8, wherein each of the pixels is passed through by the gate signal lines, and each of the gate driver circuits includes n shift register circuits, n being an integer of 2 or larger.

13. The EL display according to claim 8, wherein a plurality of gate signal output circuits are formed in each of the gate driver circuits, and an independent voltage Von is applied to each of the gate signal output circuits.

14. An EL display comprising, a panel board including a display screen on which pixels each including an EL element are arranged in a matrix;

gate signal lines arranged on a per pixel row basis;

source signal lines arranged on a per pixel column basis;

gate driver circuits mounted on a flexible board; and a source driver circuit which outputs a video signal to the source signal lines, wherein each of the gate driver circuits includes gate signal output terminals, first driver terminals, second driver terminals, and control terminals, first connection parts, gate signal connection parts, second connection parts, and third connection parts are arranged on a side of the flexible board, the flexible board includes (i) terminal connection lines which connect the gate signal output terminals and the gate signal connection parts, (ii) terminal connection lines which connect the control terminals and the second connection parts, (iii) terminal connection lines which connect the first connection parts and the first driver terminals, and (iv) terminal connection lines which connect the second driver terminals and the third connection parts, the first driver terminals and the second driver terminals are connected by lines formed in each of the gate driver circuits, the gate signal output terminals are disposed on a first side of each of the gate driver circuits, the first driver terminals and the second driver terminals are disposed on a second side of each of the gate driver circuits, the second side being opposite the first side, and the control terminals are one of disposed on a third side of each of the gate driver circuits which interconnects the first side and the second side and disposed on an end portion of the first side.

15. The EL display according to claim 14, wherein each of the gate driver circuits includes a plurality of shift register circuits.

16. The EL display according to claim 14, wherein a bi-directional buffer circuit is arranged at a point on a line formed in each of the gate driver circuits.

17. The EL display according to claim 14, wherein at least one of the driver terminals is a terminal which sets a signal mode to be output from the one of the gate signal output terminals, the signal mode is one of (i) a first signal mode in which an on voltage and a first off voltage are applied or (ii) a second signal mode in which an on voltage, a first off voltage, and a second off voltage are applied, and the one of the first signal mode or the second signal mode is selected by the terminal which sets the signal mode.

18. The EL display according to claim 14, wherein each of the pixels is passed through by the gate signal lines, and each of the gate driver circuits includes n shift register circuits, n being an integer of 2 or larger.

19. The EL display according to claim 14, wherein a plurality of gate signal output circuits are formed in each of the gate driver circuits, and an independent voltage Von is applied to each of the gate signal output circuits.

20. The EL display according to claim 14, a first one of the gate driver circuits is arranged on a first side of the display screen, and a second one of the gate driver circuits is arranged on a second side of the display screen.

* * * * *